US009798284B2

(12) United States Patent
Shimizu et al.

(10) Patent No.: US 9,798,284 B2
(45) Date of Patent: Oct. 24, 2017

(54) BLADE AND IMAGE FORMING APPARATUS INCORPORATING SAME

(71) Applicants: Eisuke Shimizu, Tokyo (JP); Kazuhiko Watanabe, Tokyo (JP); Takaaki Tawada, Kanagawa (JP); Yuu Sakakibara, Kanagawa (JP)

(72) Inventors: Eisuke Shimizu, Tokyo (JP); Kazuhiko Watanabe, Tokyo (JP); Takaaki Tawada, Kanagawa (JP); Yuu Sakakibara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/062,705

(22) Filed: Mar. 7, 2016

(65) Prior Publication Data

US 2016/0259293 A1 Sep. 8, 2016

(30) Foreign Application Priority Data

Mar. 6, 2015 (JP) ..... 2015-044804
May 29, 2015 (JP) ..... 2015-110766

(51) Int. Cl.
*G03G 21/00* (2006.01)

(52) U.S. Cl.
CPC . *G03G 21/0017* (2013.01); *G03G 2215/0132* (2013.01)

(58) Field of Classification Search
None
See application file for complete search history.

(56) References Cited

U.S. PATENT DOCUMENTS

2005/0100375 A1 5/2005 Naruse et al.
2006/0099016 A1 5/2006 Watanabe et al.
2006/0285898 A1 12/2006 Watanabe et al.
(Continued)

FOREIGN PATENT DOCUMENTS

JP 2014-163995 9/2014

OTHER PUBLICATIONS

U.S. Appl. No. 14/857,955, filed Sep. 18, 2015.

*Primary Examiner* — Thomas Giampaolo, II
(74) *Attorney, Agent, or Firm* — Harness, Dickey & Pierce, P.L.C.

(57) ABSTRACT

A multilayered blade made of an elastic material includes an edge layer, having a contact edge to contact an object, and at least one backup layer laminated on the edge layer.
The blade has a converted loss tangent tan δ of 0.23 or greater and 0.51 or smaller in a temperature range of from 0° C. to 50° C. The converted loss tangent tan δ is defined as:

$$X = \frac{A}{A+B} \times L_1 + \frac{B}{A+B} \times L_2,$$

where X represents the converted loss tangent tan δ, A represents a thickness in millimeters of the edge layer, B represents a thickness in millimeters of the at least one backup layer, $L_1$ represents a variation of a loss tangent tan δ of the edge layer in the temperature range of from 0° C. to 50° C., and $L_2$ represents a variation of a loss tangent tan δ of the at least one backup layer in the temperature range of from 0° C. to 50° C.

13 Claims, 14 Drawing Sheets

(56) References Cited

U.S. PATENT DOCUMENTS

| | | | | |
|---|---|---|---|---|
| 2007/0003337 | A1 | 1/2007 | Shakuto et al. | |
| 2008/0063448 | A1 | 3/2008 | Hozumi et al. | |
| 2009/0123205 | A1 | 5/2009 | Watanabe et al. | |
| 2010/0067945 | A1 | 3/2010 | Hozumi et al. | |
| 2010/0067949 | A1 | 3/2010 | Watanabe et al. | |
| 2010/0247188 | A1* | 9/2010 | Fukuda ..... | G03G 21/0017 399/350 |
| 2011/0229186 | A1 | 9/2011 | Okamoto et al. | |
| 2011/0229188 | A1 | 9/2011 | Watanabe et al. | |
| 2011/0229233 | A1 | 9/2011 | Watanabe et al. | |
| 2012/0243915 | A1* | 9/2012 | Nakane ..... | G03G 21/0017 399/283 |
| 2014/0119769 | A1 | 5/2014 | Kikuchi et al. | |
| 2014/0193172 | A1 | 7/2014 | Tawada et al. | |
| 2014/0233998 | A1 | 8/2014 | Watanabe et al. | |
| 2014/0341629 | A1 | 11/2014 | Watanabe et al. | |
| 2015/0370217 | A1 | 12/2015 | Shimizu et al. | |

* cited by examiner

PERIPHERAL LENGTH: C1

PROJECTED AREA: S

AREA: S

PERIPHERAL LENGTH: C2

BLADE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-044804 filed on Mar. 6, 2015 and 2015-110766 filed on May 29, 2015, in the Japan Patent Office, the entire disclosure of each of which is hereby incorporated by reference herein.

BACKGROUND

Technical Field

Embodiments of the present invention generally relate to a blade used for cleaning and an image forming apparatus, such as a copier, a printer, a facsimile machine, or a multifunction peripheral having at least two of copying, printing, facsimile transmission, plotting, and scanning capabilities, that includes the blade.

Description of the Related Art

In electrophotographic image forming apparatuses, after a toner image is transferred from a surface of an image bearer such as a photoconductor onto a transfer sheet or an intermediate transfer member, a cleaning device removes toner remaining on the surface of the image bearer.

Cleaning devices employing a cleaning blade, shaped like a strip, are widely used for simplicity in structure and high cleaning capability. There are single-layer blades and multilayer blades used for cleaning.

SUMMARY

An embodiment of the present invention provides a multilayered blade made of an elastic material. The blade includes an edge layer including a contact edge to contact an object and at least one backup layer laminated on the edge layer. The blade has a converted loss tangent tan δ of 0.23 or greater and 0.51 or smaller in a temperature range of from 0° C. to 50° C., and the converted loss tangent tan δ is defined as:

$$X = \frac{A}{A+B} \times L_1 + \frac{B}{A+B} \times L_2$$

where X represents the converted loss tangent tan δ, A represents a thickness in millimeters of the edge layer, B represents a thickness in millimeters of the at least one backup layer, $L_1$ represents a variation of a loss tangent tan δ of the edge layer in the temperature range of from 0° C. to 50° C., and $L_2$ represents a variation of a loss tangent tan δ of the at least one backup layer in the temperature range of from 0° C. to 50° C.

In another embodiment, a multilayered blade made of an elastic material includes an edge layer including a contact edge to contact an object and a multilayered backup layer laminated on the edge layer. The multilayered backup layer includes a first backup layer laminated on the edge layer and a second backup layer laminated on the first backup layer. The multilayered blade has a converted loss tangent tan δ of 0.23 or greater and 0.51 or smaller in a temperature range of from 0° C. to 50° C., and the converted loss tangent tan δ is defined as:

$$X = \frac{A}{A+B} \times L_1 + X_B$$

$$X_B = \frac{B_1}{A+B} \times L_{B1} + \frac{B_2}{A+B} \times L_{B2}$$

where X represents the converted loss tangent tan δ, A represents a thickness in millimeters of the edge layer, $B_1$ represents a thicknesses in millimeters of the first backup layer, $B_2$ represents a thickness in millimeters of the second backup layer, $L_1$ represents a variation of a loss tangent tan δ of the edge layer in the temperature range of from 0° C. to 50° C., $L_{B1}$ represents a variations of a loss tangent tan δ of the first backup layer in the temperature range of from 0° C. to 50° C., and $L_{B2}$ represents a variations of a loss tangent tan δ of the second backup layer in the temperature range of from 0° C. to 50° C.

In yet another embodiment, an elastic blade includes an edge region, which includes a contact edge to contact a contact object, and an adjacent region adjacent to the edge region on a cross section perpendicular to a direction in which the contact edge extends. The blade has a converted loss tangent tan δ of 0.23 or greater and 0.51 or smaller in a temperature range of from 0° C. to 50° C., and the converted loss tangent tan δ is defined as:

$$X = \frac{S_A}{S_A+S_B} \times L_1 + \frac{S_B}{S_A+S_B} \times L_2$$

where X represents the converted loss tangent tan δ, $S_A$ represents a cross-sectional area in square millimeters of the edge region, $S_B$ represents a cross-sectional area in square millimeters of the adjacent region, $L_1$ represents a variation of a loss tangent tan δ of the edge region in the temperature range of from 0° C. to 50° C., and $L_2$ represents a variation of a loss tangent tan δ of the adjacent region in the temperature range of from 0° C. to 50° C.

In yet another embodiment, an image forming apparatus includes an image bearer to bear an image, a charger to charge a surface of the image bearer, an exposure device to expose the surface of the charged image bearer to form an electrostatic latent image on the image bearer, a developing device to develop the electrostatic latent image into a toner image, a transfer device to transfer the toner image from the image bearer onto a recording medium, a fixing device to fix the toner image on the recording medium, and a cleaning device to remove residual toner from the image bearer. The cleaning device includes the blade according to one of the above-described blades.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
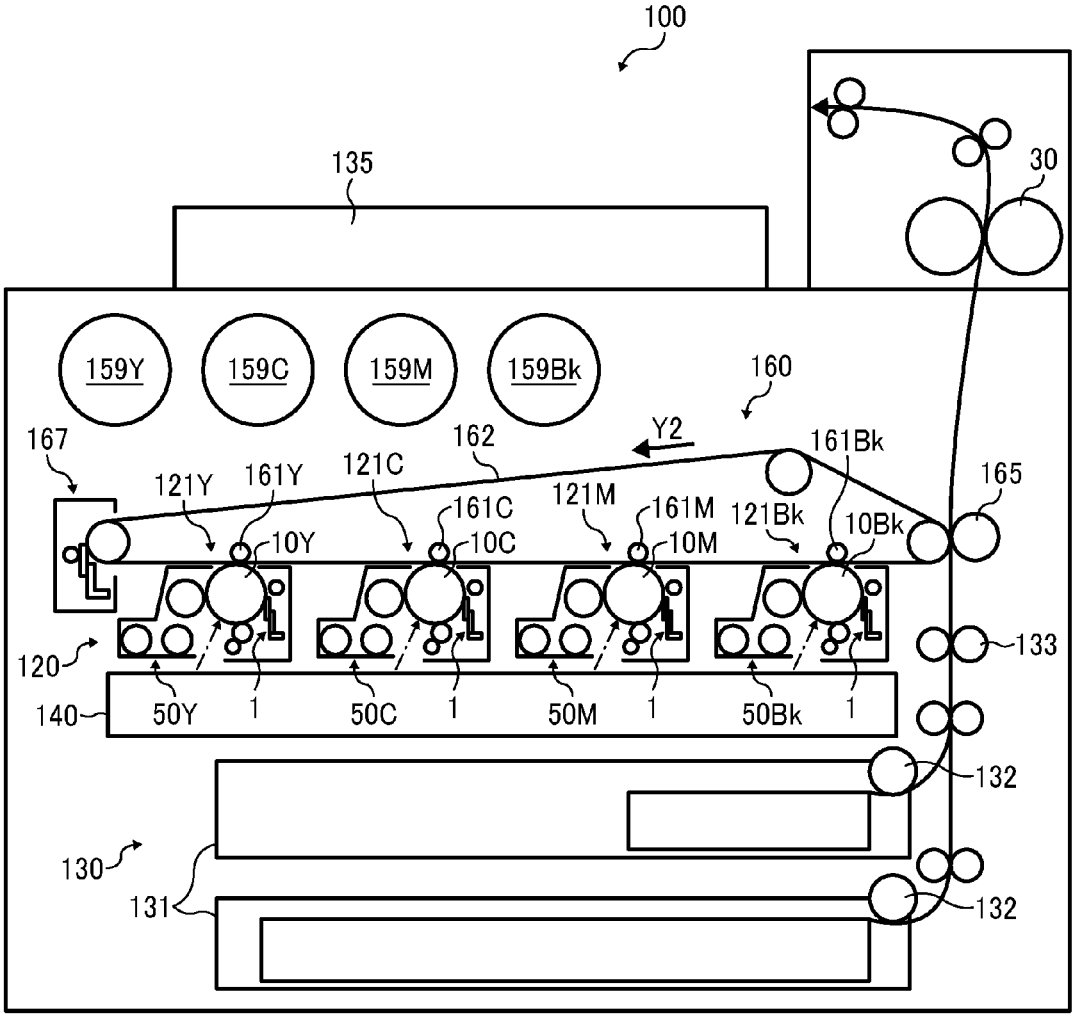
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

First Embodiment

With reference to FIG. 1, descriptions are given below of an electrophotographic color printer as an example of an image forming apparatus 100 according to a first embodiment of the present disclosure.

FIG. 1 is a schematic diagram of the image forming apparatus 100 according to the first embodiment.

The image forming apparatus 100 is capable of forming multicolor images and includes an image forming unit 120, an intermediate transfer unit 160, and a sheet feeder 130. It is to be noted that reference characters Y, C, M, and Bk represent yellow, magenta, cyan, and black, respectively, and may be omitted in the description below when color discrimination is not necessary.

The image forming unit 120 includes process cartridges 121Y, 121C, 121M, and 121Bk for yellow, cyan, magenta, and black, respectively. The process cartridges 121Y, 121C, 121M, and 121Bk are arranged in line in a substantially horizontal direction. The process cartridges 121 are removably insertable into the image forming apparatus 100.

The intermediate transfer unit 160 includes an intermediate transfer belt 162, which is an endless belt, primary transfer rollers 161Y, 161C, 161M, and 161Bk, and a secondary transfer roller 165. The intermediate transfer belt 162 is entrained around multiple support rollers. The intermediate transfer belt 162 is positioned above the process cartridges 121 and along the direction in which drum-shaped photoconductors 10Y, 10C, 10M, and 10Bk (i.e., latent image bearers) of the process cartridges 121Y, 121C, 121M, and 121Bk rotate. The intermediate transfer belt 162 rotates in synchronization with the rotation of the photoconductors 10. The primary transfer rollers 161 are positioned along the inner circumferential side of the intermediate transfer belt 162. With the primary transfer rollers 161, the outer face of the intermediate transfer belt 162 is lightly pressed against the surfaces of the photoconductors 10.

The process cartridges 121 are similar in configuration and operation to form toner images on the photoconductors 10, respectively, and transfer the toner images onto the intermediate transfer belt 162. A pivot mechanism is provided for the three primary transfer rollers 161Y, 161C, and 161M corresponding to the process cartridges 121Y, 121C, and 121 M for colors other than black to move these primary transfer rollers 161 vertically. The pivot mechanism disengages the intermediate transfer belt 162 from the photoconductors 10Y, 10C, and 10M when multicolor image formation is not performed. Additionally, a belt cleaning device 167 is disposed downstream from the secondary transfer roller 165 and upstream from the process cartridge 121Y in the direction indicated by arrow Y2 illustrated in FIG. 5, in which the intermediate transfer belt 162 rotates.

Above the intermediate transfer unit 160, toner cartridges 159 for the respective process cartridges 121 are arranged substantially horizontally. Below the process cartridges 121, an exposure device 140 is disposed. The exposure device 140 directs laser beams to the charged surfaces of the photoconductors 10 to form electrostatic latent images thereon.

The sheet feeder 130 is disposed below the exposure device 140. The sheet feeder 130 includes sheet trays 131 for containing sheets of recording media and sheet feeding rollers 132. The sheet feeder 130 feeds sheets to a secondary transfer nip formed between the intermediate transfer belt 162 and the secondary transfer roller 165 via a pair of registration rollers 133 at a predetermined timing.

A fixing device 30 is disposed downstream from the secondary transfer nip in the direction in which sheets are transported (hereinafter "sheet conveyance direction"). Further, an ejection roller and an output tray 135 to receive sheets discharged are disposed downstream from the fixing device 30 in the sheet conveyance direction.

Figure 2:
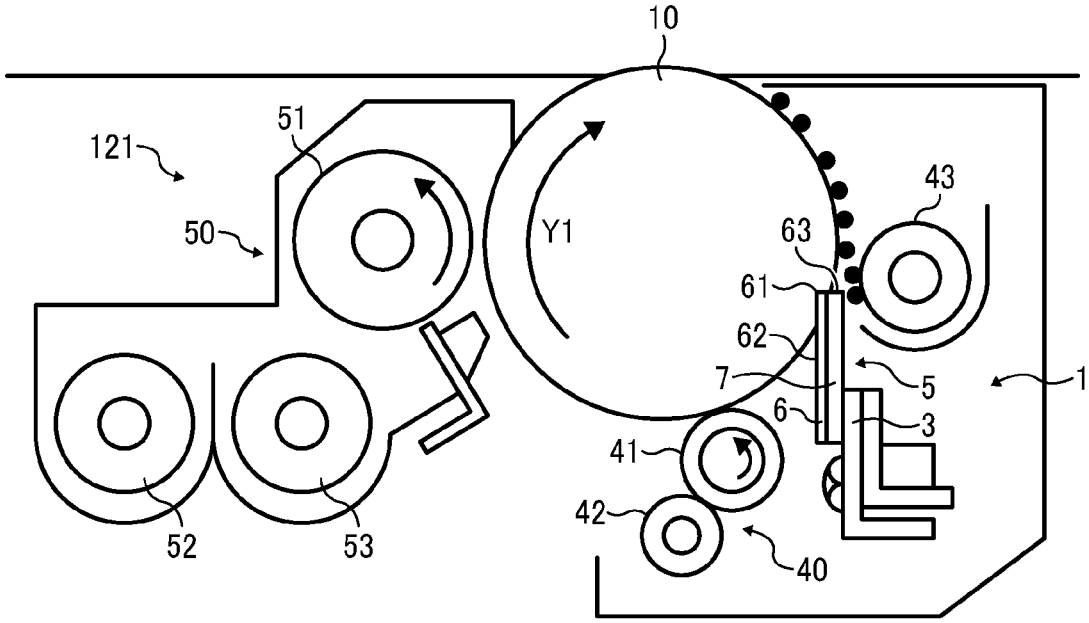
FIG. 2 is a schematic cross-sectional view illustrating a process cartridge installable in the image forming apparatus illustrated in FIG. 1.

FIG. 2 schematically illustrates a configuration of the process cartridge 121 of the image forming apparatus 100. The process cartridges 121 have a similar configuration, and therefore the subscripts Y, C, M, and Bk for color discrimination are omitted when the configuration and operation of the process cartridges 121 are described.

In addition to the drum-shaped photoconductor 10, the process cartridge 121 includes a cleaning device 1, a charging device 40, and a developing device 50 disposed around the photoconductor 10.

The cleaning device 1 includes an elastic cleaning blade 5, which is shaped like a strip and long in the axial direction of the photoconductor 10. The cleaning blade 5 is multilayered. An edge 61 (ridgeline) of the cleaning blade 5 extends in a direction perpendicular to the direction of rotation of the photoconductor 10, and the edge 61 is pressed to the surface of the photoconductor 10. With the edge 61 pressed against the surface of the photoconductor 10, the cleaning device 1 removes substances, such as residual toner, from the surface of the photoconductor 10. A discharge screw 43 of the cleaning device 1 discharges the removed toner outside cleaning device 1.

The charging device 40 includes a charging roller 41 opposing the photoconductor 10 and a roller cleaner 42 that rotates while being contact with the charging roller 41.

The developing device 50 is designed to supply toner to the surface of the photoconductor 10 to develop the latent image formed thereon into a visible image and includes a developing roller 51 serving as a developer bearer to bear developer including carrier and toner. The developing device 50 includes the developing roller 51, an agitation screw 52, and a supply screw 53. The agitation screw 52 stirs and transports developer contained in the developing device 50 (in particular, a developer container therein), and the supply screw 53 transports the developer while supplying the agitated developer to the developing roller 51.

The four process cartridges 121 having the above-described configuration can be independently removed from a printer body, installed therein, and replaced by service persons or users. When the process cartridge 121 is removed from the image forming apparatus 100, the photoconductor 10, the charging device 40, the developing device 50, and the cleaning device 1 can be replaced independently. It is to be noted that the process cartridge 121 may further includes a waste-toner tank to collect the toner removed by the cleaning device 1. In this case, it is convenient when the waste-toner tank is independently removable, installable, and replaceable.

Next, operation of the image forming apparatus 100 is described below.

The image forming apparatus 100 receives print commands via a control panel of the printer body thereof or from external devices such as computers.

Initially, the photoconductor 10 starts rotating in the direction indicated by arrow Y1 illustrated in FIG. 2, and the charging rollers 41 charge the surfaces of the photoconductors 10 uniformly to a predetermined polarity. The exposure device 140 directs light, such as laser beams, for respective colors to the charged photoconductors 10. The laser beams are optically modulated according to multicolor image data input to the image forming apparatus 100. Thus, electrostatic latent images for respective colors are formed on the photoconductors 10. The developing rollers 51 of the developing devices 50 supply respective color toners to the electrostatic latent images, thereby developing the electrostatic latent images into toner images.

Subsequently, the transfer voltage opposite in polarity to the toner image is given to the primary transfer roller 161, thereby forming a primary transfer electrical field between the photoconductor 10 and the primary transfer roller 161 via the intermediate transfer belt 162. Simultaneously, the primary transfer nip is formed by the primary transfer roller 161 lightly pressed against the intermediate transfer belt 162. With these actions, the toner images on the respective photoconductors 10 are primarily transferred onto the intermediate transfer belt 162 efficiently. The single color toner images are superimposed one on another on the intermediate transfer belt 162, forming a multilayer toner image (i.e., multicolor toner image).

Toward the multilayer toner image on the intermediate transfer belt 162, a sheet is timely transported from the sheet tray 131 via the sheet feeding roller 132 and the pair of registration rollers 133. A transfer voltage opposite in polarity to toner images is given to the secondary transfer roller 165, thereby forming a secondary-transfer electrical field between the intermediate transfer belt 162 and the secondary transfer roller 165 via the sheet. The toner image is transferred onto the sheet by the secondary-transfer electrical field.

The sheet is then transported to the fixing device 30, in which the toner image is fixed on the sheet with heat and pressure. The sheet bearing the fixed toner image is discharged by the ejection roller to the output tray 135.

After the primary-image transfer, toner remaining on the respective photoconductors 10 is removed by the cleaning blades 5 of the cleaning devices 1.

Figure 3:
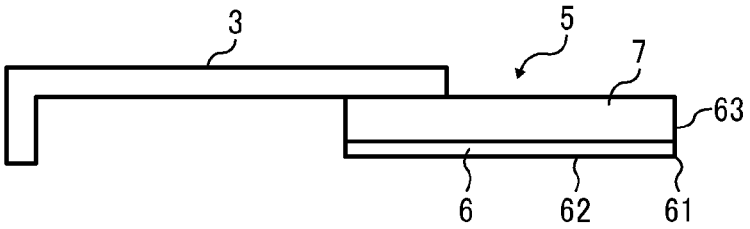
FIG. 3 is a cross-sectional view of a cleaning blade according to an embodiment.

As illustrated in FIG. 3, the cleaning device 1 includes a support 3 to support a base end of the cleaning blade 5 such that the edge 61 (the ridgeline or corner at the end opposite the base end) abuts or contacts the surface of the photoconductor 10 (i.e., a contact object). The cleaning blade 5 includes an edge layer 6, which includes the edge 61, and a backup layer 7 laminated on the edge layer 6. Thus, the cleaning blade 5 is a bilayer blade as well as an elastic blade.

As illustrated in FIG. 2, an outer face 62 of the edge layer 6 extending from the edge 61 is disposed facing the downstream side in the direction indicated by arrow Y1, in which the photoconductor 10 rotates, and the backup layer 7 and an end face 63 at a free end of the edge layer 6 are disposed facing the upstream side in the direction of rotation of the photoconductor 10. That is, the in FIG. 2, the cleaning blade 5 is disposed to contact or abut the surface of the photoconductor 10 (rotating clockwise in FIG. 2) in the direction counter to the rotation of the photoconductor 10.

Typically, cleaning blades are designed to be used in a temperature range centered on ordinary temperature or room temperature (for example, 23° C.), and there is a risk of degradation of cleaning capability if the environment changes to a hot or cold environment.

The following is a conceivable cause of the degradation of cleaning capability.

When a loss tangent tan δ (i.e., a ratio of dynamic loss modulus to dynamic storage elastic modulus) of the blade lowers due to environmental changes, the entire blade is more likely to vibrate. This is because the dynamic loss modulus becomes smaller and the dynamic storage elastic modulus becomes greater, and the material of the blade absorbs energy less easily and becomes highly resilient.

By contrast, when the tan δ increases, fatigue of the blade easily occurs. This is because the dynamic loss modulus becomes greater and the dynamic storage elastic modulus becomes smaller, and the material of the blade easily absorbs energy. Then, permanent deformation easily occurs.

When the blade easily vibrates or is easily fatigued, the amount of toner that passes between the image bearer and the edge of the cleaning blade increases. Accordingly, the cleaning capability is degraded.

In view of the foregoing, the inventors have devised the cleaning blade 5, which is described in detail below, to suppress vibration and fatigue due to changes in the environment (temperature in particular).

Descriptions are given below of multiple configurations of the cleaning blade 5 usable in each cleaning device 1 of the image forming apparatus 100 according to the first embodiment.

Embodiment 1-1

The cleaning blade 5 according to Embodiment 1-1, usable in the cleaning device 1 according to the first embodiment, is described with reference to the drawings.

Figure 4A:
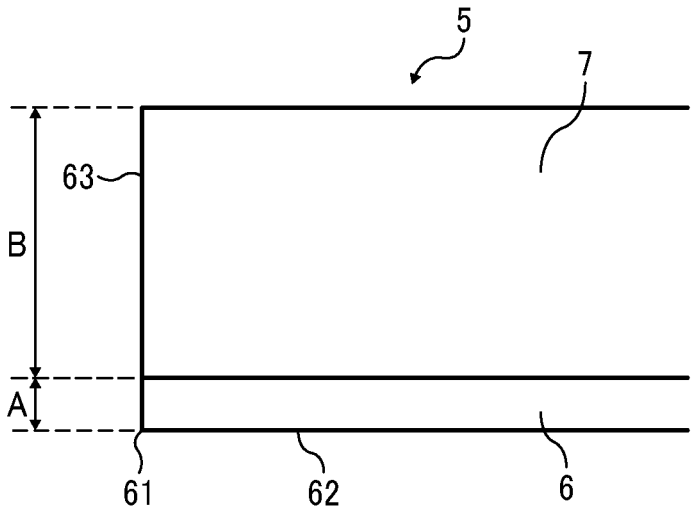
FIGS. 4A and 4B are diagrams for understanding of Formula 1 to define converted tan δ according to a first embodiment.
Figure 4B:
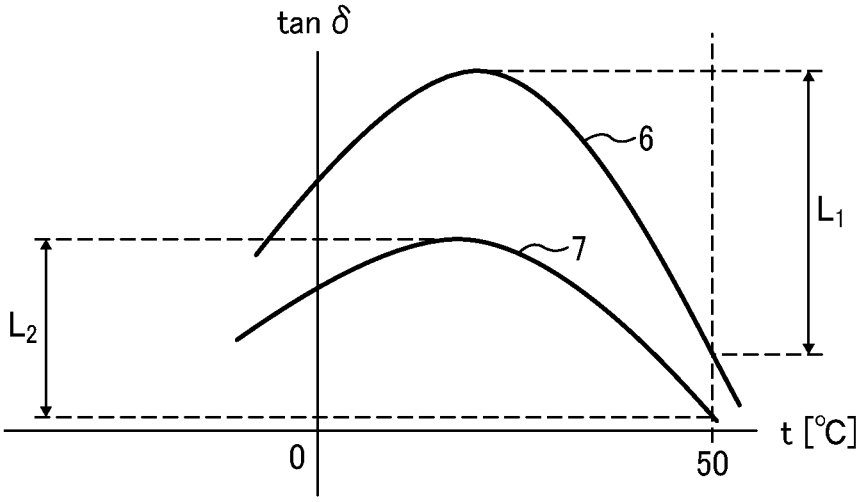

With reference to FIGS. 4A and 4B, Formula 1 to define a converted tan δ (X) according to the present embodiment is described. FIG. 4A is a schematic diagram that illustrates a thickness A of the edge layer 6 and a thickness B of the backup layer 7. FIG. 4B is a graph of variation (amount of change) of tan δ (hereinafter "tan δ variation $L_1$") of the edge layer 6 and variation of tan δ (hereinafter "tan δ variation $L_2$") of the backup layer 7.

The cleaning blade 5 according to Embodiment 1-1 is designed so that the converted tan δ (X) defined by Formula 1 is equal to or greater than 0.23 and equal to or smaller than 0.51 in a temperature range of from 0° C. to 50° C.

$$X = \frac{A}{A+B} \times L_1 + \frac{B}{A+B} \times L_2 \qquad \text{Formula 1}$$

where X represents the converted tan δ, A represents the thickness (in millimeters) of the edge layer 6, B represents the thickness (in millimeters) of the backup layer 7, $L_1$ represents the variation of tan δ of the edge layer 6, and $L_2$ represents the variation of tan δ of the backup layer 7.

As illustrated in FIG. 4A, the thickness A of the edge layer 6 and the thickness B of the backup layer 7 are lengths in the direction perpendicular to the outer face 62 of the edge layer 6 of the cleaning blade 5 before the cleaning blade 5 deforms. As described above, the outer face 62 faces the downstream side in the direction of rotation of the photoconductor 10.

Each of the terms "tan δ variation $L_1$ of the edge layer 6" and "tan δ variation $L_2$ of the backup layer 7" used in this specification mean the difference between a maximum and a minimum of the tan δ when ambient temperature changes from 0° C. to 50° C.

For example, an elastic material, such as urethane rubber, is usable for each layer of the cleaning blade 5.

Formula 1 mentioned above defines the value X of the converted tan δ, which serves as an index of loss tangent tan δ of the entire cleaning blade 5 (i.e., the bilayer cleaning blade 5) in the temperature range of from 0° C. to 50° C.

By setting the range of the converted tan δ (X) to 0.23 or greater and 0.51 or smaller (i.e., a range of from 0.23 to 0.51), the tan δ of the entire cleaning blade 5 is kept in a suitable range while suppressing fluctuations (variation) in the tan δ of the entire cleaning blade 5 due to environmental changes (temperature changes in particular). Accordingly, the tan δ of the entire cleaning blade 5 can be set in a suitable range. Thus, the degradation of cleaning capability of the cleaning blade 5 is suppressed.

Next, a verification experiment performed to ascertain effects of the cleaning blade 5 according to Embodiment 1-1 is described.

It is to be noted that the tan δ is measured using a dynamic viscoelasticity measuring instrument in the temperature range of from 0° C. to 50° C., and dynamic storage elastic modulus (E') and dynamic loss modulus (E") are measured at constant frequency or multiple frequencies. Then, the tan δ (dynamic loss tangent, =E'/E") of the material such as urethane rubber used for the cleaning blade 5 is calculated.

The cleaning blade 5 used in the experiment is made of urethane rubber, and there is no urethane rubber satisfying the converted tan δ (X) smaller than 0.23. Accordingly, in the verification, the converted tan δ (X) was 0.23 or greater.

Multiple configurations of the cleaning blade 5 according to Embodiment 1-1 and comparative examples, used in the verification experiment, and verification results thereof are indicated in Table 1 below.

TABLE 1

| | X | A [mm] | B [mm] | $L_1$ | $L_2$ | Cleaning capability |
|---|---|---|---|---|---|---|
| Configuration 1 | 0.23 | 0.50 | 1.30 | 0.30 | 0.20 | Excellent |
| Configuration 2 | 0.24 | 0.50 | 1.30 | 0.35 | 0.20 | Excellent |
| Configuration 3 | 0.29 | 0.80 | 1.00 | 0.40 | 0.20 | Excellent |
| Configuration 4 | 0.29 | 0.60 | 1.30 | 0.50 | 0.20 | Good |
| Configuration 5 | 0.28 | 0.50 | 1.30 | 0.50 | 0.20 | Good |
| Configuration 6 | 0.30 | 0.80 | 0.90 | 0.30 | 0.30 | Good |
| Configuration 7 | 0.31 | 0.50 | 1.10 | 0.55 | 0.20 | Good |
| Configuration 8 | 0.33 | 0.80 | 0.80 | 0.25 | 0.40 | Good |
| Configuration 9 | 0.33 | 0.80 | 1.00 | 0.50 | 0.20 | Good |
| Configuration 10 | 0.35 | 0.50 | 1.40 | 0.50 | 0.30 | Good |
| Configuration 11 | 0.35 | 0.80 | 0.80 | 0.50 | 0.20 | Good |
| Configuration 12 | 0.41 | 0.70 | 1.00 | 0.70 | 0.20 | Acceptable |
| Configuration 13 | 0.46 | 0.50 | 1.50 | 0.80 | 0.35 | Acceptable |
| Configuration 14 | 0.51 | 0.50 | 1.30 | 0.80 | 0.40 | Acceptable |
| Comparative example 1 | 0.52 | 0.40 | 1.30 | 0.60 | 0.50 | Bad |
| Comparative example 2 | 0.57 | 0.50 | 1.00 | 0.70 | 0.50 | Bad |
| Comparative example 3 | 0.60 | 0.50 | 1.50 | 0.90 | 0.50 | Bad |
| Comparative example 4 | 0.67 | 0.50 | 1.00 | 0.80 | 0.60 | Bad |
| Comparative example 5 | 0.68 | 0.50 | 1.30 | 0.90 | 0.60 | Bad |
| Comparative example 6 | 0.71 | 0.50 | 1.30 | 1.00 | 0.60 | Bad |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 14 and Comparative examples 1 through 6 indicated in Table 1.

In each of the cold environment (10° C.), the ordinary temperature environment (23° C.), and the hot environment (32° C.), the test machine was left unused for 24 hours, and then images were successively output on 10,000 sheets. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 10,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 10,000 sheets. There is no practical disadvantage.

Acceptable: In each of the three environments, no trace of defective cleaning is observed on the sheets after output of 10,000 sheets. Although there is no practical disadvantage, in one of the three environments, toner escaping the cleaning blade on the photoconductor 10 was observed.

Poor: In one of the three environments, the trace of defective cleaning was observed on the sheets after output of 10,000 sheets. In practice, the outputs images were substandard.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.20. The tan δ variation $L_2$ of the backup layer 7 is 0.20. The converted tan δ (X) calculated from Formula 1 is 0.20.

The converted tan δ (X) is 0.02 or greater and 0.51 or smaller (within a range of from 0.20 to 0.51). Cleaning capability was rated as excellent in any of the cold environment (10° C.), the ordinary temperature environment (23° C.), and the hot environment (32° C.). That is, defective cleaning did not occur.

Configurations 2 Through 14

Similar to Configuration 1, the converted tan δ (X) calculated from Formula 1 is within the range of from 0.20 to 0.51. Cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Comparative Examples 1 Through 6

Unlike Configurations 1 through 14, the converted tan δ (X) calculated from Formula 1 is greater than 0.51. Cleaning capability deteriorated due to environmental change and was rated as poor in the hot environment or the cold environment. That is, defective cleaning was obvious on transfer paper (image).

The above verification results confirm that vibration, fatigue, or both of the blade due to environmental changes (temperature changes), which result in defective cleaning, are suppressed by setting the value of converted tan δ (X) defined in Formula 1 to 0.23 or greater and 0.51 or smaller in the temperature range of from 0° C. to 50° C.

Embodiment 1-2

Embodiment 1-2 of the cleaning blade 5, usable in the cleaning device 1 according to the first embodiment, is described.

The cleaning blade 5 according to Embodiment 1-2 is different from the cleaning blade according to Embodiment 1-1 only in that the cleaning blade 5 according to Embodiment 1-2 specifies a more preferable range of the tan δ variation $L_1$ of the edge layer 6.

Therefore, descriptions of structures similar to Embodiment 1-1, and action and effects thereof are omitted appropriately. Unless it is necessary to distinguish, the same reference characters are given to the same or similar elements in descriptions below.

The above-described structure according to Embodiment 1-1 suppresses vibration, fatigue, or both of the blade caused by environmental changes (temperature changes), which result in defective cleaning.

However, when the tan δ of the edge layer 6 decreases due to environmental change (temperature change), that is, becomes a value of high repulsion at which a material does not easily absorb energy, vibration such as stick slip or the like of the edge 61 occurs, and the edge is chipped easily. By contrast, when the tan δ of the edge layer 6 increases, that is, becomes a value of low repulsion at which a material absorbs energy easily, fatigue is easily caused by permanent deformation of the edge layer 6.

Therefore, in the cleaning blade 5 according to Embodiment 1-2, in addition to the structure according to Embodiment 1-1, the variation (difference between maximum and minimum in the temperature range of from 0° C. to 50° C.) of tan δ $L_1$ of the edge layer 6 is set to 0.3 or greater and 0.65 or smaller (a range of from 0.3 to 0.65) in the temperature range of from 0° C. to 50° C.

By setting the tan δ variation $L_1$ of the edge layer 6 to the range of from 0.3 to 0.65 in the temperature range of from 0° C. to 50° C., it is possible to suppress vibration and chipping of the edge 61 of the edge layer 6 due to environmental change as well as fatigue caused by permanent deformation of the edge layer 6.

Next, a verification experiment performed to ascertain effects of the cleaning blade 5 according to Embodiment 1-2 is described.

The tan δ of each layer was measured in a manner similar to that described above.

The cleaning blade 5 used in the experiment is made of urethane rubber, and there is no urethane rubber satisfying the edge layer 6 having the tan δ variation $L_1$ smaller than 0.3. Accordingly, in the verification, the tan δ variation $L_1$ was 0.3 or greater.

Multiple configurations of the cleaning blade 5 according to the present embodiment and comparative examples, used in the verification experiment, and verification results thereof are indicated in Table 2 below.

TABLE 2

| | X | A [mm] | B [mm] | $L_1$ | $L_2$ | Cleaning capability |
|---|---|---|---|---|---|---|
| Configuration 1 | 0.30 | 0.5 | 1.3 | 0.30 | 0.30 | Excellent |
| Configuration 2 | 0.31 | 0.5 | 1.3 | 0.35 | 0.30 | Excellent |
| Configuration 3 | 0.34 | 0.5 | 1.3 | 0.45 | 0.30 | Good |
| Configuration 4 | 0.36 | 0.5 | 1.3 | 0.50 | 0.30 | Good |
| Configuration 5 | 0.31 | 0.5 | 1.3 | 0.60 | 0.20 | Acceptable |
| Configuration 6 | 0.33 | 0.5 | 1.3 | 0.65 | 0.20 | Acceptable |
| Comparative example 1 | 0.35 | 0.5 | 1.3 | 0.75 | 0.20 | Bad |
| Comparative example 2 | 0.34 | 0.5 | 1.5 | 0.77 | 0.20 | Bad |
| Comparative example 3 | 0.35 | 0.5 | 1.5 | 0.78 | 0.20 | Bad |
| Comparative example 4 | 0.35 | 0.5 | 1.5 | 0.80 | 0.20 | Bad |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 6 and Comparative examples 1 through 4 indicated in Table 2.

In each of the cold environment (10° C.), the ordinary temperature environment (23° C.), and the hot environment (32° C.), images were successively output on 20,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 20,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 20,000 sheets. There is no practical disadvantage.

Acceptable: In each of the three environments, no trace of defective cleaning is observed on the sheets after output of 20,000 sheets. There is no practical disadvantage. However, in one of the three environments, toner escaping the cleaning blade on the photoconductor 10 was observed.

Poor: In one of the three environments, the trace of defective cleaning was observed on the sheets after output of 20,000 sheets. In practice, the outputs images were substandard.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.30. The tan δ variation $L_2$ of the backup layer 7 is 0.30. The converted tan δ (X) calculated from Formula 1 is 0.30.

The converted tan δ (X) in this configuration is within the range of from 0.20 to 0.51. The tan δ variation $L_1$ of the edge layer 6 is 0.30 in the temperature range of from 0° C. to 50° C. This value is within the range of from 0.3 to 0.65.

With these features, cleaning capability was rated as excellent in any of the cold environment (10° C.), the ordinary temperature environment (23° C.), and the hot environment (32° C.) even in the cleaning capability evaluation in which 20,000 sheets were output. That is, defective cleaning did not occur.

According to these results, the tan δ of the blade was not excessively varied by the change of the edge layer 6 inherent to environmental change (temperature change). Additionally, in the hot environment or the cold environment, vibration and chipping of the edge 61 as well as fatigue caused by permanent deformation of the edge layer 6 was not generated.

Configurations 2 Through 6

Similar to Configuration 1, the converted tan δ (X) calculated from Formula 1 is within the range of from 0.20 to 0.51. In the temperature range of from 0° C. to 50° C., the tan δ variation $L_1$ of the edge layer 6 is from 0.3 to 0.65.

With these features, cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Similar to Configuration 1, according to these results, the tan δ of the blade did not excessively fluctuate due to the change of the edge layer 6 inherent to environmental change (temperature change). Additionally, in the hot or cold environment, vibration and chipping of the edge 61 as well as fatigue caused by permanent deformation of the edge layer 6 was not generated.

Comparative Examples 1 Through 4

Unlike Configurations 1 through 6, the tan δ variation $L_1$ of the edge layer 6 was greater than 0.51 in the temperature range of from 0° C. to 50° C. Cleaning capability was rated as poor in the hot or cold environment. That is, defective cleaning was obvious on transfer paper (image).

These results indicate that the tan δ of the blade was excessively varied by the change of the edge layer 6 inherent to environmental change (temperature change) and that at least one of vibration and chipping of the edge 61 and fatigue caused by permanent deformation of the edge layer 6 occurred in the hot or cold environment.

It is known from the above verification results that the above effects are attained in the configurations in which the converted tan δ (X) defined by Formula 1 is 0.23 or greater and 0.51 or smaller and the tan δ variation $L_1$ of the edge layer 6 is 0.3 or greater and 0.65 or smaller in the temperature range of from 0° C. to 50° C.

That is, the configurations according to Embodiment 1-2 are advantageous in suppressing vibration and chipping of the edge 61 of the edge layer 6 due to environmental change as well as fatigue caused by permanent deformation of the edge layer 6.

Embodiment 1-3

The cleaning blade 5 according to embodiment 1-3, usable in the cleaning device 1 according to the first embodiment, is described.

The cleaning blade 5 according to Embodiment 1-3 is different from the cleaning blade according to Embodiment 1-1 only in that the cleaning blade 5 according to Embodiment 1-3 specifies a more preferable range of the tan δ variation $L_2$ of the backup layer 7.

Therefore, descriptions of structures similar to Embodiment 1-1, and action and effects thereof are omitted appropriately. Unless it is necessary to distinguish, the same reference characters are given to the same or similar elements in descriptions below.

The above-described structure according to Embodiment 1-1 suppresses vibration, fatigue, or both of the blade caused by environmental changes (temperature changes), which result in defective cleaning.

However, when the tan δ of the backup layer 7 decreases due to environmental change (temperature change), that is, becomes a value of high repulsion at which a material does not easily absorb energy, toner void is generated easily due to vibration of the backup layer 7. By contrast, when the tan δ of the backup layer 7 increases, that is, becomes a value of low repulsion at which a material easily absorbs energy, fatigue caused by permanent deformation of the backup layer 7 is generated easily.

Therefore, in the cleaning blade 5 according to Embodiment 1-3, in addition to the structure according to Embodiment 1-1, the variation (difference between maximum and minimum in the temperature range of from 0° C. to 50° C.) of tan δ variation $L_2$ of the backup layer 7 is set to 0.2 or greater and 0.5 or smaller (a range of from 0.2 to 0.5) in the temperature range of from 0° C. to 50° C.

By setting the tan δ variation $L_2$ of the backup layer 7 to the range of from 0.2 to 0.5 in the temperature range of from 0° C. to 50° C., it is possible to suppress a toner void due to vibration of the backup layer 7 and generation of fatigue caused by permanent deformation of the backup layer 7.

Next, a verification experiment performed to ascertain effects of the cleaning blade 5 according to Embodiment 1-3 is described.

The tan δ of each layer was measured in a manner similar to that described above.

The cleaning blade 5 is made of urethane rubber, as the elastic material. Since there is no urethane rubber satisfying the backup layer 7 having the tan δ variation $L_2$ smaller than 0.2, the tan δ variation $L_2$ was 0.2 or greater in the verification experiment.

Multiple configurations of the cleaning blade 5 according to the present embodiment and comparative examples, used in the verification experiment, and verification results thereof are indicated in Table 3 below.

TABLE 3

| | X | A [mm] | B [mm] | $L_1$ | $L_2$ | Cleaning capability |
|---|---|---|---|---|---|---|
| Configuration 1 | 0.23 | 0.50 | 1.30 | 0.30 | 0.20 | Excellent |
| Configuration 2 | 0.25 | 0.50 | 1.30 | 0.30 | 0.23 | Excellent |
| Configuration 3 | 0.26 | 0.50 | 1.30 | 0.30 | 0.25 | Good |
| Configuration 4 | 0.28 | 0.50 | 1.00 | 0.25 | 0.30 | Good |
| Configuration 5 | 0.30 | 0.80 | 0.80 | 0.30 | 0.30 | Good |
| Configuration 6 | 0.33 | 0.80 | 0.80 | 0.20 | 0.45 | Acceptable |
| Configuration 7 | 0.35 | 0.80 | 0.80 | 0.20 | 0.50 | Acceptable |
| Comparative example 1 | 0.33 | 0.80 | 0.50 | 0.20 | 0.55 | Bad |
| Comparative example 2 | 0.35 | 0.80 | 0.50 | 0.20 | 0.58 | Bad |
| Comparative example 3 | 0.35 | 0.80 | 0.50 | 0.20 | 0.60 | Bad |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 7 and Comparative examples 1 through 3 listed in Table 3.

In each of the cold environment (10° C.), the ordinary temperature environment (23° C.), and the hot environment (32° C.), images were successively output on 20,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 20,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 20,000 sheets. There is no practical disadvantage.

Acceptable: In each of the three environments, no trace of defective cleaning is observed on the sheets after output of 20,000 sheets. Although there is no practical disadvantage, in one of the three environments, toner escaping the cleaning blade on the photoconductor 10 was observed.

Poor: In one of the three environments, the trace of defective cleaning was observed on the sheets after output of 20,000 sheets. In practice, the outputs images were substandard.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.30. The tan δ variation $L_2$ of the backup layer 7 is 0.20. The converted tan δ (X) calculated from Formula 1 is 0.23.

The converted tan δ (X) in this configuration is within the range of from 0.20 to 0.51.

The tan δ variation $L_2$ of the backup layer 7 is 0.20 in the temperature range of from of 0° C. to 50° C. This value is within the range of from 0.2 to 0.5.

With these features, cleaning capability was rated as excellent in any of the cold environment (10° C.), the ordinary temperature environment (23° C.), and the hot environment (32° C.) even in the cleaning capability evaluation in which 20,000 sheets were output. That is, defective cleaning did not occur.

This indicates that the value of tan δ was not excessively varied by the change of the backup layer 7 inherent to environmental change (temperature change), and, in the hot or cold environment, the backup layer 7 did not vibrate and permanent deformation of the backup layer 7 did not cause fatigue.

Configurations 2 Through 7

Similar to Configuration 1, the converted tan δ (X) calculated from Formula 1 is within the range of from 0.20 to 0.51. The tan δ variation $L_2$ of the backup layer 7 is within the range of from 0.2 to 0.5 in the temperature ranging from 0° C. to 50° C.

With these features, cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Similar to Configuration 1, this indicates that the value of tan δ was not excessively varied by the change of the backup layer 7 inherent to environmental change (temperature change) and that vibration of the backup layer 7 due to the hot or cold environment or fatigue caused by permanent deformation of the backup layer 7 was not generated.

Comparative Examples 1 Through 3

Unlike Configurations 1 through 7, the tan δ variation $L_2$ of the backup layer 7 was greater than 0.50 in the temperature range of from 0° C. to 50° C. Cleaning capability was rated as poor in the hot or cold environment. That is, defective cleaning was obvious on transfer paper (image).

This indicates that the tan δ was excessively varied by the change of the backup layer 7 inherent to environmental change (temperature change) and that at least one of vibration of the backup layer 7 and fatigue caused by permanent deformation of the backup layer 7 occurred in the hot or cold environment.

The above verification results have confirmed that the above effects are attained in the configurations in which the converted tan δ (X) defined by Formula 1 is 0.23 or greater and 0.51 or smaller and the tan δ variation $L_2$ of the backup layer 7 is 0.2 or greater and 0.5 or smaller in the temperature range of from 0° C. to 50° C.

That is, it has confirmed that the structure according to Embodiment 1-3 is advantageous in suppressing toner void caused by vibration of the backup layer 7 and fatigue caused by permanent deformation of the backup layer 7.

Embodiment 1-4

Embodiment 1-4 of the cleaning blade 5, usable in the cleaning device 1 according to the first embodiment, is described.

The cleaning blade 5 according to Embodiment 1-4 is different from the cleaning blades according to Embodiments 1-1 through 1-3 only in the following point. That is, the cleaning blade 5 according to Embodiment 1-4 specifies more preferable ranges of the converted tan δ (X), the tan δ variation $L_1$ of the edge layer 6, and the tan δ variation $L_2$ of the backup layer 7.

Therefore, descriptions of structures similar to Embodiments 1-1 through 1-3, and action and effects thereof are omitted appropriately. Unless it is necessary to particularly distinguish, the same reference characters are given to the same or similar elements in descriptions below.

The structures of Embodiments 1-1 through 1-3 can suppress vibration due to environmental change (temperature change) or generation of fatigue, which results in defective cleaning. In the verification experiments, any of Configurations according to the first embodiment did not make the trace of defective cleaning on transfer paper, and there was no practical disadvantage.

However, according to the verification results, in some of Configurations of Embodiments 1-1 through 1-3, cleaning capability was rated as acceptable. That is, in some of the configurations, toner escaping the cleaning blade 5 was observed with eyes on the photoconductor 10.

As described above, when the toner escaping the cleaning blade 5 is visible on the photoconductor 10, defective cleaning is expected to degrade images over time when evaluation is made in a longer period of test. That is, there is a risk that preferable cleaning capability is not maintained when the cleaning blades 5 according to Embodiments 1-1 through 1-3 are used for a long time in an environment in which temperature changes drastically.

Therefore, in the cleaning blade 5 according to Embodiment 1-4, the ranges of the converted tan δ (X), the tan δ variation $L_1$ of the edge layer 6, and the tan δ variation $L_2$ of the backup layer 7 are specified as follows in the temperature range of from 0° C. to 50° C.

In the temperature range of from 0° C. to 50° C., the converted tan δ (X) defined by Formula 1 is 0.23 or greater and 0.35 or smaller, the tan δ variation $L_1$ of the edge layer 6 is 0.3 or greater and 0.5 or smaller, and the tan δ variation $L_2$ of the backup layer 7 is 0.2 or greater and 0.3 or smaller.

By such a structure, the tan δ of the entire cleaning blade 5 is more suitably inhibited from fluctuating significantly depending on changes in the environment (temperature in particular). In addition, such a structure more suitably suppresses vibration and chipping of the edge 61 of the edge layer 6, fatigue caused by permanent deformation of the edge layer 6, toner void due to vibration of the backup layer 7, and fatigue caused by permanent deformation of the backup layer 7, which arise when the environmental changes.

With these features, the amount of toner escaping the cleaning blade 5 and remaining on the photoconductor 10 does not increase to a degree visible with eyes.

Therefore, even when the cleaning blade 5 is used for a long time in the environment in which temperature changes drastically, preferable cleaning capability can be maintained.

Here, among configurations listed in Tables 1 through 3 according to Embodiments 1-1 through 1-3, each configuration satisfying the above-mentioned preferable ranges is rated as excellent or good regarding cleaning capability. That is, in evaluation of cleaning capability, toner that has escaped the cleaning blade 5 is not visible on the photoconductor 10.

This indicates that the structure according to Embodiment 1-4 maintains cleaning capability more stably even when the number of output sheets are greater than the number of sheets (10, 000 sheets) output in the verification experiment in Embodiment 1-1 or the number of sheets (20,000 sheets) output in the verification experiment in Embodiments 1-2 and 1-3.

That is, also from the verification results regarding Embodiments 1-1 through 1-3, it is known that the cleaning blade 5 according to Embodiment 1-4 maintains preferable cleaning capability in the environment in which temperature changes drastically.

Embodiment 1-5

The cleaning blade 5 according to Embodiment 1-5, usable in the cleaning device 1 according to the first embodiment, is described with reference to the drawings.

Figure 5A:
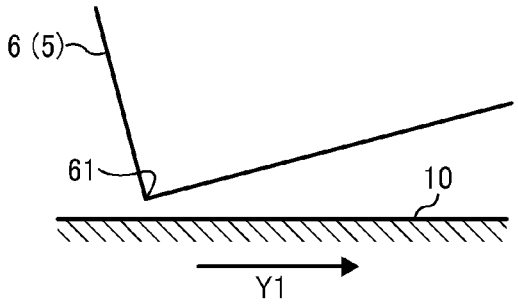
FIGS. 5A, 5B, and 5C illustrate states of an edge of the cleaning blade that contacts or abuts a photoconductor.
Figure 5B:
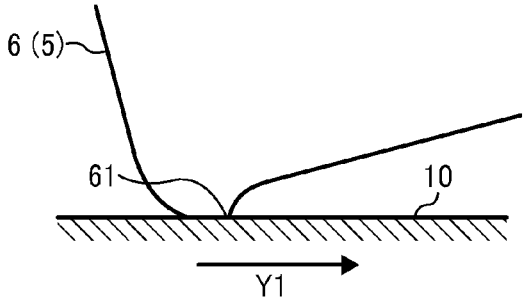
Figure 5C:
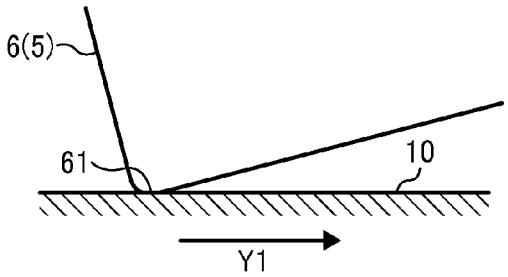
Figure 6:
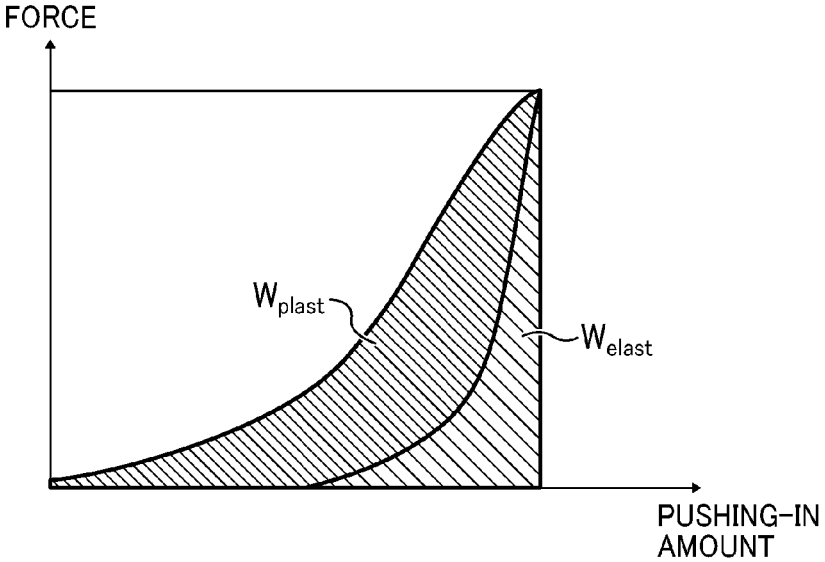
FIG. 6 is a graph of cumulative stress while a Vickers penetrator is pushed in and cumulative stress in removal of a test load.

FIGS. 5A, 5B, and 5C illustrate states of the edge 61 of the cleaning blade 5 that contacts or abuts the photoconductor 10. In FIG. 5A, the edge 61 is disengaged from the surface of the photoconductor 10. FIG. 5B illustrates the edge 61 being in contact with the surface of photoconductor 10 in a case where the edge layer 6 has a lower Martens hardness. FIG. 5C illustrates the edge 61 being in contact with the surface of photoconductor 10 in a case where the edge layer 6 has a higher Martens hardness. FIG. 6 is a graph of cumulative stress while a Vickers penetrator is pushed in, and cumulative stress in removal of a test load.

The cleaning blade 5 according to Embodiment 1-5 is different from the cleaning blade according to any of Embodiment 1-4 only in that the cleaning blade 5 according to Embodiment 1-5 has a Martens hardness of 2 $N/mm^2$ or greater.

Accordingly, descriptions about configurations, operation, action, and effects similar to those of Embodiments 1-1 through 1-4 are omitted. Unless it is necessary to particularly distinguish, the same reference characters are given to the same or similar elements in descriptions below.

In the case of the edge 61 (edge layer 6) having a lower hardness, for example, when the edge 61 contacts the surface of the photoconductor 10 as illustrated in FIG. 5B from the state illustrated in FIG. 5A, a nip between the edge 61 and the surface of the photoconductor 10 is wider. Consequently, the contact pressure decreases. When the contact pressure decreases, toner external additives escaping the edge 61 of the cleaning blade 5 are pressed to the surface of the photoconductor 10, and the possibility of streaky voids in output images and filming on the photoconductor 10 increases. The term "streaky voids" used here means voids of toner dispersed in a solid image, which is caused by toner additives adhering to the photoconductor and looks like a school of small fish.

In view of the foregoing, in the cleaning blade 5 according to the present embodiment, the Martens hardness of the edge layer 6 is equal to or greater than 2.0 N/mm$^2$.

The edge layer 6 having the Martens hardness of 2.0 N/mm$^2$ or greater is advantageous in suppressing streaky voids and filming, that is, the adhesion of toner external additives to the surface of the photoconductor 10.

In the case of the edge 61 (of the edge layer 6) having a higher hardness, such as 2.0 N/mm$^2$ or greater, deformation of the edge 61 upon application of load is smaller as illustrated in FIG. 5C. Then, the area of contact and the nip width are smaller when the cleaning blade 5 is disposed in contact with the surface of the photoconductor 10.

Additionally, since the edge 61 is harder, the amount by which the edge 61 is drawn in by the movement of the photoconductor 10 is smaller, and the vicinity of the edge 61 less easily deforms.

When the nip width is small and the deformation of the vicinity of the edge 61 is small, the edge 61 can stably contact the surface of the photoconductor 10, and the toner external additives are inhibited from adhering to the photoconductor 10. Additionally, since the deformation of the edge 61 is smaller, the load on the edge 61 is smaller. Accordingly, abrasion and chipping of the ridgeline at the end of the cleaning blade 5 are inhibited.

Thus, the occurrence of streaky voids and filming, caused by the toner external additives adhering to the surface of the photoconductor 10, is suppressed.

Next, a verification experiment performed to ascertain effects of the cleaning blade 5 according to Embodiment 1-5 is described.

The tan δ of each layer was measured in a manner similar to that described above.

Multiple configurations of the cleaning blade 5 according to the present embodiment and comparative examples, used in the verification experiment, and verification results thereof are indicated in Table 4 below.

TABLE 4

| | X | A [mm] | B [mm] | $L_1$ | $L_2$ | Martens hardness | Streaky voids and filming |
|---|---|---|---|---|---|---|---|
| Configuration 1 | 0.28 | 0.50 | 1.30 | 0.50 | 0.20 | 5.5 | Excellent |
| Configuration 2 | 0.28 | 0.50 | 1.30 | 0.50 | 0.20 | 5.1 | Excellent |
| Configuration 3 | 0.28 | 0.50 | 1.30 | 0.50 | 0.20 | 4.4 | Good |
| Configuration 4 | 0.28 | 0.50 | 1.30 | 0.50 | 0.20 | 4.0 | Good |
| Configuration 5 | 0.28 | 0.50 | 1.30 | 0.50 | 0.20 | 3.6 | Good |
| Configuration 6 | 0.28 | 0.50 | 1.30 | 0.50 | 0.20 | 3.0 | Good |
| Configuration 7 | 0.28 | 0.50 | 1.30 | 0.50 | 0.20 | 2.6 | Good |
| Configuration 8 | 0.28 | 0.50 | 1.30 | 0.50 | 0.20 | 2.0 | Good |
| Comparative example 1 | 0.28 | 0.50 | 1.30 | 0.50 | 0.20 | 1.5 | Acceptable |
| Comparative example 2 | 0.28 | 0.50 | 1.30 | 0.50 | 0.20 | 0.9 | Bad |
| Comparative example 3 | 0.28 | 0.50 | 1.30 | 0.50 | 0.20 | 0.5 | Bad |

[Evaluation Method]

The occurrence of filming was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 8 and Comparative examples 1 through 3 listed in Table 4.

Images were output on 15,000 sheets consecutively under a temperature of 32° C. and a humidity of 54%. An image having an image area ratio of 5% was output on A4-size sheets.

The cleaning capability was evaluated in the following manner and rated in four grades of "Excellent", "Good", "Acceptable", and "Poor".

Excellent: The trace of filming on the output images is not observed with eyes, and image failure is not recognized. The toner external additives adhering to the photoconductor 10 are hardly observed.

Good: No trace of filming is observed with eyes on the output images, and image failure is not recognized. On the photoconductor 10, a small amount of toner external additives adhering thereto is observed.

Acceptable: No trace of filming is observed on the output images with eyes, and image failure is not recognized. However, adhesion of toner external additives to the photoconductor 10 is noticeable.

Poor: The trace of filming on the output images is observed with eyes, and the image is degraded.

Here, descriptions are given below of measurement of the Martens hardness and the elastic power of the edge layer 6.

The Martens hardness and the elastic power of the edge layer 6 mentioned are measured using a micro hardness measuring system, FISCHERSCOPE® HM2000, from Fischer Technology, Inc., in the following manner.

Push a Vickers penetrator in the cleaning blade 5 at 20 μm from the edge 61 (ridgeline at the end), with a strength of 1.0 mN for 10 seconds, keep that state for 5 seconds, and gradually draws out the Vickers penetrator in 10 seconds. Then, measure the Martens hardness. Martens hardness is calculated concurrently with measurement of elastic power.

The elastic power is a characteristic value defined as $W_{elast}/W_{plast}\times 100\%$, wherein $W_{plast}$ represents the cumulative stress caused while the Vickers penetrator is pushed in, and $W_{elast}$ represents cumulative stress caused in removal of the test load (see FIG. 6).

As the elastic power increases, the rate of plastic work in the period from application of force to distort the material to remove the load becomes smaller. That is, the rate of plastic deformation in the deformation of rubber caused by force is smaller.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.50. The tan δ variation $L_2$ of the backup layer 7 is 0.20. The converted tan δ (X) calculated from Formula 1 is 0.28.

The converted tan δ (X) in this configuration is within the range of from 0.20 to 0.51. The edge layer 6 has a Martens hardness (edge Martens hardness) of 5.5 N/mm$^2$, which is greater than 2.0 N/mm$^2$.

With these features, inhibition of streaky voids and filming in image output on 15,000 sheets was rated as excellent. That is, effects of filming were not observed with eyes on the output image, and image failure was not observed. The toner external additives adhering to the photoconductor 10 were hardly observed.

This indicates that the toner external additives are prevented from adhering to the photoconductor 10 and occurrence of streaky voids and filming is suppressed. In addition, this indicates that the load applied to the edge 61 is reduced, and abrasion or chipping of the cleaning blade 5 is suppressed.

Configurations 2 Through 8

The thickness A of the edge layer 6, the thickness B of the backup layer 7, the tan δ variation $L_1$ of the edge layer 6, and the tan δ variation $L_2$ of the backup layer 7 are similar to those in Configuration 1. The converted tan δ (X) calculated from Formula 1 is 0.28.

The converted tan δ (X) in this configuration is within the range of from 0.20 to 0.51. The edge layer 6 has a Martens hardness of 2.0 N/mm$^2$ or greater in each of Configurations 2 through 8.

With these features, inhibition of streaky voids and filming in image output on 15,000 sheets was rated as excellent or good. That is, effects of filming were not observed with eyes on the output image, and image failure was not observed. The toner external additives adhering to the photoconductor 10 are hardly observed, or the amount is small.

This indicates that the toner external additives are prevented from adhering to the photoconductor 10 and occurrence of streaky voids and filming is suppressed. In addition, this indicates that the load applied to the edge 61 is reduced, and abrasion or chipping of the cleaning blade 5 is suppressed.

Comparative Examples 1 Through 3

The thickness A of the edge layer 6, the thickness B of the backup layer 7, the tan δ variation $L_1$ of the edge layer 6, and the tan δ variation $L_2$ of the backup layer 7 are similar to those in Configuration 1. The converted tan δ (X) calculated from Formula 1 is 0.28. The converted tan δ (X) in this configuration is within the range of from 0.20 to 0.51.

However, unlike Configurations 1 through 8, the edge layer 6 has a Martens hardness (edge Martens hardness) smaller than 2.0 N/mm$^2$.

Inhibition of streaky voids and filming in image output on 15,000 sheets was rated as acceptable or poor. That is, the trace of filming was observed with eyes on the output image, or the amount of toner external additives adhering to the photoconductor 10 was noticeable even though the trace of effects of filming were not observed with eyes on the output image.

This indicates that adhesion of toner external additive to the photoconductor 10 is not fully prevented, and streaky voids and filming are not satisfactorily suppressed in some cases. In addition, this indicates that a greater load is applied to the edge 61 and abrasion or chipping of the cleaning blade 5 are not suppressed.

The above verification results confirm that the above effects are attained in the configuration in which the converted tan δ (X) defined by Formula 1 is 0.23 or greater and 0.51 or smaller and the Martens hardness of the edge layer 6 is 2.0 N/mm$^2$ or greater in the temperature range of from 0° C. to 50° C.

That is, the verification results confirm that the structure according to the present embodiment can suppress the occurrence of streaky voids and filming. The verification results further confirm that, when the amount of deformation of the edge 61 is small, the load applied to the edge 61 is smaller, and abrasion and chipping of the cleaning blade 5 are suppressed.

Thus, streaky voids and filming, caused by the toner external additives adhering to the surface of the photoconductor 10, are suppressed.

Embodiment 1-6

Embodiment 1-6 of the cleaning blade 5, usable in the cleaning device 1 according to the first embodiment, is described.

The cleaning blade 5 according to Embodiment 1-6 is different from that according to Embodiment 1-5 only in the following points. That is, the cleaning blade 5 according to Embodiment 1-6 specifies a more preferable relation between the thickness A of the edge layer 6 and the thickness B of the backup layer 7 and a more preferable relation between the tan δ variation $L_1$ of the edge layer 6 and the tan δ variation $L_2$ of the backup layer 7 in the temperature range of from 0° C. to 50° C.

Therefore, description of a structure similar to Embodiment 1-5, and an action and an effect thereof will be omitted appropriately. Unless it is necessary to distinguish, the same reference characters will be given to the same or similar elements in descriptions below.

In the bilayer cleaning blade 5, when the backup layer 7 is relatively thin and made of a material susceptible to environmental changes, the edge layer 6, which is higher in hardness, is dominant in the posture and the behavior of the entire cleaning blade 5. In this case, fatigue of the cleaning blade 5 easily occurs, and performance of conforming (hereinafter "conforming performance") to the surface of the photoconductor 10 is degraded.

That is, the behavior and posture of the entire cleaning blade 5 fluctuate depending on environmental changes, and the cleaning capability becomes lower than a specified capability designed under standard environment (at the ordinary temperature such as 23° C.).

In view of the foregoing, in addition to the structure similar to that according to Embodiment 1-5, the cleaning blade 5 according to Embodiment 1-6 has the following features. The thickness B of the backup layer 7 is greater than the thickness A of the edge layer 6 (B>A), and the tan δ variation $L_2$ of the backup layer 7 is smaller than the tan δ variation $L_1$ of the edge layer 6 ($L_2<L_1$) in the temperature range of from 0° C. to 50° C.

With this configuration, the following effects are attained in the bilayer cleaning blade 5 including the edge layer 6 and the backup layer 7.

When the thickness B of the backup layer 7 is greater than the thickness A of the edge layer 6, the characteristics of the backup layer 7 are dominant in the posture and the behavior of the entire cleaning blade 5. In addition, when the backup layer 7 is made of a material whose tan δ is less susceptible to environmental changes than the material of the edge layer 6 ($L_2<L_1$), the cleaning capability of the cleaning blade 5 is inhibited from decreasing.

That is, the above-described features of Embodiment 1-6 suppress fluctuations in behavior and posture of the entire cleaning blade 5 caused by environmental changes, and the cleaning capability is prevented from lowering below the specified capability designed for the standard environment.

Next, a verification experiment performed to ascertain effects of the cleaning blade 5 according to Embodiment 1-6 is described.

The tan δ of each layer was measured in a manner similar to that described above.

Multiple configurations of the cleaning blade 5 according to the present embodiment and comparative examples, used in the verification experiment, and verification results thereof are indicated in Table 5 below.

TABLE 5

| | X | A | B | $L_1$ | $L_2$ | Martens hardness | Streaky voids and filming | Line pressure change |
|---|---|---|---|---|---|---|---|---|
| Configuration 1 | 0.23 | 0.50 | 1.30 | 0.30 | 0.20 | 2.0 | Good | Excellent |
| Configuration 2 | 0.27 | 0.60 | 1.20 | 0.40 | 0.20 | 3.2 | Good | Excellent |
| Configuration 3 | 0.32 | 0.50 | 1.30 | 0.50 | 0.25 | 4.1 | Good | Good |
| Configuration 4 | 0.32 | 0.80 | 0.50 | 0.40 | 0.20 | 4.0 | Good | Good |
| Configuration 5 | 0.35 | 0.70 | 1.20 | 0.60 | 0.20 | 5.0 | Excellent | Good |
| Comparative example 1 | 0.32 | 0.80 | 0.50 | 0.20 | 0.50 | 4.5 | Good | Acceptable |
| Comparative example 2 | 0.34 | 0.50 | 1.30 | 0.70 | 0.20 | 5.0 | Excellent | Bad |
| Comparative example 3 | 0.33 | 1.00 | 0.50 | 0.40 | 0.20 | 5.5 | Excellent | Bad |
| Comparative example 4 | 0.34 | 1.20 | 0.50 | 0.40 | 0.20 | 5.5 | Excellent | Bad |

[Evaluation Method]

The occurrence of filming and effects of fatigue on the cleaning capability were evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 5 and Comparative examples 1 through 4 listed in Table 5.

As changes in line pressure, a contact pressure (line pressure) of the edge 61 (i.e., the blade edge) was measured before and after the cleaning blade 5 was kept in contact with the photoconductor 10 for seven days (168 hours). Additionally, changes in the contact pressure over time, which arise in a state in which the cleaning blade 5 was kept in contact with the photoconductor 10 and thus kept under pressure, were compared. The contact pressure of the cleaning blade 5 in contact with the photoconductor 10 was set to 20 g/cm.

Adverse effects of fatigue (due to the line pressure change) of the cleaning blade 5 on the cleaning capability were evaluated in the four ratings under a condition of high charging current, which increases the possibility of defective cleaning. When the line pressure is reduced by 4.0 g/cm, (20% of a specified line pressure), cleaning becomes defective.

Evaluations were made in the three environments, namely, the cold environment (10° C.), the ordinary temperature environment (23° C.), and the hot environment (32° C.), and the rating was made based on the largest reduction in line pressure among the three environments.

Excellent: Reduction in line pressure is 3.0 g/cm (15% of specified line pressure) or smaller. Cleaning capability is not affected, and the degree of margin is large.

Good: Reduction in line pressure is 4.0 g/cm (20% of specified line pressure) or smaller. Cleaning capability is not affected.

Acceptable: Reduction in line pressure is 5.0 g/cm (25% of specified line pressure) or greater. Cleaning capability is affected.

Poor: Reduction in line pressure is 6.0 g/cm (30% of specified line pressure) or greater. Cleaning capability is significantly affected.

It is to be noted that the occurrence of filming was evaluated in a manner similar to that in Embodiment 1-5.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.30. The tan δ variation $L_2$ of the backup layer 7 is 0.20. The converted tan δ (X) calculated from Formula 1 is 0.23.

The converted tan δ (X) in this configuration is within the range of from 0.20 to 0.51. The thickness B of the backup layer 7 is greater than the thickness A of the edge layer 6 (B>A), and the tan δ variation $L_2$ of the backup layer 7 is smaller than the tan δ variation $L_1$ of the edge layer 6 in the temperature range of from 0° C. to 50° C. ($L_2<L_1$). The edge layer 6 has a Martens hardness of 2.0 N/mm$^2$ or greater, similar to Embodiment 1-5.

With these features, inhibition of streaky voids and filming in image output on 15,000 sheets was rated as good. That is, effects of filming were not observed with eyes on the output image, and image failure was not observed. On the photoconductor 10, a small amount of toner external additives adhering thereto is observed.

Additionally, effects of fatigue (due to the line pressure change) on the cleaning capability were rated as excellent. That is, the line pressure reduction was 3.0 g/cm (15% of specified line pressure) or smaller. The cleaning capability was not affected, and the degree of margin was large.

This indicates that, while the toner external additives are prevented from adhering to the photoconductor 10, thereby suppressing the occurrence of streaky voids and filming, the line pressure is prevented from lowing to the degree that the cleaning capability is affected.

Configurations 2 Through 5

Similar to Configuration 1, the converted tan δ (X) is within the range of from 0.20 to 0.51.

The thickness B of the backup layer 7 is greater than the thickness A of the edge layer 6 (B>A), and the tan δ variation $L_2$ of the backup layer 7 is smaller than the tan δ variation $L_1$ of the edge layer 6 in the temperature range of from 0° C. to 50° C. ($L_2<L_1$).

The edge layer 6 has a Martens hardness of 2.0 N/mm$^2$ or greater, similar to Configuration 1.

With these features, inhibition of streaky voids and filming in image output on 15,000 sheets was rated as excellent or good. That is, effects of filming were not observed with eyes on the output image, and image failure was not observed. The toner external additives adhering to the photoconductor 10 were hardly observed, or the amount was small.

Additionally, effects of fatigue (due to the line pressure change) on the cleaning capability were rated as excellent or good. That is, the line pressure reduction was 4.0 g/cm (20% of specified line pressure) or smaller. The cleaning capability was not affected.

This indicates that, while the toner external additives are prevented from adhering to the photoconductor 10, thereby suppressing the occurrence of streaky voids and filming, the line pressure is prevented from lowing to the degree to affect the cleaning capability.

Comparative Examples 1 Through 4

Similar to Configurations 1 through 5, the converted tan δ (X) is within the range of from 0.20 to 0.51. The edge layer 6 has a Martens hardness of 2.0 $N/mm^2$ or greater, similar to Configurations 1 through 5.

However, Comparative examples 1 through 4 do not satisfy at least one of the preferable relation between the thickness A of the edge layer 6 and the thickness B of the backup layer 7 (B>A) and the preferable relation between the tan δ variation $L_1$ of the edge layer 6 and the tan δ variation $L_2$ of the backup layer 7 in the temperature range of from 0° C. to 50° C. ($L_2<L_1$).

With these features, inhibition of streaky voids and filming in image output on 15,000 sheets was rated as excellent or good. That is, effects of filming were not observed with eyes on the output image, and image failure was not observed. The toner external additives adhering to the photoconductor 10 are hardly observed, or the amount is small.

However, effects of fatigue (due to the line pressure change) on the cleaning capability were rated as acceptable or poor. That is, the line pressure reduction was 5.0 g/cm (25% of specified line pressure) or greater. The cleaning capability was affected.

According to the verification results, the edge layer 6, which is harder, is dominant in the posture and the behavior of the entire cleaning blade 5. Alternatively, the harder edge layer 6 causes fatigue of the cleaning blade 5 or reduces the conforming performance. Then, line pressure decreases, thereby degrading the cleaning capability.

Thus, the verification results confirm that the above-described features of Embodiment 1-6 suppress fluctuations in behavior and posture of the entire cleaning blade 5 caused by environmental changes, and the cleaning capability is prevented from lowering below the specified capability designed for the standard environment.

Embodiment 1-7

Embodiment 1-7 of the cleaning blade 5, usable in the cleaning device 1 according to the first embodiment, is described.

It is to be noted that the cleaning blade 5 according to present embodiment is different from the cleaning blade according Embodiment 1-5 only in that the edge layer 6 is greater in Martens hardness than the backup layer 7.

Therefore, description of a structure similar to Embodiment 1-5, and an action and an effect thereof will be omitted appropriately. Unless it is necessary to distinguish, the same reference characters will be given to the same or similar elements in descriptions below.

When both of the edge layer 6 and the backup layer 7 of the bilayer cleaning blade 5 are relatively high in hardness, the entire cleaning blade 5 is relatively high in hardness, and the conforming performance of the cleaning blade 5 is lowered from the following reasons.

When urethane rubber, which is widely used in cleaning blades, is increased in hardness to enhance the capability to remove substances adhering to the contact object (e.g., the photoconductor 10), elasticity thereof decreases. Accordingly, when the backup layer 7 is high in hardness, the performance of the cleaning blade 5 to conform to the surface unevenness of the contact object decreases. When the conforming performance decreases, an increased amount of toner can escape the cleaning blade 5, and the cleaning capability is degraded.

In view of the foregoing, in the present embodiment, the Martens hardness of the edge layer 6 is made greater than that of the backup layer 7 in the structure according to Embodiment 1-5. When the edge layer 6 is higher in hardness than the backup layer 7, the capability of the edge layer 6 can be separated from that of the backup layer 7. That is, the edge layer 6 has a higher hardness to scrape off toner external additives from the photoconductor 10, and the backup layer 7 has a lower hardness to maintain elasticity to secure the conforming performance of the entire cleaning blade 5.

Next, a verification experiment performed to ascertain effects of the cleaning blade 5 according to Embodiment 1-7 is described.

The tan δ of each layer was measured in a manner similar to that described above. Multiple configurations of the cleaning blade 5 according to the present embodiment and comparative examples, used in the verification experiment, and verification results thereof are indicated in Table 6 below.

TABLE 6

| | | | | | | Martens hardness [N/mm2] | | |
|---|---|---|---|---|---|---|---|---|
| | X | A [mm] | B [mm] | $L_1$ | $L_2$ | Edge layer | Backup layer | Cleaning capability |
| Configuration 1 | 0.28 | 0.50 | 1.30 | 0.50 | 0.20 | 2.2 | 0.9 | Excellent |
| Configuration 2 | 0.28 | 0.50 | 1.30 | 0.50 | 0.20 | 2.9 | 1.0 | Excellent |
| Configuration 3 | 0.28 | 0.50 | 1.30 | 0.50 | 0.20 | 3.5 | 1.1 | Good |
| Configuration 4 | 0.28 | 0.50 | 1.30 | 0.50 | 0.20 | 3.9 | 1.0 | Good |
| Comparative example 1 | 0.28 | 0.50 | 1.30 | 0.50 | 0.20 | 2.1 | 3.1 | Bad |
| Comparative example 2 | 0.28 | 0.50 | 1.30 | 0.50 | 0.20 | 2.2 | 2.5 | Bad |
| Comparative example 3 | 0.28 | 0.50 | 1.30 | 0.50 | 0.20 | 2.0 | 4.2 | Bad |
| Comparative example 4 | 0.28 | 0.50 | 1.30 | 0.50 | 0.20 | 2.0 | 3.5 | Bad |

[Evaluation Method]

The cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 4 and Comparative examples 1 through 4 listed in Table 6.

In each of the cold environment (10° C.), the ordinary temperature environment (23° C.), and the hot environment (32° C.), images were successively output on 25,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 25,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 25,000 sheets. There is no practical disadvantage.

Acceptable: In each of the three environments, no trace of defective cleaning is observed on the sheets after output of 25,000 sheets. Although there is no practical disadvantage, in one of the three environments, toner escaping the cleaning blade on the photoconductor 10 was observed.

Poor: In one of the three environments, the trace of defective cleaning was observed on the sheets after output of 25,000 sheets. In practice, the outputs images were substandard.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.50. The tan δ variation $L_2$ of the backup layer 7 is 0.20. The converted value tan δ (X) calculated from Formula 1 is 0.28. The converted tan δ (X) in this configuration is within the range of from 0.20 to 0.51.

The edge layer 6 has a Martens hardness (edge Martens hardness) of 2.2 N/mm$^2$, which is greater than 2.0 N/mm$^2$. The backup layer 7 has a Martens hardness of 0.9 N/mm$^2$, and the edge layer 6 is higher in Martens hardness than the backup layer 7.

With these features, cleaning capability was rated as excellent in any of the cold environment (10° C.), the ordinary temperature environment (23° C.), and the hot environment (32° C.) even in the cleaning capability evaluation in which 25,000 sheets were output. That is, defective cleaning was not obvious on the transfer sheets, and there is no disadvantage in practice.

This means that, since the edge layer 6 is higher in hardness to scrape off toner external additives from the photoconductor 10 and the backup layer 7 is lower in hardness to maintain elasticity, preferable conforming performance of the entire cleaning blade 5 is maintained.

Configurations 2 Through 4

Similar to Configuration 1, the thickness A of the edge layer 6 is 0.50 mm. The thickness B of the backup layer 7 is 1.30 mm. The tan δ variation $L_1$ of the edge layer 6 is 0.50. The tan δ variation $L_2$ of the backup layer 7 is 0.20. The converted value tan δ (X) calculated from Formula 1 is 0.28. Thus, the converted tan δ (X) in this configuration is within the range of from 0.20 to 0.51.

The edge layer 6 has a Martens hardness of 2.0 N/mm$^2$ or greater. Thus, the edge layer 6 is higher in Martens hardness than the backup layer 7.

With these features, cleaning capability was rated as excellent or good in any of the cold environment (10° C.), the ordinary temperature environment (23° C.), and the hot environment (32° C.) even in the cleaning capability evaluation in which 25,000 sheets were output. That is, defective cleaning was not obvious on the transfer sheets, and there is no practical disadvantage.

This means that, similar to Configuration 1, since the edge layer 6 is higher in hardness to scrape off toner external additives from the photoconductor 10 and the backup layer 7 is lower in hardness to maintain elasticity, preferable conforming performance of the entire cleaning blade 5 is maintained.

Comparative Examples 1 Through 4

Similar to Configurations 1 through 4, the thickness A of the edge layer 6 is 0.50 mm. The thickness B of the backup layer 7 is 1.30 mm. The tan δ variation $L_1$ of the edge layer 6 is 0.50. The tan δ variation $L_2$ of the backup layer 7 is 0.20. The converted value tan δ (X) calculated from Formula 1 is 0.28.

However, the edge layer 6 is lower in Martens hardness than the backup layer 7.

Regarding cleaning capability, these structures were rated as poor in any one of the cold environment (10° C.), the ordinary temperature environment (23° C.), and the hot environment (32° C.) in the cleaning capability evaluation in which 25,000 sheets were output. That is, defective cleaning was obvious on the transfer sheets in one of these environments, and there is a practical disadvantage.

According to the verification results, since the edge layer 6 is lower in hardness than the backup layer 7 differently from Configurations 1 through 4, the conforming performance of the cleaning blade 5 decreases, and defective cleaning occurs.

The verification results confirm that Embodiment 1-7, in which the edge layer 6 is higher in hardness to scrape off toner external additives from the photoconductor 10 and the backup layer 7 is lower in hardness to maintaining elasticity, is advantageous in maintaining the conforming performance of the entire cleaning blade 5.

Embodiment 1-8

Embodiment 1-8 of the cleaning blade 5, usable in the cleaning device 1 according to the first embodiment, is described below.

It is to be noted that Embodiment 1-8 is different from Embodiment 1-5 only in that the cleaning blade 5 according to Embodiment 1-8 specifies a preferable range of the elastic power of each of the edge layer 6 and the backup layer 7.

Therefore, description of a structure similar to Embodiment 1-5, and an action and an effect thereof will be omitted appropriately. Unless it is necessary to distinguish, the same reference characters will be given to the same or similar elements in descriptions below.

When the elastic power of each of the edge layer 6 and the backup layer 7 is lower (the ratio of plastic work to deformation is greater), permanent deformation of the cleaning blade 5 easily arises. Then, the permanent deformation thereof causes fatigue of the cleaning blade 5, and the contact pressure (line pressure) of the edge 61 (blade edge) pressed to the photoconductor 10 decreases. Then, defective cleaning occurs easily.

In view of the foregoing, in Embodiment 1-8, in addition to the features of Embodiment 1-5, the edge layer 6 has an elastic power of 40% or greater and 90% or smaller (i.e., a range of from 40% to 90%), and the backup layer 7 has an elastic power of 70% or greater and 95% or smaller (i.e., a range of from 70% to 95%).

This structure inhibits the line pressure from significantly decreasing to a degree to degrade the cleaning capability and makes the deformation of the entire cleaning blade 5 not plastic but elastic. Accordingly, fatigue of the cleaning blade 5 is suppressed.

Next, a verification experiment performed to ascertain effects of the cleaning blade 5 according to Embodiment 1-8 is described.

The tan δ of each layer was measured in a manner similar to that described above.

Multiple configurations of the cleaning blade 5 according to the present embodiment and comparative examples, used in the verification experiment, and verification results thereof are indicated in Table 7 below.

TABLE 7

| | X | A [mm] | B [mm] | $L_1$ | $L_2$ | Elastic power [%] Edge layer | Elastic power [%] Backup layer | Line pressure change |
|---|---|---|---|---|---|---|---|---|
| Configuration 1 | 0.28 | 0.50 | 1.30 | 0.50 | 0.20 | 90 | 95 | Excellent |
| Configuration 2 | 0.28 | 0.50 | 1.30 | 0.50 | 0.20 | 82 | 88 | Excellent |
| Configuration 3 | 0.28 | 0.50 | 1.30 | 0.50 | 0.20 | 71 | 75 | Excellent |
| Configuration 4 | 0.28 | 0.50 | 1.30 | 0.50 | 0.20 | 79 | 81 | Good |
| Configuration 5 | 0.28 | 0.50 | 1.30 | 0.50 | 0.20 | 55 | 75 | Good |
| Configuration 6 | 0.28 | 0.50 | 1.30 | 0.50 | 0.20 | 40 | 70 | Good |
| Comparative example 1 | 0.28 | 0.50 | 1.30 | 0.50 | 0.20 | 65 | 60 | Acceptable |
| Comparative example 2 | 0.28 | 0.50 | 1.30 | 0.50 | 0.20 | 56 | 49 | Bad |
| Comparative example 3 | 0.28 | 0.50 | 1.30 | 0.50 | 0.20 | 47 | 42 | Bad |
| Comparative example 4 | 0.28 | 0.50 | 1.30 | 0.50 | 0.20 | 40 | 33 | Bad |

[Evaluation Method]

The occurrence of filming and effects of fatigue on the cleaning capability were evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 6 and Comparative examples 1 through 4 indicated in Table 7.

As changes in line pressure, a contact pressure (line pressure) of the edge 61 (i.e., the blade edge) was measured before and after the cleaning blade 5 was kept in contact with the photoconductor 10 for seven days (168 hours). Additionally, changes in the contact pressure over time, which arise in a state in which the cleaning blade 5 was kept in contact with the photoconductor 10 and thus kept under pressure, were compared. The contact pressure of the cleaning blade 5 in contact with the photoconductor 10 was set to 20 g/cm.

Adverse effects of fatigue (due to the line pressure change) of the cleaning blade 5 on the cleaning capability were evaluated in the four ratings under a condition of high charging current, which increases the possibility of defective cleaning. When the line pressure is reduced by 4.0 g/cm, (20% of a specified line pressure), cleaning becomes defective.

Evaluations were made in the three environments, namely, the cold environment (10° C.), the ordinary temperature environment (23° C.), and the hot environment (32° C.), and the rating was made based on the largest reduction in line pressure among the three environments.

Excellent: Reduction in line pressure is 3.0 g/cm (15% of specified line pressure) or smaller. Cleaning capability is not affected, and the degree of margin is large.

Good: Reduction in line pressure is 4.0 g/cm (20% of specified line pressure) or smaller. Cleaning capability is not affected.

Acceptable: Reduction in line pressure is 5.0 g/cm (25% of specified line pressure) or greater. Cleaning capability is affected.

Poor: Reduction in line pressure is 6.0 g/cm (30% of specified line pressure) or greater. Cleaning capability is significantly affected.

[Evaluation Results]

Configuration 1

The thickness A of the edge layer 6 is 0.50 mm. The thickness B of the backup layer 7 is 1.30 mm. The tan δ variation $L_1$ of the edge layer 6 is 0.50. The tan δ variation $L_2$ of the backup layer 7 is 0.20. The converted tan δ (X) calculated from Formula 1 is 0.28, which is within the range of from 0.20 to 0.51.

The elastic power of the edge layer 6 is 90%, which is in the preferable range of from 40% to 90%, and the elastic power of the backup layer 7 is 90%, which is in the preferable range of from 70% to 95%. The edge layer 6 has a Martens hardness of 2.0 N/mm$^2$ or greater, similar to Embodiment 1-5.

In this structure, effects of fatigue (due to the line pressure change) on the cleaning capability were rated as excellent. That is, the line pressure reduction was 3.0 g/cm (15% of specified line pressure) or smaller. The cleaning capability was not affected, and the degree of margin was large.

According to the verification results, the line pressure did not significantly decrease to a degree to degrade the cleaning capability, and the entire cleaning blade 5 deformed not plastically but elastically. Accordingly, fatigue of the cleaning blade 5 was suppressed.

Configurations 2 Through 6

Similar to Configuration 1, the converted tan δ (X) is 0.28, which is within the range of from 0.20 to 0.51. The elastic power of the edge layer 6 is within the range of from 40% to 90%, and the elastic power of the backup layer 7 is within the range of from 70% to 95%. The edge layer 6 has a Martens hardness of 2.0 N/mm$^2$ or greater, similar to Configuration 1.

In this structure, effects of fatigue (due to the line pressure change) on the cleaning capability were rated as excellent or good. That is, the line pressure reduction was 3.0 g/cm (15% of specified line pressure) or smaller. The cleaning capability was not affected.

According to the verification results, the line pressure did not significantly decrease to a degree to degrade the cleaning capability, and the entire cleaning blade 5 deformed not plastically but elastically. Accordingly, fatigue of the cleaning blade 5 was suppressed.

Comparative Examples 1 Through 4

Similar to Configurations 1 through 6, the converted tan δ (X) is 0.28, which is within the range of from 0.20 to 0.51.

The edge layer 6 has a Martens hardness of 2.0 N/mm$^2$ or greater, similar to Configuration 1.

Although the elastic power of the edge layer 6 is within the range of from 40% to 90%, the elastic power of the backup layer 7 is smaller than 70%.

In this structure, effects of fatigue (due to the line pressure change) on the cleaning capability were rated as acceptable or poor. That is, the line pressure reduction was 5.0 g/cm (25% of specified line pressure) or greater, and cleaning capability was affected.

According to the verification results, the line pressure significantly decreased to degrade the cleaning capability, and the entire cleaning blade 5 deformed plastically. Accordingly, fatigue of the cleaning blade 5 occurred.

Thus, the verification results confirm that the structure according to Embodiment 1-8 is advantageous in inhibiting the line pressure from significantly decreasing to degrade the cleaning capability and making the deformation of the entire cleaning blade 5 not plastic but elastic, thereby suppressing fatigue of the cleaning blade 5.

The descriptions above concern the multiple configurations of the cleaning blade 5 usable in the cleaning device 1 of the image forming apparatus 100 according to the first embodiment.

It is to be noted that, by incorporating the cleaning blade 5 according to any one of Embodiment 1-1 through 1-8, the image forming apparatus 100 according to the first embodiment can attain the effect similar to the effect of the cleaning blade 5 incorporated therein.

For example, the image forming apparatus 100 can suppress generation of vibration and fatigue of the cleaning blade 5 due to environmental change (temperature change), which degrade the cleaning capability of the cleaning device 1, and accordingly suppress creation of substandard images caused by the degraded cleaning capability.

Nest, other features of the image forming apparatus 100 according to the present embodiment are described in detail below.

Initially, the charging device 40 to uniform charge the surface of the photoconductor 10 is described.

Use of a contact-type charger (e.g., a charging roller) to apply superimposed voltage including direct current (DC) voltage and alternating current (AC) voltage to charge the image bearer, such as the photoconductor 10, is advantageous in that a charging current is greater and the potential of the charged image bearer becomes more reliable. Then, image quality is enhanced and the operational life of the apparatus is expanded.

However, when the AC voltage is applied to the charger, the image bearer vibrates, and the edge 61 of the cleaning blade 5 vibrates significantly. The significant vibration can cause noise, wear or chipping of the cleaning blade 5, and abnormal wear of the photoconductor 10. Additionally, when the tan δ of the material of the blade is reduced by environmental (e.g., temperature) changes, the blade easily vibrates.

By contrast, the image forming apparatus 100 according to the first embodiment, described above, uses the bilayer cleaning blade 5 whose tan δ is less dependent on the environment. Accordingly, generation of vibration is suppressed even when the charging device 40 employs the charging roller 41 to apply AC voltage to the surface of the photoconductor 10.

Thus, generation of noise due to vibration, abrasion and chipping of the cleaning blade 5, and abnormal abrasion of the photoconductor 10 are suppressed.

Next, descriptions are given below of the photoconductor 10 serving as the image bearer in the image forming apparatus 100.

Figure 7A:
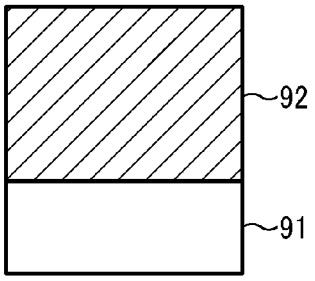
FIGS. 7A through 7D illustrate layer structures of the photoconductor according to an embodiment.

FIGS. 7A through 7D illustrate layer structures of the photoconductor 10 of the image forming apparatus 100. In the layer structure illustrated in FIG. 7A, the photoconductor 10 includes a conductive support 91 and a photosensitive layer 92 overlying the conductive support 91. In FIG. 7A, the photosensitive layer 92 is a surface layer, and inorganic particles are present at or adjacent to the surface of the photosensitive layer 92.

Figure 7B:
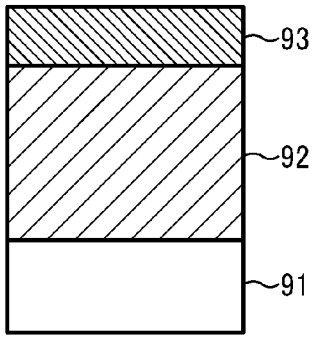
Figure 7C:
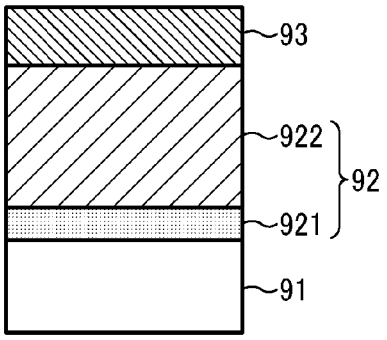
Figure 7D:
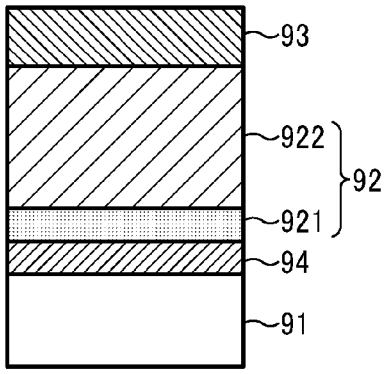

In the layer structures illustrated in FIGS. 7B, 7C, and 7D, a surface layer 93 including inorganic particles is disposed above the photosensitive layer 92. The layer structure illustrated in FIG. 7B includes, from the bottom, the conductive support 91, the photosensitive layer 92, and the surface layer 93 including inorganic particles. The layer structure illustrated in FIG. 7C includes, from the bottom, the conductive support 91, the photosensitive layer 92, and the surface layer 93 including inorganic particles. Further, the photosensitive layer 92 includes a charge generation layer 921 and a charge transport layer 922. The layer structure illustrated in FIG. 7D includes, from the bottom, the conductive support 91; a under layer 94; the photosensitive layer 92 including the charge generation layer 921 and the charge transport layer 922; and the surface layer 93 including inorganic particles.

That is, the photoconductor 10 according to the present embodiment includes at least the photosensitive layer 92 above the conductive support 91, and the surface layer 93 may be disposed above the photosensitive layer 92. In another embodiment, one or greater layers are combined freely. When the photosensitive layer 92 includes the charge generation layer 921 and the charge transport layer 922 superimposed thereon as the surface layer, the charge transport layer 922 includes inorganic particles.

An aspect of the photoconductor 10 according to the first embodiment is that inorganic particles are included in the surface layer of the photoconductor 10.

Including inorganic particles at the surface (or in the surface layer) of the photoconductor 10 is advantageous in inhibiting wear (in particular, uneven wear or partial wear) of the photoconductor 10, thereby improving image quality, performance stability of the apparatus, and operational life.

The inorganic particles at the surface of the photoconductor 10 create micro surface unevenness. It is possible that the micro surface unevenness causes the edge 61 of the cleaning blade 5 to vibrate. If the vibration is significant, the vibration results in noise, wear or chipping of the cleaning blade 5, or abnormal wear of the photoconductor 10.

By contrast, in the image forming apparatus 100 according to the first embodiment, such vibration is suppressed since the bilayer cleaning blade 5 has the tan δ that is less dependent on the environment.

Thus, the image forming apparatus 100 according to the first embodiment can suppress noise caused by the vibration of the cleaning blade 5, abrasion or chipping of the cleaning blade 5, and abnormal abrasion of the photoconductor 10 even when inorganic particles are included at the surface of the photoconductor 10.

Examples of inorganic particles added to the layer structure include metal powder such as copper, tin, aluminum, and indium; metal oxide such as silicon oxide, silica, tin oxide, zinc oxide, titanium oxide, indium oxide, antimony oxide, bismuth oxide, tin oxide in which antimony is doped, and indium oxide in which tin is doped; and inorganic material such as potassium titanate. Metal oxide is particularly preferable, and further silicon oxide, aluminum oxide, and titanium oxide are effective.

The inorganic particle preferably has an average primary particle diameter from 0.01 to 0.5 μm considering the characteristics of the surface layer 93 such as light transmission degree and abrasion resistance.

The abrasion resistance and the degree of dispersion decrease when the average primary particle diameter is 0.01 μm or smaller. Additionally, when the average primary particle diameter is 0.5 μm or greater, inorganic particles in the dispersion liquid can sink more easily, and toner filming can occur.

As the amount of inorganic particles added increases, abrasion resistance increases, which is desirable. An extremely large amount of inorganic particles, however, causes side effects such as increases in residual potentials and decreases in the degree at which writing light transmits a protective layer.

Generally, the amount of addition to the total solid amount is preferably 30% by weight or smaller, and more preferably 20% by weight or smaller. The lower limit is generally 3% by weight.

The above-described inorganic particles can be treated with at least one surface treatment agent, which is preferable for facilitating the dispersion of inorganic particles.

Degradation in dispersion of inorganic particles can cause not only the rise of residual potentials but also degradation of transparency of coating, defective coating, and further degradation of abrasion resistance. Accordingly, degradation in dispersion of inorganic particles can hinder the extension of operational life or image quality improvement.

Regarding the layer structures illustrated in FIGS. 7B, 7C, 7D, that include the surface layer 93 disposed above the photosensitive layer 92, the surface layer 93 includes at least inorganic particles and binder resin.

The inorganic particles can be similar to those included in the photosensitive layer 92 in the layer structure in which the photosensitive layer 92 serves as the surface layer. The primary particle diameter of inorganic particles can be similar to that in the layer structure in which the photosensitive layer 92 serves as the surface layer.

Generally, the amount of addition to the total solid amount is preferably 50% by weight or smaller, and more preferably 30% by weight or smaller. The lower limit is generally 5% by weight.

The above-described inorganic particles can be treated with at least one surface treatment agent, which is preferable for facilitating the dispersion of inorganic particles.

Degradation in dispersion of inorganic particles can cause not only the rise of residual potentials but also degradation of transparency of coating, defective coating, and further degradation of abrasion resistance. Accordingly, degradation in dispersion of inorganic particles can hinder the extension of operational life or image quality improvement.

Typical surface treatment agents can be used, but surface treatment agents capable of maintaining insulation of inorganic particles are preferable.

For example, titanate coupling agents, aluminum coupling agents, zircoaluminate coupling agents, higher fatty acids, mixtures of silane coupling agents and those, Al2O3, TiO2, ZrO2, silicone, aluminum stearate, and mixtures of two or greater of them are preferable as the surface treatment agent to attain preferable dispersion of inorganic particles and inhibition of image blurring.

Although treatment with silane coupling agents increases image blurring effects, the effects may be inhibited by mixing the above-described surface treatment agents in the silane coupling agent.

The amount of surface treatment agent is preferably from 3% by weight to 30% by weight and, more preferably, from 5% by weight to 20% by weight although it depends on the average primary particle diameter of inorganic particle. If the amount of surface treatment is smaller than this range, dispersion of inorganic particles is insufficient, and, if the amount is extremely large, the residual potential can rise significantly. The above-mentioned inorganic particles can be used alone or in combination.

The above-mentioned inorganic particles can be dispersed using a dispersing device. The average particle diameter of the inorganic particles in the dispersion liquid is preferably 1 μm or smaller and, more preferably, 0.5 μm or smaller considering the transmittance of the surface layer 93.

Next, toner usable in the image forming apparatus 100 according to the first embodiment is described below using drawings.

Figure 8A:
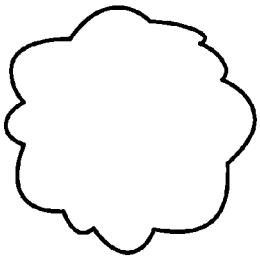
FIGS. 8A and 8B are illustrations of measurement of circularity of toner.
Figure 8B:
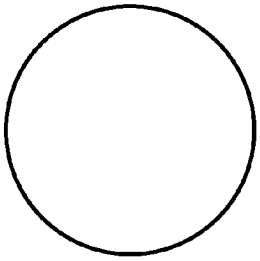

FIGS. 8A and 8B are illustrations of measurement of circularity of toner. FIG. 8A schematically illustrates a peripheral length C1 of a projected shape of a toner particle having an area S. FIG. 8B illustrates a peripheral length C2 of a perfect circle having an area identical to the area (area S) of the projected shape illustrated in FIG. 8A.

To improve image quality, it is preferable to use polymerization toner produced by suspension polymerization, emulsion polymerization, or dispersion polymerization, which is suitable for enhancing circularity and reducing particle diameter. In particular, it is preferred to use polymerization toner having a circularity of 0.97 or higher and a volume average particle diameter of 5.5 μm or smaller. High resolution can be attained by use of polymerization toner having a circularity of 0.97 or higher and a volume average particle diameter of 5.5 μm or smaller.

The circularity used herein is an average circularity measured by a flow-type particle image analyzer FPIA-2000 from SYSMEX CORPORATION. Specifically, put surfactant as a dispersant, preferably 0.1 ml to 0.5 ml of alkylbenzene sulfonate, in 100 ml to 150 ml of water from which impure solid materials are previously removed, and add 0.1 g to 0.5 g of the sample (toner) to the mixture. Then, disperse the mixture including toner with an ultrasonic disperser for 1 to 3 minutes to prepare a dispersion liquid having a concentration of from 3,000 to 10,000 pieces/μl and measure the toner shape and distribution with the above-mentioned measurer.

Based on the measurement results, obtain C2/C1 wherein C1 represents a peripheral length of a projected toner particle having an area S illustrated in FIG. 8A, and C2 represents a peripheral length of a perfect circle illustrated in FIG. 8B, identical in area with the projected toner particle. The average of C2/C1 is used as the circularity.

The volume average particle diameter of toner can be measured by a coulter counter method. Specifically, number distribution and volume distribution of toner, measured by Coulter Multisizer 2e from Beckman Coulter, are output, via an interface from Nikkaki Bios Co., Ltd., to a computer and analyzed. More specifically, the volume average particle diameter of toner is obtained as follows. Prepare, as an electrolyte, a NaCl aqueous solution including a primary sodium chloride of 1%. Add 0.1 ml to 5 ml of surfactant, preferably alkylbenzene sulfonate, as dispersant, to 100 ml to 150 ml of the electrolyte. Add, as test sample, 2 to 20 mg of toner to the mixture and disperse the test sample by an ultrasonic disperser for 1 to 3 min.

Put 100 ml to 200 ml of the electrolyte solution in a separate beaker, and put the above-described sample therein to attain a predetermined concentration. Then, using Coulter Multisizer 2e, measure the particle diameter of 50,000 toner particles with an aperture of 100 μm.

The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The range to be measured is set from 2.00 μm to less than 40.30 μm. The target is toner particles of particle diameter greater than 2.00 μm and equal to or smaller than 32.0 μm. Calculate the volume average particle diameter represented as ΣXfV/ΣfV, where X represents a representative diameter in each channel, V represents an equivalent volume of the representative diameter in each channel, and f represents the number of particles in each channel.

Second Embodiment

Descriptions are given below of a cleaning blade according to a second embodiment.

It is to be noted that second embodiment is different from the first embodiment only regarding the cleaning blade 5 of the cleaning device 1. Specifically, in the first embodiment, the cleaning blade 5 is double-layered and includes the edge layer 6, which includes the edge 61, and the backup layer 7 laminated on the edge layer 6. By contrast, in the second embodiment, the cleaning blade 5 includes three or greater number of layers. That is, in addition to the edge layer 6 including the edge 61, the cleaning blade 5 includes a multilayered layer as the backup layer 7.

Except the cleaning blade 5, the structure (the cleaning device 1, the charging device 40, the charging device 40, the photoconductor 10, toner, and the like) of the image forming apparatus 100 according to the second embodiment is similar to that of the first embodiment, and descriptions about operation, action, and effects of the similar structure are omitted. Components identical or similar to those described above are given identical reference characters.

Descriptions are given below of multiple configurations of the cleaning blade 5 usable in the cleaning device 1 of the image forming apparatus 100 according to the second embodiment.

Embodiment 2-1

The cleaning blade 5 according to Embodiment 2-1, usable in the cleaning device 1 according to the second embodiment, is described with reference to the drawings.

Figure 9A:
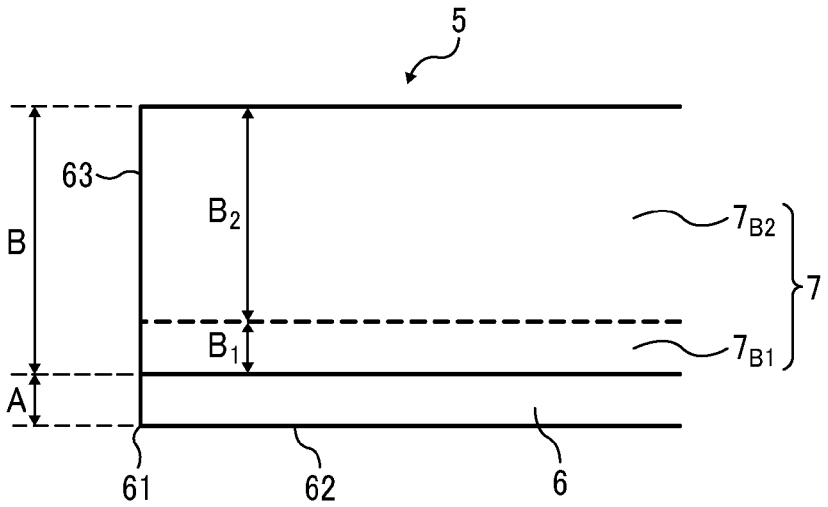
FIGS. 9A and 9B are schematic diagrams for understanding Formulas 2 and 3 to define converted tan δ according to a second embodiment.
Figure 9B:
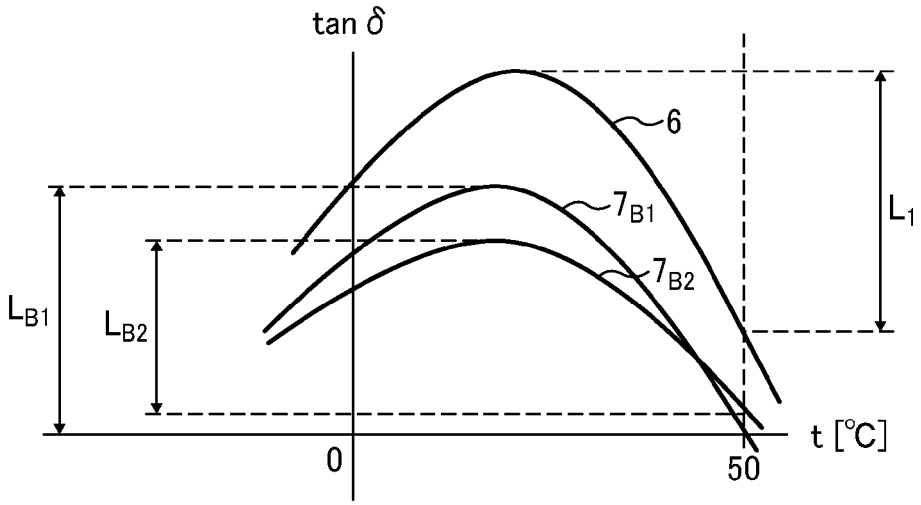

With reference to FIGS. 9A and 9B, Formulas 2 and 3 to define converted tan δ according to the present embodiment is described. In the layer structure illustrated in FIG. 9A, the backup layer 7 is double-layered and includes a first backup layer $\mathbf{7}_{B1}$ and a second backup layer $\mathbf{7}_{B2}$. FIG. 9A illustrates the thickness A of the edge layer 6, a thickness $B_1$ of the first backup layer $\mathbf{7}_{B1}$, and a thickness $B_2$ of the second backup layer $\mathbf{7}_{B2}$. FIG. 9B illustrates the tan δ variation of $L_1$ of the edge layer 6, a variation of tan δ (hereinafter "tan δ variation $L_{B1}$") of the first backup layer $\mathbf{7}_{B1}$, and a variation of tan δ (hereinafter "tan δ variation $L_{B2}$") of the second backup layer $\mathbf{7}_{B2}$.

In the case of the above-described bilayer blade according to the first embodiment, when the tan δ variation $L_1$ of the edge layer 6 is large (e.g., 0.8 or greater), it is necessary to keep the tan δ variation $L_2$ of the backup layer 7 small and make the backup layer 7 thick. To reduce the tan δ, material characteristics impose a limitation, and there is a risk that other physical properties change if the tan δ is extremely small. If the backup layer 7 is extremely thick, there arises a risk that the flexibility (conforming performance) of the cleaning blade 5 decreases to degrade the cleaning capability. In addition, it is possible that the cleaning device 1 and the process cartridge 121 become bulkier.

In view of the foregoing, in the cleaning blade 5 according to the present embodiment, the backup layer 7 is multilayered, and the edge layer 6 and the multilayered backup layer 7 are designed such that a converted tan δ (X) defined by Formulas 2 and 3 is 0.23 or greater and 0.51 or smaller in the temperature range of from 0° C. to 50° C.

$$X = \frac{A}{A+B} \times L_1 + X_B \qquad \text{Formula 2}$$

$$X_B = \frac{B_1}{A+B} \times L_{B1} + \frac{B_2}{A+B} \times L_{B2} \qquad \text{Formula 3}$$

where X represents the converted tan δ, A represents the thickness (in millimeters) of the edge layer 6, $B_1$ and $B_2$ represent the thicknesses (in millimeters) of the first and second backup layers $\mathbf{7}_{B1}$ and $\mathbf{7}_{B2}$, $L_1$ represents the variation of tan δ of the edge layer 6, and $L_{B1}$ and $L_{B2}$ represent the variations of tan δ of the first and second backup layers $\mathbf{7}_{B1}$ and $\mathbf{7}_{B2}$.

Formula 3 is modified in accordance with the number of backup layers. For example, when the number of backup layers is three, reference character $B_3$ is given to the thickness of a third backup layer, and $L_{B3}$ is given to the tan δ variation of the third backup layer. Then, Formula 3 further includes "$B_3$ divided by A+B and multiplied with $L_{B3}$".

As illustrated in FIG. 9A, the thickness A of the edge layer 6 and the thicknesses $B_1$ and $B_2$ of the first and second backup layers $\mathbf{7}_{B1}$ and $\mathbf{7}_{B2}$ are the lengths in the direction perpendicular to the outer face 62 of the edge layer 6 of the cleaning blade 5 before the cleaning blade 5 deforms. As described above, the outer face 62 faces the downstream side in the direction of rotation of the photoconductor 10.

The tan δ variation $L_1$ of the edge layer 6 is the difference between a maximum and a minimum of the tan δ when ambient temperature changes from 0° C. to 50° C. as illustrated in FIG. 9B. Similarly, as illustrated in FIG. 9B, each of the tan δ variation $L_{B1}$ of the first backup layer $\mathbf{7}_{B1}$ and the tan δ variation $L_{B2}$ of the second backup layer $\mathbf{7}_{B2}$ is the difference between a maximum and a minimum of the tan δ when ambient temperature changes from 0° C. to 50° C.

Similar to the first embodiment, an elastic material, such as urethane rubber, is usable for each layer of the cleaning blade 5.

Formulas 2 and 3 mentioned above define the value X of the converted tan δ, which serves as an index of tan δ of the entire cleaning blade 5 (i.e., the bilayer cleaning blade 5) at a temperature ranging from 0° C. to 50° C. when the backup layer 7 is multilayered.

When the converted tan δ (X) defined by Formulas 2 and 3 is 0.23 or greater and 0.51 or smaller in the temperature range of from 0° C. to 50° C., it is not necessary to make the tan δ variations $L_{B1}$ and $L_{B2}$ of the first and second backup layers $\mathbf{7}_{B1}$ and $\mathbf{7}_{B2}$ inconveniently small even when the tan δ of the edge layer 6 is very small. Further, it is not necessary that the first backup layer $\mathbf{7}_{B1}$ and the second backup layer $\mathbf{7}_{B2}$ are very thick. The converted tan δ (X) thus defined can eliminate the risk that other physical properties change, which arises when the tan δ is very small.

The converted tan δ (X) thus defined can eliminate the risk that the flexibility of the cleaning blade 5 decreases to degrade the cleaning capability, which arises when the backup layer 7 is extremely thick. In addition, the cleaning device 1 and the process cartridge 121 can be compact.

Thus, the backup layer 7 is multilayered and the converted tan δ defined by Formulas 2 and 3 is in the range of from 0.23 to 0.51 in the temperature range of from 0° C. to 50° C. This structure is advantageous in suppressing the tan δ of the entire cleaning blade 5, which is multilayered, from fluctuating significantly depending on changes in the environment (temperature in particular), similar to the first embodiment, also in the cleaning blade 5 including the edge layer 6 and the multilayered backup layer 7.

Accordingly, degradation in the cleaning capability is suppressed in the multilayered cleaning blade 5 including the edge layer 6 and the multilayered backup layer 7.

This can suppress degradation of cleaning capability due to environmental change (temperature change) without making the thick backup layer 7 from a single material to lower the tan δ.

It is to be noted that, although the bilayer backup layer 7 including the first and second backup layers $\mathbf{7}_{B1}$ and $\mathbf{7}_{B2}$ is described here, aspects of the present embodiment are applicable to a cleaning blade including the backup layer 7 made of three or more layers, not limited to the bilayer backup layer 7.

In such a structure, Formula 3 is modified to conform to the respective layers of the backup layer 7.

Next, a verification experiment performed to ascertain effects of the cleaning blade 5 according to Embodiment 2-1 is described.

It is to be noted that, similar to the first embodiment, the loss tangent tan δ is measured using a dynamic viscoelasticity measuring instrument in the temperature range of from 0° C. to 50° C., and dynamic storage elastic modulus (E') and dynamic loss modulus (E") are measured at constant frequency or multiple frequencies. Then, the tan δ (dynamic loss tangent, =E'/E") of the material such as urethane rubber used for the cleaning blade 5 is calculated.

The cleaning blade 5 used in the experiment is made of urethane rubber, and there is no urethane rubber satisfying the converted tan δ (X) smaller than 0.23. Accordingly, in the verification, the converted tan δ (X) was 0.23 or greater.

Multiple configurations of the three-layer cleaning blade 5 according to the present embodiment and comparative examples, used in the verification experiment, and verification results thereof are indicated in Table 8 below. It is to be noted that, to clarify the difference from Embodiment 1-1 of the first embodiment, Configurations 1 through 14 and Comparative examples 1 through 6 in the verification of Embodiment 1-1 are included as Reference configurations 1 through 14 and Reference comparative examples 1 through 6 in Table 8.

TABLE 8

| | Blade | | | B [mm] | | | $L_2$ | | Cleaning |
|---|---|---|---|---|---|---|---|---|---|
| | type | X | A [mm] | $B_1$ | $B_2$ | $L_1$ | $L_{B1}$ | $L_{B2}$ | capability |
| Reference Configuration 1 | Bilayer | 0.23 | 0.50 | 1.30 | | 0.30 | 0.20 | | 0.23 |
| Reference Configuration 2 | Bilayer | 0.24 | 0.50 | 1.30 | | 0.35 | 0.20 | | 0.24 |
| Reference Configuration 3 | Bilayer | 0.29 | 0.80 | 1.00 | | 0.40 | 0.20 | | 0.29 |
| Reference Configuration 4 | Bilayer | 0.29 | 0.60 | 1.30 | | 0.50 | 0.20 | | 0.29 |
| Reference Configuration 5 | Bilayer | 0.28 | 0.50 | 1.30 | | 0.50 | 0.20 | | 0.28 |
| Reference Configuration 6 | Bilayer | 0.30 | 0.80 | 0.90 | | 0.30 | 0.30 | | 0.30 |
| Reference Configuration 7 | Bilayer | 0.31 | 0.50 | 1.10 | | 0.55 | 0.20 | | 0.31 |
| Reference Configuration 8 | Bilayer | 0.33 | 0.80 | 0.80 | | 0.25 | 0.40 | | 0.33 |
| Reference Configuration 9 | Bilayer | 0.33 | 0.80 | 1.00 | | 0.50 | 0.20 | | 0.33 |
| Reference Configuration 10 | Bilayer | 0.35 | 0.50 | 1.40 | | 0.50 | 0.30 | | 0.35 |
| Reference Configuration 11 | Bilayer | 0.35 | 0.80 | 0.80 | | 0.50 | 0.20 | | 0.35 |

TABLE 8-continued

| | Blade type | X | A [mm] | B [mm] $B_1$ | $B_2$ | $L_1$ | $L_2$ $L_{B1}$ | $L_{B2}$ | Cleaning capability |
|---|---|---|---|---|---|---|---|---|---|
| Reference Configuration 12 | Bilayer | 0.41 | 0.70 | 1.00 | | 0.70 | 0.20 | | 0.41 |
| Reference Configuration 13 | Bilayer | 0.46 | 0.50 | 1.50 | | 0.80 | 0.35 | | 0.46 |
| Reference Configuration 14 | Bilayer | 0.51 | 0.50 | 1.30 | | 0.80 | 0.40 | | 0.51 |
| Configuration 1 | Three-layer | 0.23 | 0.01 | 0.10 | 1.70 | 0.80 | 0.23 | 0.01 | Excellent |
| Configuration 2 | Three-layer | 0.33 | 0.01 | 0.20 | 1.60 | 0.90 | 0.33 | 0.01 | Good |
| Configuration 3 | Three-layer | 0.34 | 0.01 | 0.50 | 1.30 | 0.90 | 0.34 | 0.01 | Good |
| Configuration 4 | Three-layer | 0.35 | 0.01 | 0.40 | 1.30 | 0.80 | 0.35 | 0.01 | Good |
| Configuration 5 | Three-layer | 0.33 | 0.10 | 0.40 | 1.30 | 0.90 | 0.33 | 0.10 | Good |
| Configuration 6 | Three-layer | 0.32 | 0.10 | 0.40 | 1.20 | 0.80 | 0.32 | 0.10 | Good |
| Configuration 7 | Three-layer | 0.41 | 0.10 | 0.50 | 1.30 | 0.85 | 0.41 | 0.10 | Acceptable |
| Configuration 8 | Three-layer | 0.51 | 0.10 | 0.50 | 1.30 | 0.85 | 0.51 | 0.10 | Acceptable |
| Reference comparative example 1 | Bilayer | 0.52 | 0.40 | 1.30 | | 0.60 | 0.50 | | 0.52 |
| Reference comparative example 2 | Bilayer | 0.57 | 0.50 | 1.00 | | 0.70 | 0.50 | | 0.57 |
| Reference comparative example 3 | Bilayer | 0.60 | 0.50 | 1.50 | | 0.90 | 0.50 | | 0.60 |
| Reference comparative example 4 | Bilayer | 0.67 | 0.50 | 1.00 | | 0.80 | 0.60 | | 0.67 |
| Reference comparative example 5 | Bilayer | 0.68 | 0.50 | 1.30 | | 0.90 | 0.60 | | 0.68 |
| Reference comparative example 6 | Bilayer | 0.71 | 0.50 | 1.30 | | 1.00 | 0.60 | | 0.71 |
| Comparative example 1 | Three-layer | 0.52 | 0.01 | 0.40 | 1.40 | 1.00 | 0.52 | 0.01 | Bad |
| Comparative example 2 | Three-layer | 0.67 | 0.10 | 0.40 | 1.20 | 1.00 | 0.67 | 0.10 | Bad |
| Comparative example 3 | Three-layer | 0.76 | 0.10 | 0.50 | 1.30 | 1.05 | 0.76 | 0.10 | Bad |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 8 and Comparative examples 1 through 3 listed in Table 8.

In each of the cold environment (10° C.), the ordinary temperature environment (23° C.), and the hot environment (32° C.), the test machine was left unused for 24 hours, and then images were successively output on 10,000 sheets. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 10,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 10,000 sheets. There is no practical disadvantage.

Acceptable: In each of the three environments, no trace of defective cleaning is observed on the sheets after output of 10,000 sheets. Although there is no practical disadvantage, in one of the three environments, toner escaping the cleaning blade on the photoconductor 10 was observed.

Poor: In one of the three environments, the trace of defective cleaning was observed on the sheets after output of 10,000 sheets. In practice, the outputs images were substandard.

[Evaluation Results]

Configuration 1

The thickness A of the edge layer 6 is 0.01 mm. The thickness $B_1$ of the first backup layer $\mathbf{7}_{B1}$ of the backup layer 7 is 0.10 mm. The thickness $B_2$ of the second backup layer $\mathbf{7}_{B2}$ is 1.70 mm. The tan δ variation $L_1$ of the edge layer 6 is 0.80. The variation of tan δ $L_{B1}$ of the first backup layer $7_{B1}$ of the backup layer 7 is 0.60. The variation of tan δ $L_{B2}$ of the second backup layer $7_{B2}$ is 0.20. The converted tan δ (X) calculated from Formulas 2 and 3 is 0.23.

The converted tan δ (X) is 0.02 or greater and 0.51 or smaller (within a range of from 0.20 to 0.51). Cleaning capability was rated as excellent in any of the cold environment (10° C.), the ordinary temperature environment (23° C.), and the hot environment (32° C.). That is, defective cleaning did not occur.

Configurations 2 Through 8

Similar to Configuration 1, the converted tan δ (X) calculated from Formulas 2 and 3 is within the range of 0.20 or greater and 0.51 or less. Cleaning capability was evaluated to be good or acceptable in any of the cold environment (10° C.), the ordinary temperature environment (23° C.), and the hot environment (32° C.). No trace of defective cleaning was observed on transfer paper, and defective cleaning did not occur.

Comparative Examples 1 Through 3

Unlike Configurations 1 through 8, the converted tan δ (X) calculated from Formulas 2 and 3 was greater than 0.51. Cleaning capability was deteriorated due to environmental change and was evaluated as poor in the hot or cold environment. That is, a trace of defective cleaning was found on transfer paper.

It is known from the above verification results that the following effects are attained by setting the converted tan δ (X) defined by Formulas 2 and 3 to 0.23 or greater and 0.51 or smaller in the temperature range of from 0° C. to 50° C.

When the backup layer 7 is multilayered, the cleaning capability is inhibited from being degraded by environmental changes (temperature changes) without forming the thick backup layer 7 from a single material to reduce the tan δ.

Embodiment 2-2

Next, Embodiment 2-2 of the cleaning blade 5 usable in the cleaning device 1 according to the second embodiment is described with reference to the drawings.

Figure 10A:
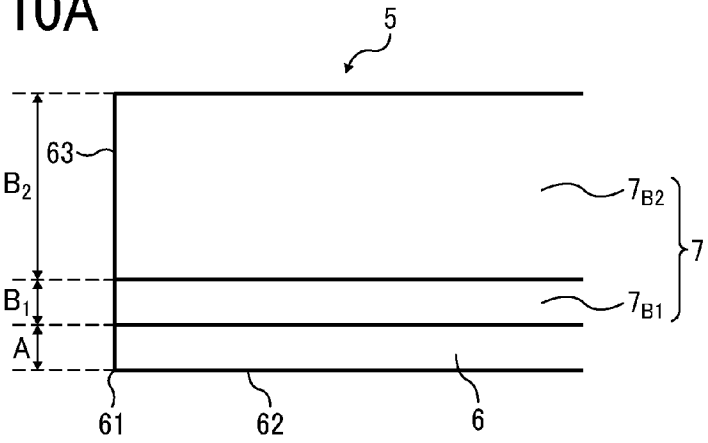
FIGS. 10A through 10F illustrate layer structures of the cleaning blade according to the second embodiment.

FIGS. 10A to 10F illustrate laminated structures of the cleaning blade 5 according to the second embodiment. FIG. 10A illustrates an example in which the entire cleaning blade 5 has a three-layer structure. FIGS. 10B to 10F illustrate examples in which only the vicinity of the edge 61 has a three-layer structure. FIG. 11 illustrates a cross section of the cleaning blade 5 according to the second embodiment. Reference character "D" in FIG. 11 represents a length of the cleaning blade 5.

In Embodiment 2-1, as illustrated in FIG. 10A, the entire cleaning blade 5 is three-layered. However, in the cleaning blade 5 according to Embodiment 2-2, only the vicinity of the edge 61 is three-layered as illustrated in FIGS. 10B to 10F.

Therefore, descriptions of structures similar to Embodiment 2-1, and action and effects thereof are omitted appropriately. Unless it is necessary to distinguish, the same reference characters are given to the same or similar elements in descriptions below.

In the structure in which the entire cleaning blade is three-layered, when the tan δ of the edge layer 6 drastically changes due to temperature changes, the edge layer 6 tends to contribute largely to the posture or behavior of the entire cleaning blade even when the change in tan δ of the backup layer 7 due to temperature change is small. Then, there is a risk that the cleaning capability deteriorates due to environmental change (temperature change).

Therefore, in the cleaning blade 5 according to Embodiment 2-2, as illustrated in FIGS. 10B to 10F, only the vicinity of the edge 61 (tip of the blade) has a three-layer structure.

When only the vicinity of the edge 61 is multilayered, the posture or behavior of the entire cleaning blade 5 depends on the backup layer 7. Therefore, by reducing the tan δ variation of the backup layer 7 due to temperature change, it is possible to suppress deterioration of cleaning capability caused by fatigue of the cleaning blade 5 or vibration or posture change of the entire cleaning blade 5.

Next, a verification experiment performed to ascertain effects of the cleaning blade 5 according to the present embodiment is described.

The tan δ of each layer was measured in a manner similar to that described above.

Multiple configurations of the cleaning blade 5 according to the present embodiment and comparative examples, used in the verification experiment, and verification results thereof are indicated in Table 9 below.

TABLE 9

| | Blade type | X | A [mm] | $B_1$ [mm] | $B_2$ [mm] | $L_1$ | $L_{B1}$ | $L_{B2}$ | Cleaning capability |
|---|---|---|---|---|---|---|---|---|---|
| Configuration 1 | Three-layer(b) | 0.42 | 0.01 | 0.10 | 1.80 | 0.80 | 0.70 | 0.40 | Good |
| Configuration 2 | Three-layer(c) | 0.41 | 0.10 | 0.50 | 1.30 | 0.85 | 0.60 | 0.30 | Good |
| Configuration 3 | Three-layer(d) | 0.41 | 0.10 | 0.50 | 1.30 | 0.85 | 0.60 | 0.30 | Good |
| Configuration 4 | Three-layer(e) | 0.41 | 0.01 | 0.50 | 1.30 | 0.80 | 0.70 | 0.30 | Good |
| Configuration 5 | Three-layer(f) | 0.42 | 0.01 | 0.10 | 1.80 | 0.80 | 0.65 | 0.40 | Good |
| Configuration 6 | Three-layer(a) | 0.42 | 0.01 | 0.10 | 1.80 | 0.80 | 0.70 | 0.40 | Acceptable |
| Configuration 7 | Three-layer(a) | 0.41 | 0.10 | 0.50 | 1.30 | 0.85 | 0.60 | 0.30 | Acceptable |
| Configuration 8 | Three-layer(a) | 0.41 | 0.10 | 0.50 | 1.30 | 0.85 | 0.60 | 0.30 | Acceptable |
| Configuration 9 | Three-layer(a) | 0.41 | 0.01 | 0.50 | 1.30 | 0.80 | 0.70 | 0.30 | Acceptable |
| Configuration 10 | Three-layer(a) | 0.42 | 0.01 | 0.10 | 1.80 | 0.80 | 0.65 | 0.40 | Acceptable |

TABLE 9-continued

| | Blade type | X | A [mm] | $B_1$ [mm] | $B_2$ [mm] | $L_1$ | $L_{B1}$ | $L_{B2}$ | Cleaning capability |
|---|---|---|---|---|---|---|---|---|---|
| Comparative example 1 | Three-layer(a) | 0.76 | 0.01 | 0.50 | 1.30 | 0.95 | 0.90 | 0.70 | Bad |
| Comparative example 2 | Three-layer(b) | 0.76 | 0.01 | 0.50 | 1.30 | 0.95 | 0.90 | 0.70 | Bad |
| Comparative example 3 | Three-layer(c) | 0.77 | 0.10 | 0.50 | 1.30 | 0.95 | 0.90 | 0.70 | Bad |
| Comparative example 4 | Three-layer(d) | 0.77 | 0.10 | 0.50 | 1.30 | 0.95 | 0.90 | 0.70 | Bad |
| Comparative example 1 | Three-layer(e) | 0.77 | 0.10 | 0.50 | 1.30 | 0.95 | 0.90 | 0.70 | Bad |
| Comparative example 6 | Three-layer(f) | 0.77 | 0.10 | 0.50 | 1.30 | 0.95 | 0.90 | 0.70 | Bad |

Here, with reference to FIGS. 10A to 10F, blade type in which the entire cleaning blade 5 has a three-layer structure and blade type in which only the vicinity of the edge 61 (tip of the blade edge) has a three-layer structure are described.

FIG. 10A illustrates an example in which the entire cleaning blade 5 has a three-layer structure. This blade type is indicated as "three-layer (a)" in Table 9 above. Each of the edge layer 6, the first backup layer $\mathbf{7}_{B1}$, and the second backup layer $\mathbf{7}_{B2}$ has a uniform thickness in the entire length D of the cleaning blade 5 illustrated in FIG. 11.

To determine the converted tan δ (X), the thickness A of the edge layer 6, the thickness $B_1$ of the first backup layer $\mathbf{7}_{B1}$, and the thickness $B_2$ of the second backup layer $\mathbf{7}_{B2}$ are used.

Figure 10B:
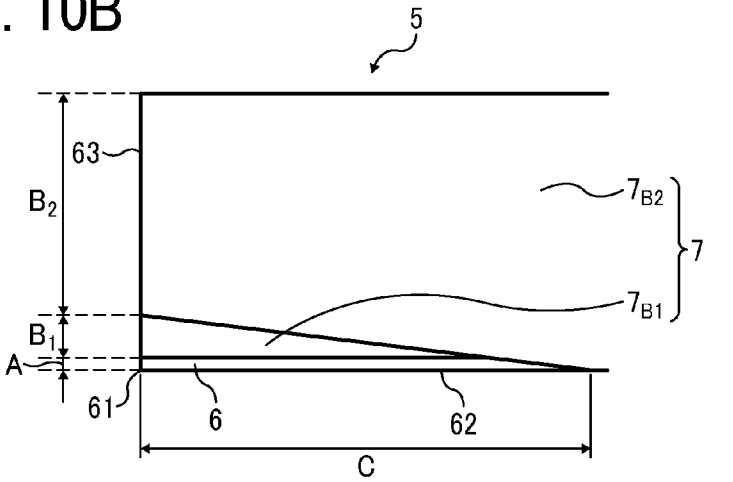
Figure 11:
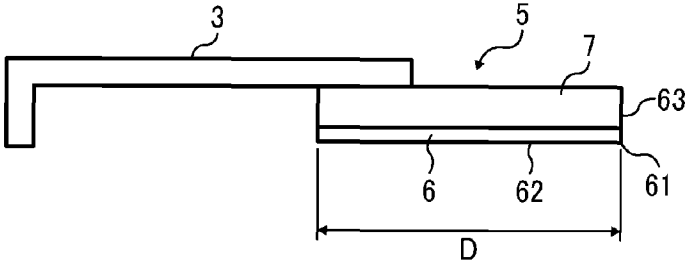
FIG. 11 is a cross-sectional view of the cleaning blade according to the second embodiment.

In FIG. 10B, only the vicinity of the edge 61 has a three-layer structure. In Table 9 above, this blade type is referred to as "three-layer (b)". A boundary of the second backup layer $\mathbf{7}_{B2}$ on a side of the outer face 62 is inclined to coincide with the outer face 62 at a distance of C from the edge 61. In other words, the thickness of the second backup layer $\mathbf{7}_{B2}$ progressively increases from the thickness $B_2$ at the end face 63 to become equal to the thickness of the entire cleaning blade 5 at the distance of C from the edge 61. The edge layer 6 is formed along the outer face 62 to have the thickness A, and the first backup layer $\mathbf{7}_{B1}$ adjoins this boundary to be interposed between the second backup layer $\mathbf{7}_{B2}$ and the edge layer 6.

To determine the converted tan δ (X), the thickness A at the end face 63 is used as the thickness of the edge layer 6, the thickness $B_1$ at the end face 63 is used as the thickness of the first backup layer $\mathbf{7}_{B1}$, and the thickness $B_2$ at the end face 63 is used as the thickness of the second backup layer $\mathbf{7}_{B2}$.

Additionally, the distance C in FIGS. 10B through 10F is equal to or longer than the nip width (1 μm to 1 mm) in which the edge layer 6 contacts the contact object (i.e., the photoconductor 10) and shorter than the length D of the cleaning blade 5 illustrated in FIG. 11.

Figure 10C:
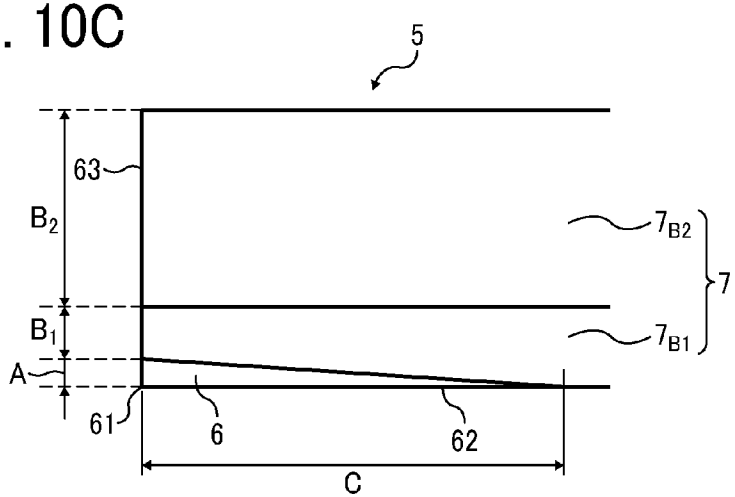

In FIG. 10C, only the vicinity of the edge 61 has a three-layer structure similarly, and the second backup layer $\mathbf{7}_{B2}$ has a uniform thickness ($B_2$) over the entire length D of the cleaning blade 5. However, a boundary of the first backup layer $\mathbf{7}_{B1}$ on the side of the outer face 62 is inclined to coincide with the outer face 62 in the distance of C from the edge 61. In other words, the thickness of the first backup layer $\mathbf{7}_{B1}$ progressively increases from the thickness $B_1$ at the end face 63, and the thickness of the edge layer 6 progressively decreases from the thickness A to zero at the distance of C from the edge 61.

To determine the converted tan δ (X), the thickness A at the end face 63 is used as the thickness of the edge layer 6, the thickness $B_1$ at the end face 63 is used as the thickness of the first backup layer $\mathbf{7}_{B1}$, and the thickness $B_2$ is used as the thickness of the second backup layer $\mathbf{7}_{B2}$. In Table 9 above, this blade type is referred to as "three-layer (c)".

Figure 10D:
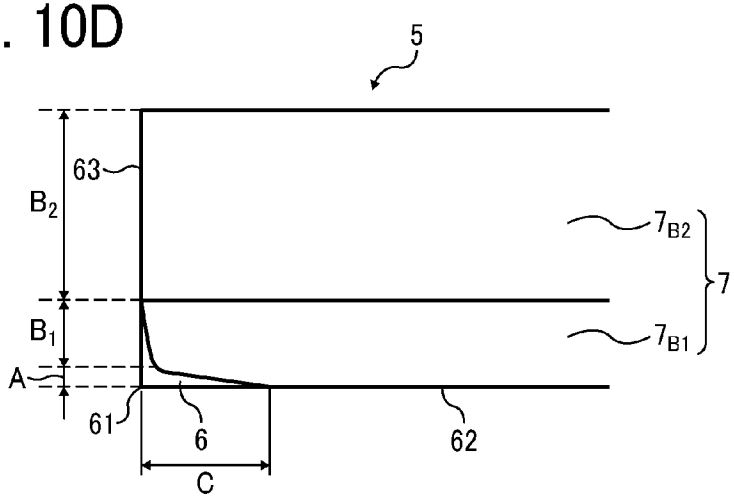

In FIG. 10D, only the vicinity of the edge 61 has a three-layer structure similarly, and the second backup layer $\mathbf{7}_{B2}$ has a uniform thickness ($B_2$) over the entire length D of the cleaning blade 5. In Table 9 above, this blade type is referred to as "three-layer (d)".

However, as illustrated in FIG. 10D, the edge layer 6 has a boomerang-shaped cross section with the edge 61 serving as an outer bending point. A first half of the boomerang-shaped edge layer 6 extends from the bending point along the end face 63, and a second half (the other half) extends along the outer face 62. A boundary between the first half of the edge layer 6 and the first backup layer $\mathbf{7}_{B1}$ is inclined from an inner bending point of the boomerang-shape toward the boundary between the first backup layer $\mathbf{7}_{B1}$ and the second backup layer $\mathbf{7}_{B2}$ at the end face 63. A boundary between the second half (extending along the outer face 62) and the first backup layer $\mathbf{7}_{B1}$ is inclined to coincide with the outer face 62 at the distance of C from the edge 61.

At the inner bending point of the boomerang-shaped edge layer 6, the first backup layer $\mathbf{7}_{B1}$ has the thickness $B_1$ (i.e., a length from the second backup layer $\mathbf{7}_{B2}$ to the inner bending point), and the face (interlayer face) of the first backup layer $\mathbf{7}_{B1}$ is inclined to coincide with the outer face 62 at the distance of C from the edge 61.

To determine the converted tan δ (X), the thickness A from the outer face 62 to the inner bending point of the boomerang-shape is used as the thickness of the edge layer 6, and the thickness $B_1$ from the inner bending point of the boomerang-shape to the second backup layer $\mathbf{7}_{B2}$ is used as the thickness of the first backup layer $\mathbf{7}_{B1}$. The thickness $B_2$ is used as the thickness of the second backup layer $\mathbf{7}_{B2}$.

Figure 10F:
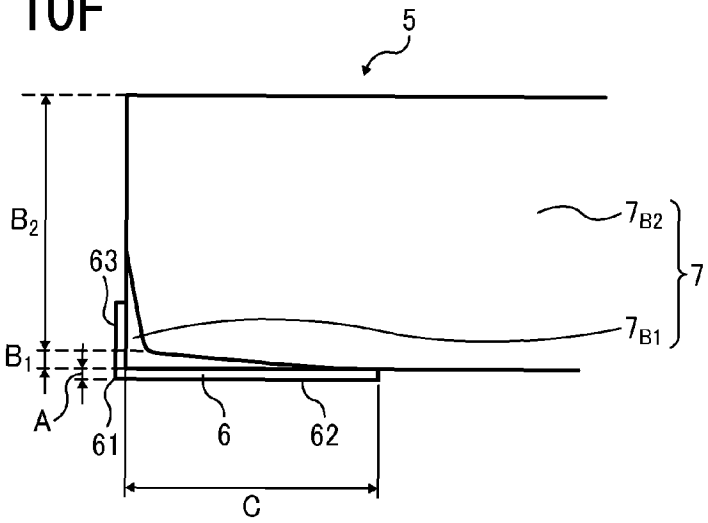
Figure 10E:
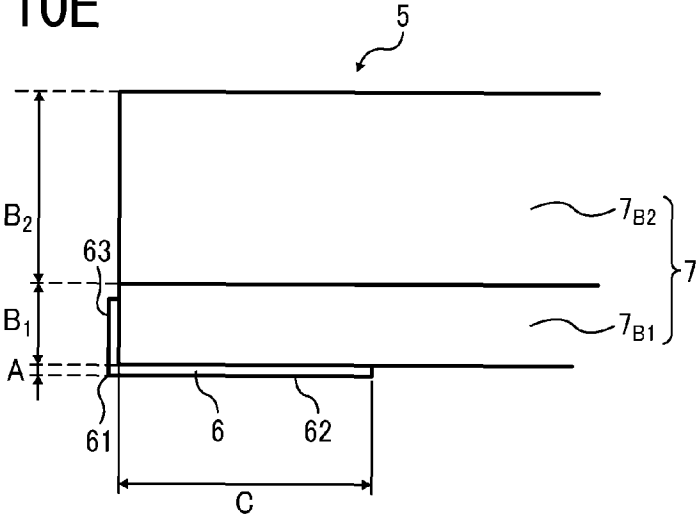

In FIG. 10E, only the vicinity of the edge 61 has a three-layer structure similarly, and the thicknesses $B_1$ and $B_2$ of the first and second backup layers $\mathbf{7}_{B1}$ and $\mathbf{7}_{B2}$ are uniform over the entire length D of the cleaning blade 5. The edge layer 6 has an L-shape including a first part that partly covers an end face side (along the end face 63) of the first backup layer $\mathbf{7}_{B1}$ and a second part that covers an outer face side (along the outer face 62) of the first backup layer $\mathbf{7}_{B1}$ in the distance of C from the edge 61. The second part covering the outer face side has the thickness A. In Table 9 above, this blade type is referred to as "three-layer (e)".

To determine the converted tan δ (X), the thickness A of the second part covering the outer face side of the first backup layer $7_{B1}$, the thickness of $B_1$ of the first backup layer $7_{B1}$, and the thickness $B_2$ of the second backup layer $7_{B2}$ are used.

In FIG. 10F, only the vicinity of the edge 61 has a three-layer structure similarly, and the backup layer 7 has a rectangular cross section. The backup layer 7 includes the first backup layer $7_{B1}$ located in the vicinity of the edge 61 and having a boomerang-shaped cross section. The second backup layer $7_{B2}$ occupies the rest of the backup layer 7. The edge layer 6 is L-shaped and includes a first part covering an end face side (along the end face 63) of the boomerang-shaped first backup layer $7_{B1}$ and a second part covering an outer face side of the backup layer 7 in the distance of C from the edge 61. The second part of the edge layer 6 (on the outer face side) has the thickness A.

A first boundary of the boomerang-shaped first backup layer $7_{B1}$ (with the second backup layer $7_{B2}$) is inclined from a bending point of the boomerang-shape to a point close to a middle point of the second backup layer $7_{B2}$ on the end face 63. A second boundary of the first backup layer $7_{B1}$ (with the second backup layer $7_{B2}$) is inclined to coincide with the outer face 62 at a position close to the end of the edge layer 6 extending for the distance C from the edge 61.

To determine the converted tan δ (X), the thickness A of the second part of the L-shape covering the outer face side is used as the thickness of the edge layer 6, and the thickness $B_1$ from the edge layer 6 to the inner bending point of the boomerang-shape is used as the thickness of the first backup layer $7_{B1}$. As the thickness of the second backup layer $7_{B2}$, the thickness $B_2$ from the inner bending point of the boomerang-shape to the face of the cleaning blade 5 opposite the outer face 62 is used.

In Table 9 above, this blade type is referred to as "three-layer (f)".

[Evaluation Method]

The cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 5 and Comparative examples 1 through 11 listed in Table 9.

In each of the cold environment (10° C.), the ordinary temperature environment (23° C.), and the hot environment (32° C.), images were successively output on 20,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 10,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 10,000 sheets. There is no practical disadvantage.

Acceptable: In each of the three environments, no trace of defective cleaning is observed on the sheets after output of 10,000 sheets. Although there is no practical disadvantage, in one of the three environments, toner escaping the cleaning blade on the photoconductor 10 was observed.

Poor: In one of the three environments, the trace of defective cleaning was observed on the sheets after output of 10,000 sheets. In practice, the outputs images were substandard.

[Evaluation Results]

Configuration 1

The thickness A of the edge layer 6 is 0.01 mm. The thickness $B_1$ of the first backup layer $7_{B1}$ of the backup layer 7 is 0.10 mm. The thickness $B_2$ of the second backup layer $7_{B2}$ is 1.80 mm. The tan δ variation $L_1$ of the edge layer 6 is 0.80. The tan δ variation $L_{B1}$ of the backup layer $7_{B1}$ is 0.70. The tan δ variation of $L_{B2}$ of the second backup layer $7_{B2}$ is 0.40. The converted tan δ (X) calculated from Formulas 2 and 3 is 0.42.

This converted tan δ (X) is within a range of from 0.20 to 0.51. Cleaning capability was evaluated to be good in any of the cold environment (10° C.), the ordinary temperature environment (23° C.), and the hot environment (32° C.). That is, defective cleaning did not occur. In any environment, toner escaping the cleaning blade on the photoconductor 10 was not observed.

Configurations 2 Through 5

Similar to Configuration 1, the converted tan δ (X) calculated from Formulas 2 and 3 is within the range of 0.20 or greater and 0.51 or less. Cleaning capability was evaluated to be good in any of the cold environment (10° C.), the ordinary temperature environment (23° C.), and the hot environment (32° C.). No trace of defective cleaning was observed on transfer paper, and defective cleaning did not occur. In any environment, toner escaping the cleaning blade on the photoconductor 10 was not observed.

Comparative Examples 1 Through 5

Similar to Configurations 1 through 5, the converted tan δ (X) calculated from Formulas 2 and 3 is within a range of 0.20 or greater and 0.51 or less. Cleaning capability was rated as acceptable in any of the cold environment (10° C.), the ordinary temperature environment (23° C.), and the hot environment (32° C.). No trace of defective cleaning was observed on transfer paper, and defective cleaning did not occur. However, unlike Configurations 1 through 5, toner escaping the cleaning blade on the photoconductor 10 was observed in any one of the environments.

Comparative Examples 6 Through 11

Unlike Configurations 1 through 5 and Comparative examples 1 through 5, the converted tan δ (X) calculated from Formulas 2 and 3 is more than 0.51. Therefore, cleaning capability deteriorated due to environmental change, and was rated as poor in the hot or cold environment. That is, defective cleaning was obvious on transfer paper.

The above verification results confirm that the following effect are attained by setting the converted tan δ (X) defined by Formulas 2 and 3 to 0.23 or greater and 0.51 or smaller in the temperature range of from 0° C. to 50° C. and making the three-layer structure only in the vicinity of the edge 61.

In addition to the effect of Embodiment 2-1, contribution of the backup layer 7 to the posture or behavior of the entire cleaning blade 5 is increased since only the vicinity (tip of the edge) of the edge 61 has the laminated structure. Therefore, by reducing the tan δ variation of the backup layer 7 due to temperature change, it is possible to suppress fatigue of the cleaning blade 5 or deterioration of cleaning capability caused by vibration of the entire cleaning blade 5 or posture change of the cleaning blade 5. This is clear from the following facts. That is, in Configurations 1 through 5, toner escaping the cleaning blade on the photoconductor 10 was not observed in any environment. By contrast, in Comparative examples 1 through 5, toner escaping the cleaning blade on the photoconductor 10 was observed in any one of the environments.

Even if only the vicinity of the edge 61 has a three-layer structure, when the converted tan δ (X) defined by Formulas 2 and 3 is not within a range of 0.23 or greater and 0.51 or smaller in the temperature range of from 0° C. to 50° C., the above effects are not attained.

Thus, the cleaning blade 5 usable in the cleaning device 1 according to the second embodiment has been described using Embodiments 2-1 and 2-2.

Here, the image forming apparatus 100 according to the second embodiment can exhibit a similar effect to the cleaning blade 5 according to Embodiment 2-1 or 2-2 described above by including the cleaning blade 5 according to Embodiment 2-1 or 2-2.

For example, the image forming apparatus 100 can suppress generation of vibration and fatigue of the cleaning blade 5 due to environmental change (temperature change), which degrade the cleaning capability of the cleaning device 1, and accordingly suppress creation of substandard images caused by the degraded cleaning capability.

Since the image forming apparatus 100 according to the second embodiment uses the three-layer cleaning blade 5 having the tan δ less dependent on the environment, vibration is suppressed, similar to the first embodiment, even when the charging device 40 employs the charging roller 41 to apply AC voltage to the surface of the photoconductor 10.

Thus, generation of noise due to vibration, abrasion and chipping of the cleaning blade 5, and abnormal abrasion of the photoconductor 10 are suppressed.

Similar to the first embodiment, in the image forming apparatus 100 according to the second embodiment, inorganic particles are included at the surface or in the surface layer of the photoconductor 10. It is possible to suppress vibration of the edge 61 by using the three-layer cleaning blade 5 whose tan δ is less dependent on the environment.

Thus, the image forming apparatus 100 according to the second embodiment can suppress noise caused by the vibration of the cleaning blade 5, abrasion or chipping of the cleaning blade 5, and abnormal abrasion of the photoconductor 10 even when inorganic particles are included at the surface of the photoconductor 10.

A layer structure similar to that described in the first embodiment can be used for the photoconductor 10 of the image forming apparatus 100.

For the image forming apparatus 100 according to the second embodiment, toner similar to that described in the first embodiment can be used.

Third Embodiment

Descriptions are given below of an image forming apparatus including a cleaning blade according to a third embodiment.

It is to be noted that third embodiment is different from the first embodiment only regarding the cleaning blade 5 of the cleaning device 1. Specifically, in the first embodiment, the cleaning blade 5 is double-layered and includes the edge layer 6, which includes the edge 61, and the backup layer 7 laminated on the edge layer 6. By contrast, in the third embodiment, the cleaning blade 5 is a double-region blade and includes an edge region 206 including the edge 61 and an adjacent region 207 that adjoins the edge region 206 and does not include the edge 61. The edge region 206 and the adjacent region 207 are equivalent to the edge layer 6 and the backup layer 7 of the first embodiment, respectively.

Except the cleaning blade 5, the structure (the cleaning device 1, the charging device 40, the charging device 40, the photoconductor 10, toner, and the like) of the image forming apparatus 100 according to the third embodiment is similar to that of the first embodiment, and descriptions about operation, action, and effects of the similar structure are omitted. Components identical or similar to those described above are given identical reference characters.

Descriptions are given below of multiple configurations of the cleaning blade 5 usable in each cleaning device 1 of the image forming apparatus 100 according to the third embodiment.

Embodiment 3-1

The cleaning blade 5 according to Embodiment 3-1, usable in the cleaning device 1 according to the third embodiment, is described with reference to the drawings.

Figure 12A:
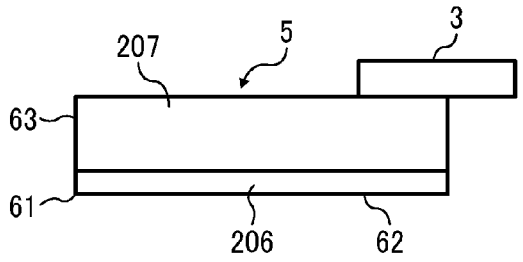
FIGS. 12A though 12F are schematic views of shapes of the cleaning blade usable in a third embodiment.

FIGS. 12A though 12F are schematic views of shapes of the cleaning blade 5 usable in the third embodiment.

Figure 12B:
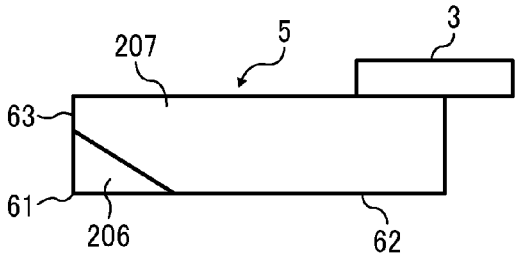
Figure 12C:
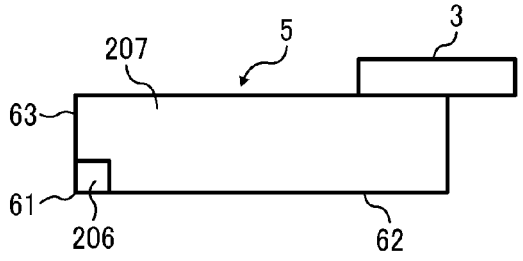

FIG. 12A illustrates a bilayer blade shape including the edge region 206 and the adjacent region 207 divided from each other by a line parallel to the outer face 62. FIG. 12B illustrates a blade shape in which the edge region 206 and the adjacent region 207 are divided from each other by a line that obliquely adjoins both of the outer face 62 and the end face 63. FIG. 12C illustrates a blade shape in which the edge region 206 has a rectangular boundary. That is, the edge region 206 and the adjacent region 207 are divided from each other by a first line parallel to the outer face 62 and a second line parallel to the end face 63, and the first line and the second line are equal in distance from the edge 61, which adjoins both of the outer face 62 and the end face 63.

Figure 12D:
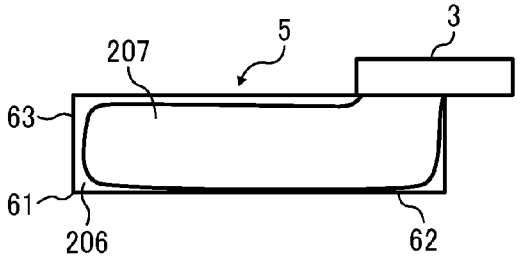
Figure 12E:
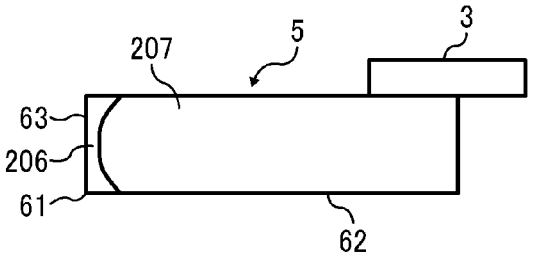
Figure 12F:
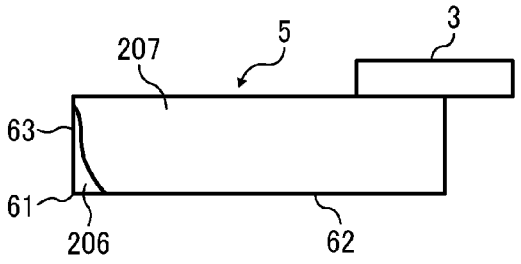

FIG. 12D illustrates a blade shape in which the edge region 206 covers a circumference of the adjacent region 207 except the contact portion of the adjacent region 207 with the support 3. For example, the edge region 206 is formed by impregnation. FIG. 12E illustrates a blade shape in which the edge region 206 is formed on the side of the end face 63 by impregnation or the like, separately from the adjacent region 207. FIG. 12F illustrates a blade shape in which the edge region 206 extends from the edge 61 in a part of the outer face 62 and a part of the end face 63. The edge region 206 is produced by impregnation or the like, separately from the adjacent region 207.

Figure 13A:
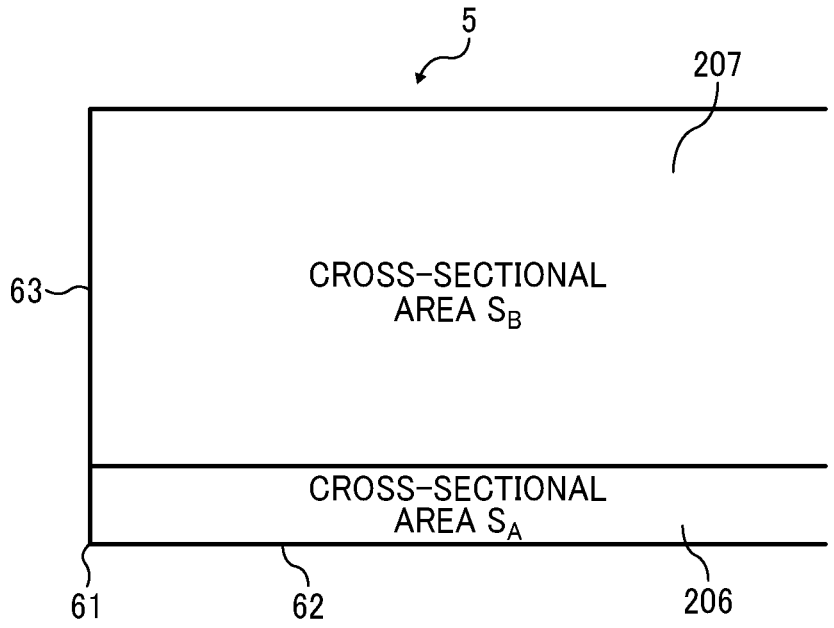
FIG. 13A is a cross-sectional view of a blade structure according to the third embodiment.
Figure 13B:
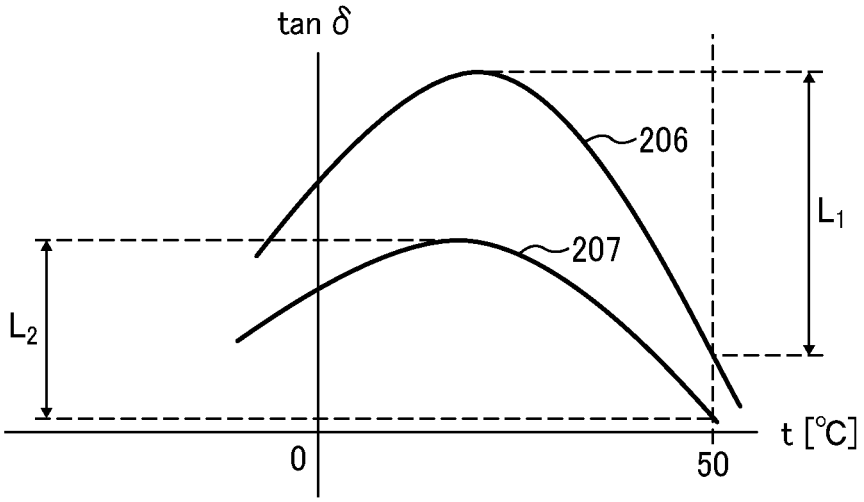
FIG. 13B is a graph of variation of tan δ of each of an edge region and an adjacent region of the blade structure illustrated in FIG. 13A.

With reference to FIGS. 13A and 13B, Formula 4 to define the converted tan δ (X) according to the present embodiment is described.

FIG. 13A illustrates a cross section of the bilayer blade structure. FIG. 13B is a graph of the tan δ variation $L_1$ (change amount of tan δ) of the edge region 206 and the tan δ variation $L_2$ of the adjacent region 207.

The cleaning blade 5 according to the first embodiment is limited to multilayer structures though capable of suppressing vibration and fatigue of the cleaning blade 5 caused by environmental changes to a certain degree, thereby inhibiting degradation of cleaning capability. The blade structure usable in the cleaning device, however, is not limited to the bilayer structure illustrated in FIG. 12A but includes the two-region structures, which includes the edge region 206 having the edge 61 and the adjacent region 207 without the edge 61, as illustrated in FIGS. 12B through 12F.

Above-described Formula 1 to calculate the converted tan δ (X) is applicable to the multilayered blades, and the converted tan δ (X) calculated from Formula 1 is not suitable to multi-region blades.

As described above, cleaning blades are designed to be used in a temperature range centered on ordinary temperature (for example, 23° C.), and there is a risk of degradation of cleaning capability if the environment changes to the hot or cold environment.

Also in a two-region blade, there is a risk that, due to environmental changes, the vibration or fatigue of the blade occurs to degrade the cleaning capability unless the tan δ of the two-region blade is set in a preferable range.

In the present embodiment, the area of the cleaning blade 5 is divided, with a boundary, into the edge region 206 including the edge 61 and the adjacent region 207 without the edge 61. Then, the edge region 206 and the adjacent region 207 are designed such that the converted tan δ (X) defined by Formula 4 is 0.23 or greater and 0.51 or smaller in the temperature range of from 0° C. to 50° C.

$$X = \frac{S_A}{S_A + S_B} \times L_1 + \frac{S_B}{S_A + S_B} \times L_2 \qquad \text{Formula 4}$$

where X represents the converted tan δ, $S_A$ represents a cross-sectional area (in square millimeters) of the edge region 206, $S_B$ represents a cross-sectional area (in square millimeters) of the adjacent region 207, $L_1$ represents the tan δ variation (difference between maximum and minimum in the temperature range of from 0° C. to 50° C.) of the edge region 206, and $L_2$ represents the tan δ variation (difference between maximum and minimum in the temperature range of from 0° C. to 50° C.) of the adjacent region 207.

In an example illustrated in FIG. 13A, which is a bilayer blade, the cross-sectional area $S_A$ and the cross-sectional area $S_B$ are cross-sectional areas of the edge region 206 and the adjacent region 207 that are not deformed and rectangular.

Each of the tan δ variation $L_1$ of the edge region 206 and the tan δ variation $L_2$ of the adjacent region 207 is the difference between the maximum and the minimum of the tan δ when the ambient temperature changes from 0° C. to 50° C. Similar to the first embodiment, an elastic material, such as urethane rubber, is usable for each layer of the cleaning blade 5.

Formula 4 mentioned above defines the value X of the converted tan δ, which serves as an index of los tangent tan δ of the entire two-region cleaning blade 5 (including the edge region 206 and the adjacent region 207) in the temperature range of from 0° C. to 50° C.

By setting the range of the converted tan δ (X) to 0.23 or greater and 0.51 or smaller (i.e., a range of from 0.23 to 0.51), the tan δ of the entire cleaning blade 5 is kept in a suitable range while suppressing fluctuations (variation) in the tan δ of the entire cleaning blade 5 due to environmental changes. By setting the converted tan δ (X) in the range from 0.23 to 0.51, the tan δ of the entire two-region cleaning blade 5 is prevented from significantly fluctuating due to environmental changes. Accordingly, the tan δ of the entire cleaning blade 5 can be set to a suitable range.

Thus, the degradation of cleaning capability of the cleaning blade 5 is suppressed.

Next, a verification experiment performed to ascertain effects of the cleaning blade 5 according to the present embodiment is described.

It is to be noted that the tan δ is measured using a dynamic viscoelasticity measuring instrument in the temperature range of from 0° C. to 50° C., and dynamic storage elastic modulus (E') and dynamic loss modulus (E") are measured at constant frequency or multiple frequencies. Then, the tan δ (dynamic loss tangent, =E'/E") of the material such as urethane rubber used for the cleaning blade 5 is calculated.

The cleaning blade 5 used in the experiment is made of urethane rubber, and there is no urethane rubber satisfying the converted tan δ (X) smaller than 0.23. Accordingly, in the verification, the converted tan δ (X) was 0.23 or greater.

Multiple configurations of the cleaning blade 5 according to the present embodiment and comparative examples, used in the verification experiment, and verification results thereof are indicated in Table 10 below.

It is to be noted that the blade shape illustrated in FIG. 12A (bilayer structure) was used in the verification experiment described here. Verification experiments regarding the blade shapes illustrated in FIGS. 12B through 12F are described later.

Figure 14A:
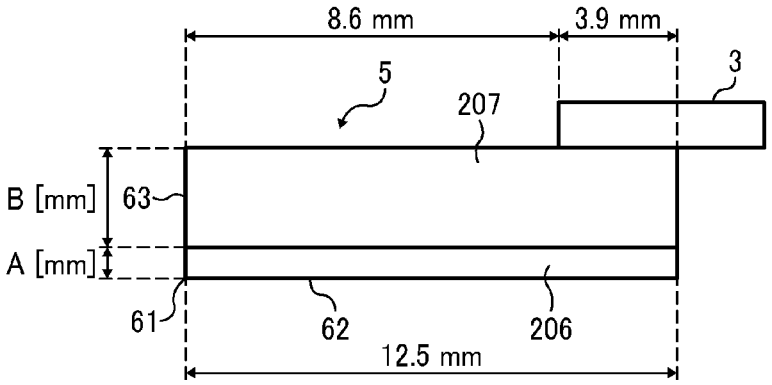
FIGS. 14A and 14B are schematic cross-sectional views, with dimensions, of cleaning blades used in a verification experiment of the third embodiment.

As illustrated in FIG. 14A, the cleaning blade 5 used in the experiment has a length of 12.5 mm. Evaluation was made while the thickness A of the edge region 206 and the thickness B of the adjacent region 207 were varied to vary the cross-sectional area $S_A$ of the edge region 206 and the cross-sectional area $S_B$ of the adjacent region 207, respectively, and the tan δ variation $L_1$ of the edge region 206 and the tan δ variation $L_2$ of the adjacent region 207 were varied. Thus, the relations between cleaning capability and the cross-sectional area $S_A$ of the edge region 206, the cross-sectional area $S_B$ of the adjacent region 207, the tan δ variation $L_1$ of the edge region 206, and the tan δ variation $L_2$ of the adjacent region 207 were studied.

TABLE 10

| | X | $S_A$ [mm$^2$] | $S_B$ [mm$^2$] | $L_1$ | $L_2$ | Cleaning capability |
|---|---|---|---|---|---|---|
| Configuration 1 | 0.23 | 16.3 | 16.3 | 0.30 | 0.20 | Excellent |
| Configuration 2 | 0.24 | 16.3 | 16.3 | 0.35 | 0.20 | Excellent |
| Configuration 3 | 0.29 | 12.5 | 12.5 | 0.40 | 0.20 | Good |
| Configuration 4 | 0.29 | 16.3 | 16.3 | 0.50 | 0.20 | Good |
| Configuration 5 | 0.28 | 16.3 | 16.3 | 0.50 | 0.20 | Good |
| Configuration 6 | 0.30 | 11.3 | 11.3 | 0.30 | 0.30 | Good |
| Configuration 7 | 0.31 | 13.8 | 13.8 | 0.55 | 0.20 | Good |
| Configuration 8 | 0.33 | 10.0 | 10.0 | 0.25 | 0.40 | Good |
| Configuration 9 | 0.33 | 12.5 | 12.5 | 0.50 | 0.20 | Good |
| Configuration 10 | 0.35 | 17.5 | 17.5 | 0.50 | 0.30 | Good |
| Configuration 11 | 0.35 | 10.0 | 10.0 | 0.50 | 0.20 | Good |
| Configuration 12 | 0.41 | 12.5 | 12.5 | 0.70 | 0.20 | Acceptable |
| Configuration 13 | 0.46 | 18.8 | 18.8 | 0.80 | 0.35 | Acceptable |
| Configuration 14 | 0.51 | 16.3 | 16.3 | 0.80 | 0.40 | Acceptable |
| Comparative example 1 | 0.52 | 16.3 | 16.3 | 0.60 | 0.50 | Poor |
| Comparative example 2 | 0.57 | 12.5 | 12.5 | 0.70 | 0.50 | Poor |
| Comparative example 3 | 0.60 | 18.8 | 18.8 | 0.90 | 0.50 | Poor |
| Comparative example 4 | 0.67 | 12.5 | 12.5 | 0.80 | 0.60 | Poor |
| Comparative example 5 | 0.68 | 16.3 | 16.3 | 0.90 | 0.60 | Poor |
| Comparative example 6 | 0.71 | 16.3 | 16.3 | 1.00 | 0.60 | Poor |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 14 and Comparative examples 1 through 6 indicated in Table 10.

In each of the cold environment (10° C.), the ordinary temperature environment (23° C.), and the hot environment (32° C.), the test machine was left unused for 24 hours, and then images were successively output on 10,000 sheets. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 10,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 10,000 sheets. There is no practical disadvantage.

Acceptable: In each of the three environments, no trace of defective cleaning is observed on the sheets after output of 10,000 sheets. Although there is no practical disadvantage, in one of the three environments, toner escaping the cleaning blade on the photoconductor 10 was observed.

Poor: In one of the three environments, the trace of defective cleaning was observed on the sheets after output of 10,000 sheets. In practice, the outputs images were substandard.

[Evaluation Results]

Configuration 1

Figure 14B:
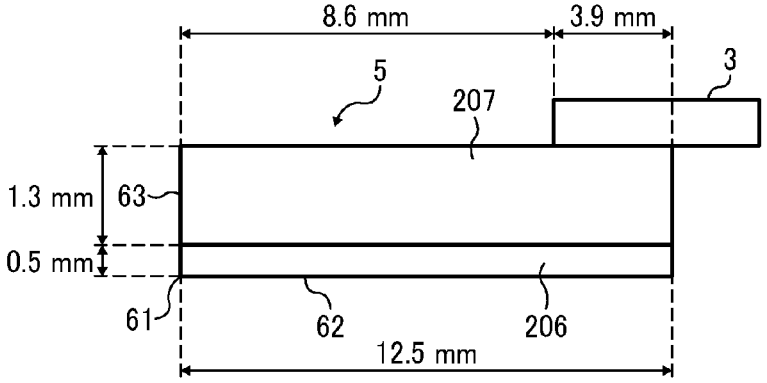

As illustrated in FIG. 14B, the edge region 206 has a thickness of 0.5 mm, the adjacent region 207 has a thickness of 1.3 mm, the cross-sectional area $S_A$ of the edge region 206 is 6.3 $mm^2$, and the cross-sectional area $S_B$ of the adjacent region 207 is 16.3 $mm^2$. The tan δ variation $L_1$ of the edge region 206 is 0.30. The tan δ variation $L_2$ of the adjacent region 207 is 0.20. The converted tan δ (X) calculated from Formula 4 is 0.23, which is within the range of from 0.23 to 0.51.

Cleaning capability was rated as excellent in any of the cold environment (10° C.), the ordinary temperature environment (23° C.), and the hot environment (32° C.). That is, defective cleaning did not occur.

Configurations 2 Through 14

Similar to Configuration 1, the converted tan δ (X) calculated from Formula 4 is within the range of from 0.23 to 0.51. Cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Comparative Examples 1 Through 6

Unlike Configurations 1 through 14, the converted tan δ (X) calculated from Formula 4 is greater than 0.51. Cleaning capability deteriorated due to environmental change and was rated as poor in the hot environment or the cold environment. That is, defective cleaning was obvious on transfer paper (image).

The above verification results confirm that vibration, fatigue, or both of the blade due to environmental changes (temperature changes), which result in defective cleaning, are suppressed by setting the value of converted tan δ (X) defined in Formula 4 to 0.23 or greater and 0.51 or smaller in the temperature range of from 0° C. to 50° C.

Embodiment 3-2

Embodiment 3-2 of the cleaning blade 5, usable in the cleaning device 1 according to the third embodiment, is described below.

The cleaning blade 5 according to Embodiment 3-2 is different from the cleaning blade according to Embodiment 3-1 only in that a more preferable range of the tan δ variation $L_1$ of the edge region 206 is specified. Therefore, descriptions of structures similar to Embodiment 3-1, and action and effects thereof are omitted appropriately. Unless it is necessary to distinguish, the same reference characters are given to the same or similar elements in descriptions below.

The above-described structure according to Embodiment 3-1 suppresses vibration, fatigue, or both of the blade caused by environmental changes (temperature changes), which result in defective cleaning.

However, when the tan δ of the edge region 206 decreases due to environmental change (temperature change), that is, becomes a value of high repulsion at which a material does not easily absorb energy, vibration such as stick slip or the like of the edge 61 occurs, and the edge is chipped easily. By contrast, when the tan δ of the edge region 206 increases, that is, becomes a value of low repulsion at which a material absorbs energy easily, fatigue is easily caused by permanent deformation of the edge region 206.

Therefore, in the cleaning blade 5 according to the present embodiment, in addition to the structure according to Embodiment 3-1, the variation (difference between maximum and minimum in the temperature range of from 0° C. to 50° C.) of tan δ $L_1$ of the edge region 206 is set to 0.3 or greater and 0.65 or smaller (a range of from 0.3 to 0.65) in the temperature range of from 0° C. to 50° C.

By setting the tan δ variation $L_1$ of the edge region 206 to the range of from 0.3 to 0.65 in the temperature range of from 0° C. to 50° C., it is possible to suppress vibration and chipping of the edge 61 of the edge region 206 due to environmental change as well as fatigue caused by permanent deformation of the edge region 206.

Next, a verification experiment performed to ascertain effects of the cleaning blade 5 according to the present embodiment is described.

The tan δ of each layer was measured in a manner similar to that in Embodiment 3-1.

The cleaning blade 5 used in the experiment is made of urethane rubber, as the elastic material, and there is no urethane rubber satisfying the edge region 206 having the tan δ variation $L_1$ smaller than 0.3. Accordingly, the tan δ variation $L_1$ was 0.3 or greater in the verification experiment.

Multiple configurations of the cleaning blade 5 according to the present embodiment and comparative examples, used in the verification experiment, and verification results thereof are indicated in Table 11 below.

TABLE 11

| | X | $S_A$ [$mm^2$] | $S_B$ [$mm^2$] | $L_1$ | $L_2$ | Cleaning capability |
|---|---|---|---|---|---|---|
| Configuration 1 | 0.30 | 6.3 | 16.3 | 0.30 | 0.20 | Excellent |
| Configuration 2 | 0.31 | 6.3 | 16.3 | 0.35 | 0.30 | Excellent |
| Configuration 3 | 0.34 | 6.3 | 16.3 | 0.45 | 0.30 | Good |
| Configuration 4 | 0.36 | 6.3 | 16.3 | 0.50 | 0.30 | Good |

TABLE 11-continued

| | X | $S_A$ [mm$^2$] | $S_B$ [mm$^2$] | $L_1$ | $L_2$ | Cleaning capability |
|---|---|---|---|---|---|---|
| Configuration 5 | 0.31 | 6.3 | 16.3 | 0.60 | 0.20 | Acceptable |
| Configuration 6 | 0.33 | 6.3 | 16.3 | 0.65 | 0.20 | Acceptable |
| Comparative example 1 | 0.35 | 6.3 | 16.3 | 0.75 | 0.20 | Poor |
| Comparative example 2 | 0.34 | 6.3 | 18.8 | 0.77 | 0.20 | Poor |
| Comparative example 3 | 0.35 | 6.3 | 18.8 | 0.78 | 0.20 | Poor |
| Comparative example 4 | 0.35 | 6.3 | 18.8 | 0.80 | 0.20 | Poor |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 6 and Comparative examples 1 through 4 indicated in Table 11.

In each of the cold environment (10° C.), the ordinary temperature environment (23° C.), and the hot environment (32° C.), images were successively output on 20,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 20,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 20,000 sheets. There is no practical disadvantage.

Acceptable: In each of the three environments, no trace of defective cleaning is observed on the sheets after output of 20,000 sheets. There is no practical disadvantage. However, in one of the three environments, toner escaping the cleaning blade on the photoconductor 10 was observed.

Poor: In one of the three environments, the trace of defective cleaning was observed on the sheets after output of 20,000 sheets. In practice, the outputs images were substandard.

[Evaluation Results]

Configuration 1

The cross-sectional area $S_A$ of the edge region 206 is 6.3 mm$^2$, and the cross-sectional area $S_B$ of the adjacent region 207 is 16.3 mm$^2$. The tan δ variation $L_1$ of the edge region 206 is 0.30. The tan δ variation $L_2$ of the adjacent region 207 is 0.20. The converted tan δ (X) calculated from Formula 4 is 0.23.

The converted tan δ (X) of this configuration is within the range of from 0.23 to 0.51. The tan δ variation $L_1$ of the edge region 206 is 0.30 in the temperature range of from 0° C. to 50° C. This value is within the range of from 0.3 to 0.65.

With these features, cleaning capability was rated as excellent in any of the cold environment (10° C.), the ordinary temperature environment (23° C.), and the hot environment (32° C.) even in the cleaning capability evaluation in which 20,000 sheets were output. That is, defective cleaning did not occur.

According to these results, the tan δ of the edge region 206 was not excessively varied by environmental change (temperature change). Additionally, in the hot environment or the cold environment, vibration and chipping of the edge 61 as well as fatigue caused by permanent deformation of the edge region 206 was not generated.

Configurations 2 Through 6

Similar to Configuration 1, the converted tan δ (X) calculated from Formula 4 is within the range of from 0.23 to 0.51.

The tan δ variation $L_1$ of the edge region 206 is in the range of from 0.3 to 0.65 in the temperature range of from 0° C. to 50° C.

With these features, cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Similar to Configuration 1, according to these results, the tan δ of the edge region 206 was not excessively varied by environmental change (temperature change). Additionally, in the hot or cold environment, vibration and chipping of the edge 61 as well as fatigue caused by permanent deformation of the edge region 206 was not generated.

Comparative Examples 1 Through 4

Unlike Configurations 1 through 6, the tan δ variation $L_1$ of the edge region 206 was greater than 0.51 in the temperature range of from 0° C. to 50° C. Cleaning capability was rated as poor in the hot or cold environment. That is, defective cleaning was obvious on transfer paper (image).

These results indicate that the tan δ of the edge region 206 was excessively varied due to environmental change (temperature change) and that at least one of vibration and chipping of the edge 61 and fatigue caused by permanent deformation of the edge region 206 occurred in the hot or cold environment.

It is known from the above verification results that the above effects are attained in the configurations in which the converted tan δ (X) defined by Formula 4 is 0.23 or greater and 0.51 or smaller and the tan δ variation $L_1$ of the edge region 206 is 0.3 or greater and 0.65 or smaller in the temperature range of from 0° C. to 50° C.

That is, the configurations according to Embodiment 3-2 are advantageous in suppressing vibration and chipping of the edge 61 of the edge region 206 due to environmental change as well as fatigue caused by permanent deformation of the edge region 206.

Embodiment 3-3

Embodiment 3-3 of the cleaning blade 5, usable in the cleaning device 1 according to the third embodiment, is described below.

The cleaning blade 5 according to Embodiment 3-3 is different from the cleaning blade according to Embodiment 3-1 only in that a more preferable range of the tan δ variation $L_2$ of the adjacent region 207 is specified.

Therefore, descriptions of structures similar to Embodiment 3-1, and action and effects thereof are omitted appropriately. Unless it is necessary to distinguish, the same reference characters are given to the same or similar elements in descriptions below.

The above-described structure according to Embodiment 3-1 suppresses vibration, fatigue, or both of the blade caused by environmental changes (temperature changes), which result in defective cleaning.

However, when the tan δ of the adjacent region 207 decreases due to environmental change (temperature change), that is, becomes a value of high repulsion at which a material does not easily absorb energy, toner void is generated easily due to vibration of the adjacent region 207. By contrast, when the tan δ of the adjacent region 207 increases, that is, becomes a value of low repulsion at which a material absorbs energy easily, fatigue is easily caused by permanent deformation of the adjacent region 207.

Therefore, in the cleaning blade 5 according to Embodiment 3-3, in addition to the structure according to Embodiment 3-1, the variation (difference between maximum and minimum) of the tan δ variation $L_2$ of the adjacent region 207 is set to 0.2 or greater and 0.5 or smaller (a range of from 0.2 to 0.5) in the temperature range of from 0° C. to 50° C.

By setting the tan δ variation $L_2$ of the adjacent region 207 in the range of from 0.2 to 0.5 in the temperature range of from 0° C. to 50° C., it is possible to suppress a toner void due to vibration of the adjacent region 207 and generation of fatigue caused by permanent deformation of the adjacent region 207.

Next, a verification experiment performed to ascertain effects of the cleaning blade 5 according to the present embodiment is described.

The tan δ of each layer was measured in a manner similar to that in Embodiment 3-1.

The cleaning blade 5 used in the experiment is made of urethane rubber, as the elastic material, and there is no urethane rubber satisfying the adjacent region 207 having the tan δ variation $L_2$ smaller than 0.2. Accordingly, the tan δ variation $L_2$ was 0.2 or greater in the verification experiment.

Multiple configurations of the cleaning blade 5 according to the present embodiment and comparative examples, used in the verification experiment, and verification results thereof are indicated in Table 12 below.

TABLE 12

| | X | $S_A$ [mm$^2$] | $S_B$ [mm$^2$] | $L_1$ | $L_2$ | Cleaning capability |
|---|---|---|---|---|---|---|
| Configuration 1 | 0.23 | 6.3 | 16.3 | 0.30 | 0.20 | Excellent |
| Configuration 2 | 0.25 | 6.3 | 16.3 | 0.30 | 0.23 | Excellent |
| Configuration 3 | 0.26 | 6.3 | 16.3 | 0.30 | 0.25 | Good |
| Configuration 4 | 0.28 | 6.3 | 12.5 | 0.25 | 0.30 | Good |
| Configuration 5 | 0.30 | 10.0 | 10.0 | 0.30 | 0.30 | Good |
| Configuration 6 | 0.33 | 10.0 | 10.0 | 0.20 | 0.45 | Acceptable |
| Configuration 7 | 0.35 | 10.0 | 10.0 | 0.20 | 0.50 | Acceptable |
| Comparative example 1 | 0.33 | 10.0 | 6.3 | 0.20 | 0.55 | Poor |
| Comparative example 2 | 0.35 | 10.0 | 6.3 | 0.20 | 0.58 | Poor |
| Comparative example 3 | 0.35 | 10.0 | 6.3 | 0.20 | 0.60 | Poor |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 7 and Comparative examples 1 through 3 listed in Table 12.

In each of the cold environment (10° C.), the ordinary temperature environment (23° C.), and the hot environment (32° C.), images were successively output on 20,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 20,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 20,000 sheets. There is no practical disadvantage.

Acceptable: In each of the three environments, no trace of defective cleaning is observed on the sheets after output of 20,000 sheets. Although there is no practical disadvantage, in one of the three environments, toner escaping the cleaning blade on the photoconductor 10 was observed.

Poor: In one of the three environments, the trace of defective cleaning was observed on the sheets after output of 20,000 sheets. In practice, the outputs images were substandard.

[Evaluation Results]

Configuration 1

The cross-sectional area $S_A$ of the edge region 206 is 6.3 mm$^2$, and the cross-sectional area $S_B$ of the adjacent region 207 is 16.3 mm$^2$. The tan δ variation $L_1$ of the edge region 206 is 0.30. The tan δ variation $L_2$ of the adjacent region 207 is 0.20. The converted tan δ (X) calculated from Formula 4 is 0.23.

The converted tan δ (X) of this configuration is within the range of from 0.23 to 0.51. The tan δ variation $L_2$ of the adjacent region 207 is 0.20 in the temperature range of from 0° C. to 50° C., which is within the range of from 0.2 to 0.5.

With these features, cleaning capability was rated as excellent in any of the cold environment (10° C.), the ordinary temperature environment (23° C.), and the hot environment (32° C.) even in the cleaning capability evaluation in which 20,000 sheets were output. That is, defective cleaning did not occur.

According to these results, the tan δ of the adjacent region 207 was not excessively varied by environmental change (temperature change). Additionally, in the hot environment or the cold environment, vibration of the adjacent region 207 as well as fatigue caused by permanent deformation of the adjacent region 207 was not generated.

Configurations 2 Through 7

Similar to Configuration 1, the converted tan δ (X) calculated from Formula 4 is within the range of from 0.23 to 0.51.

The tan δ variation $L_2$ of the adjacent region 207 is within the range of from 0.2 to 0.5 in the temperature range of from 0° C. to 50° C.

With these features, cleaning capability was rated as excellent, good, or acceptable in any of the cold environment (10° C.), the ordinary temperature environment (23° C.), and the hot environment (32° C.). No trace of defective cleaning was observed on transfer paper, and defective cleaning did not occur.

Similar to Configuration 1, according to these results, the tan δ of the adjacent region 207 was not excessively varied by environmental change (temperature change). Additionally, in the hot environment or the cold environment, vibration of the adjacent region 207 as well as fatigue caused by permanent deformation of the adjacent region 207 was not generated.

Comparative Examples 1 Through 3

Unlike Configurations 1 through 7, the tan δ variation $L_2$ of the adjacent region 207 was greater than 0.50 in the temperature range of from 0° C. to 50° C. Cleaning capability was rated as poor in the hot or cold environment. That is, defective cleaning was obvious on transfer paper (image).

According to these results, the tan δ of the adjacent region 207 was extremely varied by environmental change (temperature change). Additionally, in the hot environment or the cold environment, vibration of the adjacent region 207 as well as fatigue caused by permanent deformation of the adjacent region 207 occurred.

The above verification results confirm that the above effects are attained in the configurations in which the converted tan δ (X) defined by Formula 4 is 0.23 or greater and 0.51 or smaller and the tan δ variation $L_2$ of the adjacent region 207 is 0.2 or greater and 0.5 or smaller in the temperature range of from 0° C. to 50° C.

That is, the structure according to present embodiment is advantageous in suppressing toner void caused by vibration of the adjacent region 207 and fatigue caused by permanent deformation of the adjacent region 207.

Embodiment 3-4

Embodiment 3-4 of the cleaning blade 5, usable in the cleaning device 1 according to the third embodiment, is described below.

The cleaning blade 5 according to Embodiment 3-4 is different from the cleaning blades according to Embodiments 3-1 through 3-3 only in that more preferable ranges of the converted tan δ (X), the tan δ variation $L_1$ of the edge region 206, and the tan δ variation $L_2$ of the adjacent region 207 are specified.

Therefore, descriptions of structures similar to Embodiments 3-1 through 3-3, and action and effects thereof are omitted appropriately. Unless it is necessary to particularly distinguish, the same reference characters are given to the same or similar elements in descriptions below.

The structures of Embodiments 3-1 through 3-3 can suppress vibration due to environmental change (temperature change) to cause defective cleaning or generation of fatigue. In none of the configurations of Embodiments 3-1 through 3-3, defective cleaning is obvious on transfer paper, and there was no practical disadvantage according to the verification results described above.

However, according to the verification results, in some of Configurations of Embodiments 1-1 through 1-3, cleaning capability was rated as acceptable. That is, in some of the configurations, toner escaping the cleaning blade 5 was observed with eyes on the photoconductor 10.

As described above, when the toner escaping the cleaning blade 5 is visible on the photoconductor 10, defective cleaning is expected to degrade images over time when evaluation is made in a longer period of test. That is, there is a risk that preferable cleaning capability is not maintained when the cleaning blades 5 according to Embodiments 3-1 through 3-3 are used for a long time in an environment in which temperature changes drastically.

Therefore, in the cleaning blade 5 according to Embodiment 3-4, the ranges of the converted tan δ (X), the tan δ variation $L_1$ of the edge region 206, and the tan δ variation $L_2$ of the adjacent region 207 are specified as follows in the temperature range of from 0° C. to 50° C.

In the temperature range of from 0° C. to 50° C., the converted tan δ (X) defined by Formula 4 is 0.23 or greater and 0.35 or smaller, the tan δ variation $L_1$ of the edge region 206 is 0.3 or greater and 0.5 or smaller, and the tan δ variation $L_2$ of the adjacent region 207 is 0.2 or greater and 0.3 or smaller.

By such a structure, the tan δ of the entire cleaning blade 5 is more suitably inhibited from fluctuating significantly depending on changes in the environment (temperature in particular). In addition, such a structure more suitably suppresses vibration and chipping of the edge 61 caused by the change of the edge region 206 inherent to environmental changes, fatigue caused by permanent deformation of the edge region 206, toner void due to vibration of the adjacent region 207, and fatigue caused by permanent deformation of the adjacent region 207, which arise when the environmental changes.

With these features, the amount of toner escaping the cleaning blade 5 and remaining on the photoconductor 10 does not increase to a degree visible with eyes.

Therefore, even when the cleaning blade 5 is used for a long time in the environment in which temperature changes drastically, preferable cleaning capability can be maintained.

Here, among configurations according to Embodiments 3-1 through 3-3, each configuration satisfying the above-mentioned preferable ranges is rated as excellent or good regarding cleaning capability. That is, in evaluation of cleaning capability, toner that has escaped the cleaning blade 5 is not visible on the photoconductor 10.

This indicates that the structure according to Embodiment 3-4 maintains cleaning capability more stably even when the number of output sheets are greater than the number of sheets (10, 000 sheets) output in the verification experiment in Embodiment 3-1 or the number of sheets (20,000 sheets) output in the verification experiment in Embodiments 3-2 and 3-3.

That is, also from the verification results regarding Embodiments 3-1 through 3-3, it is known that the cleaning blade 5 according to Embodiment 3-4 maintains preferable cleaning capability in the environment in which temperature changes drastically.

Although Embodiments 3-1 through 3-4 concern the bilayer structure illustrated in FIGS. 12A and 13A, similar effects are attained by other types of two-region blades.

Embodiment 3-5

The cleaning blade 5 according to Embodiment 3-5, usable in the cleaning device 1 according to the third embodiment, is described with reference to the drawings.

Figure 15:
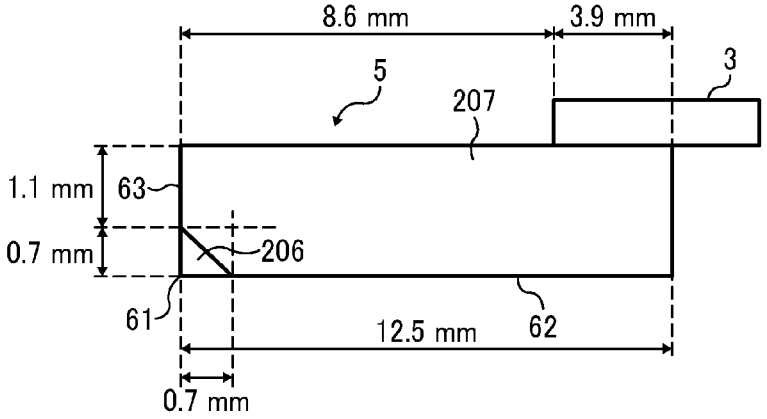
FIG. 15 is a schematic cross-sectional view, with dimension, of a blade type used in a verification experiment of Embodiment 3-5 of the third embodiment.
Figure 16A:
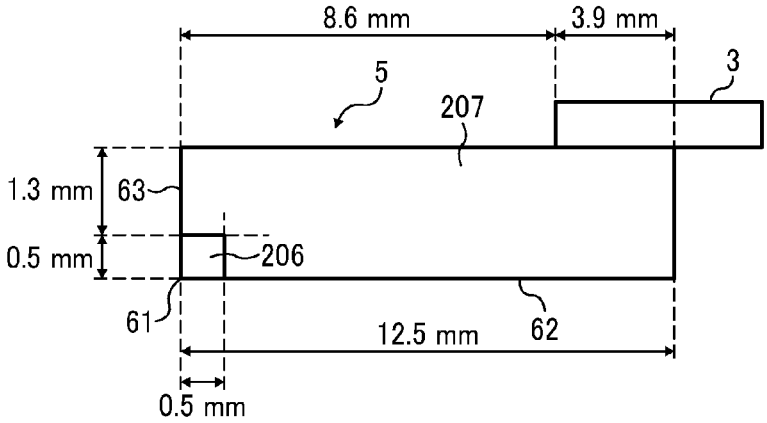
FIGS. 16A and 16B are schematic cross-sectional views, with dimensions, of other blade types used in the verification experiment of Embodiment 3-5 of the third embodiment.
Figure 16B:
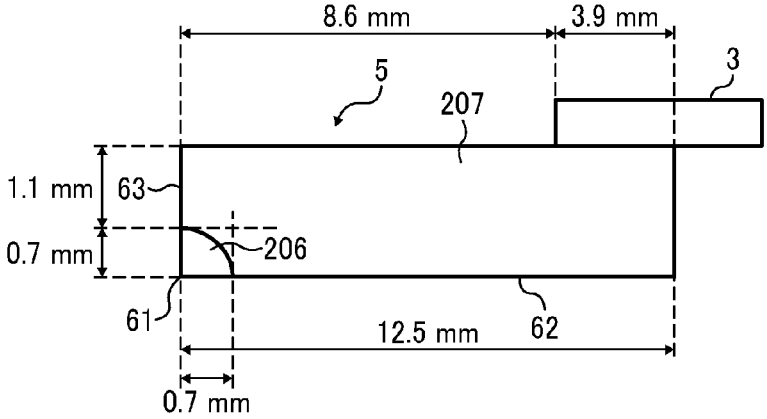

FIG. 15 illustrates an example dimension of the blade shape illustrated in FIG. 12B (hereinafter "blade type B"). FIGS. 16A and 16B illustrate example dimensions of the blade shape illustrated in FIG. 12C (hereinafter "blade types C1 and C2").

Specifically, FIG. 16A illustrates an example of the blade type C1 in which the L-shaped boundary divides the edge region 206 from the adjacent region 207 as illustrated in FIG. 12C. By contrast, FIG. 16B illustrates an example of the blade type C2 in which the boundary between the edge region 206 and the adjacent region 207 is arc-shaped (the edge region 206 is fan-shaped).

Figure 17:
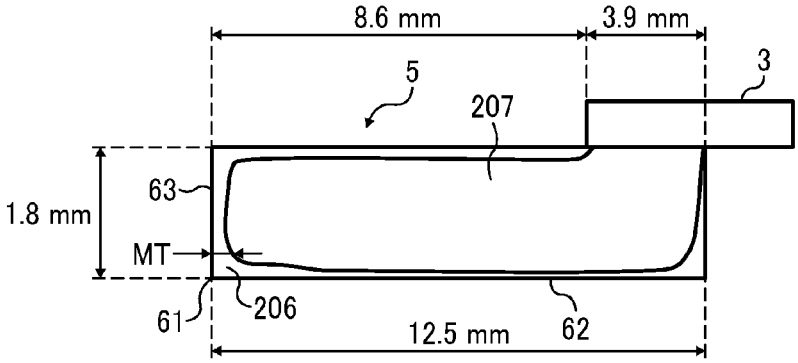
FIG. 17 is a schematic cross-sectional view, with dimension, of another blade type used in the verification experiment of Embodiment 3-5 of the third embodiment.
Figure 18:
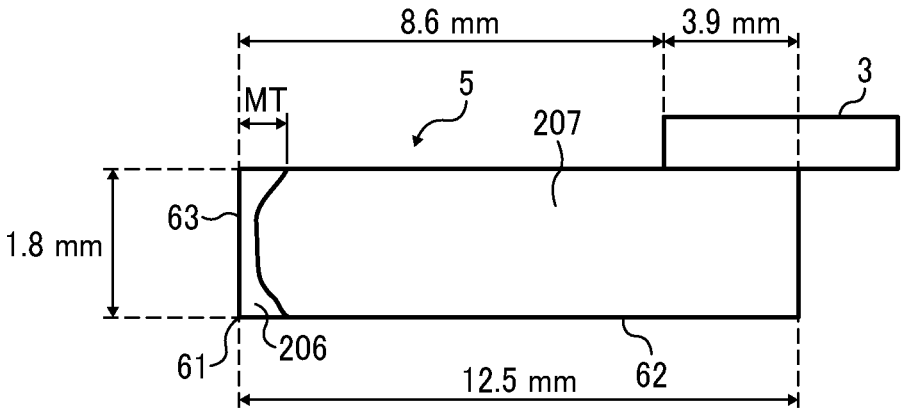
FIG. 18 is a schematic cross-sectional view, with dimension, of another blade type used in the verification experiment of Embodiment 3-5 of the third embodiment.
Figure 19:
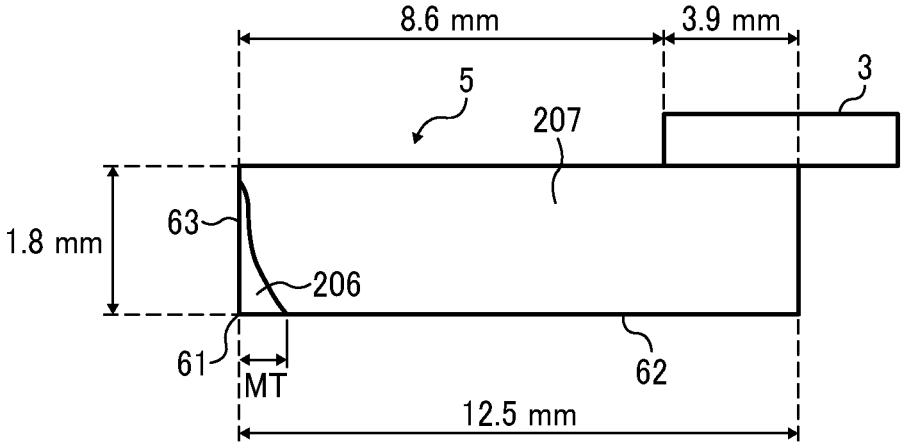
FIG. 19 is a schematic cross-sectional view, with dimension, of another blade type used in the verification experiment of Embodiment 3-5 of the third embodiment.
Figure 20:
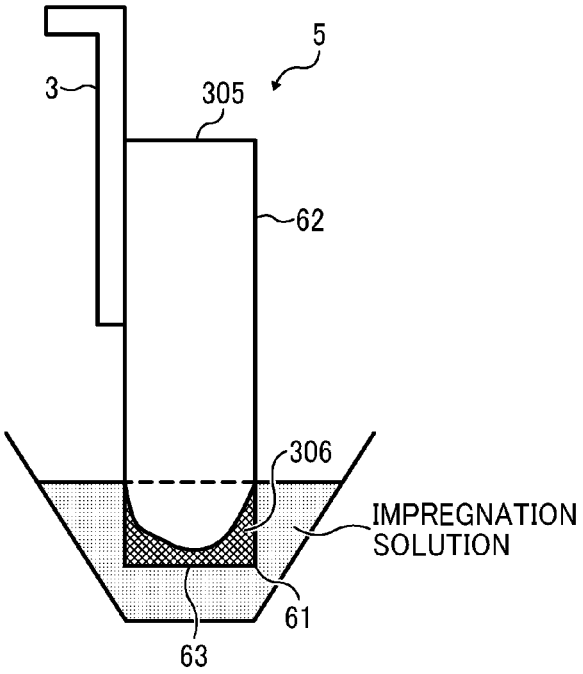
FIG. 20 illustrates a method of impregnation to produce the blade type illustrated in FIG. 18.
Figure 21:
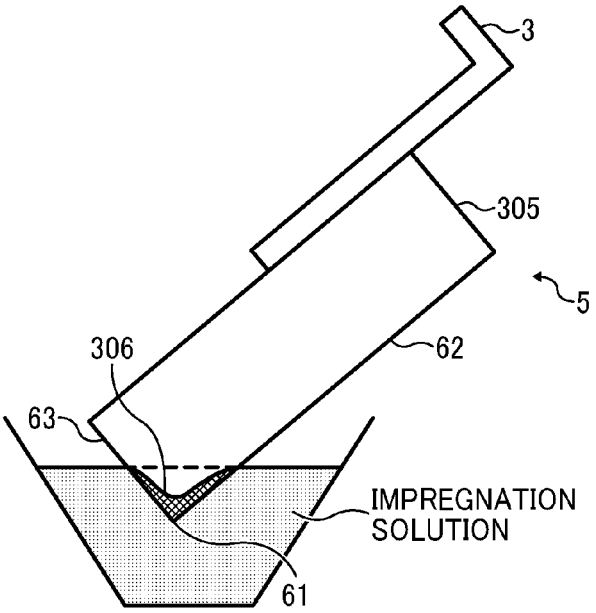
FIG. 21 illustrates a method of impregnation to produce the blade type illustrated in FIG. 19.

FIG. 17 illustrates an example dimension of the blade shape illustrated in FIG. 12D (hereinafter "blade type D"). FIG. 18 illustrates an example dimension of the blade shape illustrated in FIG. 12E (hereinafter "blade type E"). FIG. 19 illustrates an example dimension of the blade shape illustrated in FIG. 12F (hereinafter "blade type F"). The examples illustrated in FIGS. 15 through 19 were used in the verification experiment described below. FIG. 20 illustrates a method of impregnation to produce the blade type E. FIG. 21 illustrates a method of impregnation to produce the blade type F.

Embodiment 3-5 concerns the relations between cleaning capability and the converted tan δ (X), the tan δ variation $L_1$ of the edge region 206, and the tan δ variation $L_2$ of the adjacent region 207 in the blade types B through F illustrated in FIGS. 12B through 12F, which are not described in Embodiments 3-1 through 3-4.

Accordingly, descriptions about configurations, operation, action, and effects of the present embodiment similar to those of Embodiment 3-1 through 3-4 are omitted.

In each of the blade types B through F, cleaning capability was evaluated while changing the tan δ variation $L_1$ of the edge region 206 and the tan δ variation $L_2$ of the adjacent region 207.

Regarding each blade type used in the verification experiment, the dimension of the cleaning blade 5 is identical and three different combinations of the tan δ variation $L_1$ of the edge region 206 and the tan δ variation $L_2$ of the adjacent region 207 are used. For example, in the case of blade type B, there are first, second, and third combinations B-1, B-2, and B-3. In the first combination B-1, the tan δ variation $L_1$ of the edge region 206 is 0.40, and the tan δ variation $L_2$ of the adjacent region 207 is 0.20. In the second combination B-2, the tan δ variation $L_1$ of the edge region 206 is 0.80, and the tan δ variation $L_2$ of the adjacent region 207 is 0.35. In the third combination B-3, the tan δ variation $L_1$ of the edge region 206 is 1.00, and the tan δ variation $L_2$ of the adjacent region 207 is 0.40.

The example dimension of each blade type used in the experiment is described below.

In the blade type B, as illustrated in FIG. 15, the boundary between the edge region 206 and the adjacent region 207 is a straight line starting at 0.7 mm from the edge 61 on the end face 63 and ending at 0.7 from the edge 61 on the outer face 62. The length D of the cleaning blade 5 is 12.5 mm, and the thickness is 1.8 (0.7+1.1) mm.

In the blade type C1, as illustrated in FIG. 16A, the boundary between the edge region 206 and the adjacent region 207 is L-shaped made of a first perpendicular starting at 0.5 mm from the edge 61 on the end face 63 and a second perpendicular starting at 0.5 from the edge 61 on the outer face 62 to cross the first perpendicular. The length D of the cleaning blade 5 is 12.5 mm, and the thickness is 1.8 (0.5+1.3) mm.

In the blade type C1, as illustrated in FIG. 16B, the boundary between the edge region 206 and the adjacent region 207 is an arc having a radius of 0.7 mm from the edge 61. The length D of the cleaning blade 5 is 12.5 mm, and the thickness is 1.8 (0.7+1.1) mm.

In the blade type D, as illustrated in FIG. 17, the boundary of the edge region 206 surrounds the circumference of the adjacent region 207 except the contact portion of the adjacent region 207 with the support 3. Reference character MT in FIG. 17 represents a thickest portion of the edge region 206, which is 200 μm in thickness, and the edge region 206 is produced by impregnation. The length D of the cleaning blade 5 is 12.5 mm, the thickness is 1.8 mm, and the cross-sectional area $S_A$ of the edge region 206 is about 49 $mm^2$.

In the blade type E, as illustrated in FIG. 18, the edge region 206 is produced by impregnating the adjacent region 207, from the end side (adjacent to the end face 63), with an impregnation solution such that the edge region 206 entirely covers the end side of the adjacent region 207. The thickest portion MT of the edge region 206 is 200 μm in thickness. The length D of the cleaning blade 5 is 12.5 mm, the thickness is 1.8 mm, and the cross-sectional area $S_A$ of the edge region 206 is about 36 $mm^2$.

In the blade type F, as illustrated in FIG. 19, the edge region 206 is produced by impregnating the adjacent region 207, from the edge 61, with an impregnation solution such that the edge region 206 partly covers each of the end face 63 and the outer face 62. The thickest portion MT of the edge region 206 is 200 μm in thickness. The length D of the cleaning blade 5 is 12.5 mm, the thickness is 1.8 mm, and the cross-sectional area $S_A$ of the edge region 206 is about 18 $mm^2$.

Table 13 below includes the converted tan δ (X), the tan δ variation $L_1$ of the edge region 206, the tan δ variation $L_2$ of the adjacent region 207, and the evaluation results of cleaning capability of each blade type used in the experiment.

TABLE 13

| | X | $S_A$ [$mm^2$] | $S_B$ [$mm^2$] | $L_1$ | $L_2$ | Cleaning capability |
|---|---|---|---|---|---|---|
| B-1 | 0.20 | 0.25 | 22.3 | 0.40 | 0.20 | Excellent |
| B-2 | 0.35 | 0.25 | 22.3 | 0.80 | 0.35 | Good |
| B-3 | 0.41 | 0.25 | 22.3 | 1.00 | 0.40 | Acceptable |
| C1-1 | 0.30 | 0.25 | 22.3 | 0.40 | 0.20 | Good |
| C1-2 | 0.36 | 0.25 | 22.3 | 0.80 | 0.35 | Good |
| C1-3 | 0.41 | 0.25 | 22.3 | 1.00 | 0.40 | Acceptable |
| C2-1 | 0.20 | 0.38 | 22.1 | 0.40 | 0.20 | Excellent |
| C2-2 | 0.36 | 0.38 | 22.1 | 0.80 | 0.35 | Good |
| C2-3 | 0.41 | 0.38 | 22.1 | 1.00 | 0.40 | Acceptable |
| D-1 | 0.24 | 4.90 | 17.6 | 0.40 | 0.20 | Excellent |
| D-2 | 0.45 | 4.90 | 17.6 | 0.80 | 0.35 | Acceptable |
| D-3 | 0.53 | 4.90 | 17.6 | 1.00 | 0.40 | Poor |
| E-1 | 0.20 | 0.36 | 22.1 | 0.40 | 0.20 | Excellent |
| E-2 | 0.36 | 0.36 | 22.1 | 0.80 | 0.35 | Good |
| E-3 | 0.41 | 0.36 | 22.1 | 1.00 | 0.40 | Acceptable |
| F-1 | 0.20 | 0.18 | 22.3 | 0.40 | 0.20 | Excellent |
| F-2 | 0.35 | 0.18 | 22.3 | 0.80 | 0.35 | Good |
| F-3 | 0.35 | 0.18 | 22.3 | 1.00 | 0.40 | Good |

[Evaluation Method]

Cleaning capability was evaluated under the conditions similar to those of Embodiment 3-1.

[Evaluation Results]

Blade Type B

An aim of the blade type B is to reduce the area of the edge region 206 compared with the bilayer blade illustrated in FIG. 12A.

For example, compared with Configuration 14 in Table 10, in the combination B-3 of the blade type B, the ratio of the cross-sectional area $S_A$ of the edge region 206 to the cross-sectional area ($S_A$ and $S_B$) of the entire cleaning blade 5 is smaller. Accordingly, even in the combination in which the tan δ variation $L_1$ of the edge region 206 is 1.00, which is greatest in the three combinations, the cleaning capability evaluation is acceptable, similar to Configuration 14 in Table 10.

As another example, compared with Configuration 13 in Table 10, in the combination B-2 of the blade type B, the ratio of the cross-sectional area $S_A$ of the edge region 206 is small although the tan δ variation $L_1$ of the edge region 206 and the tan δ variation $L_2$ of the adjacent region 207 are respectively identical to those of Configuration 13 in Table 10. Accordingly, the cleaning capability evaluation is better than that of Configuration 13.

Blade Types C1 and C2

An aim of the blade types C1 and C2 is to reduce the cross-sectional area of the edge region 206 compared with the bilayer blade illustrated in FIG. 12A.

Compared with Configuration 13 in Table 10, in the combination C1-2 of the blade type C1 and the combination C2-2 of the blade type C2, the cross-sectional area $S_A$ of the edge region 206 is small. Accordingly, although the tan δ variation $L_1$ of the edge region 206 and the tan δ variation $L_2$ of the adjacent region 207 are respectively identical to those of Configuration 13, the cleaning capability evaluation is better than that of Configuration 13. Although the cleaning capability evaluation of Configuration 13 is "good, the cleaning capability evaluations of the combination C1-2 and the combination C2-2 are improved to "good".

Blade Types D, E, and F

In the blade types D, E, and F, the edge region and the adjacent region 207 are produced by impregnating a part of a single-layer urethane rubber blade. Accordingly, the tan δ variation $L_1$ of the edge region 206, Martens hardness, and the like are adjustable with the combination of the impregnation solution, processing time, and the type of single-layer urethane rubber blade.

As described above, the blade type D is produced by impregnating the surface of the blade, except the contact portion with the support 3, to attain a deepest impregnation depth (thickest portion) of 200 μm. The edge region 206 is 4.9 $mm_2$ at the maximum.

In the blade types E and F, an impregnated region is provided partially to reduce the cross-sectional area $S_A$ of the edge region 206 relative to the entire blade. When the blade types D, E, and F are compared with each other, in the combination in which the tan δ variation $L_1$ of the edge region 206 is 1.00 (D-3, E-3, and F-3), the blade type F, having a smallest impregnated region, is better in cleaning capability evaluation (good) than the blade types D and E. Additionally, the blade types E and F attain better evaluation (good) of cleaning capability than Configuration 13 in Table 10 (acceptable).

The above verification results confirm that, similar to the bilayer blades, the above effects are attained by setting the converted tan δ (X) defined by Formula 4 to 0.23 or greater and 0.51 or smaller in the temperature range of from 0° C. to 50° C. even in the blade types B through F.

That is, it has confirmed that the structure according to present embodiment is advantageous in suppressing toner void caused by vibration of the adjacent region 207 of the two-region blade and fatigue caused by permanent deformation of the adjacent region 207.

Next, descriptions are given below of impregnation of blades.

FIG. 20 illustrates one method of impregnation, and FIG. 21 illustrates another method of impregnation.

The edge 61 of the cleaning blade 5 can be treated as follows to enhance the strength of the elastic material used in the cleaning blade 5. For example, a single layer blade member 305 made of urethane rubber is impregnated with an impregnation solution, such as acrylic resin or isocyanate resin, to form an impregnated region 306. Alternatively, a part of the impregnated region 306 or the entire impregnated region 306 is coated to form a surface layer.

For example, as illustrated in FIG. 20, impregnation treatment includes dipping, in an impregnation solution, the blade member 305 of the cleaning blade 5 at an angle perpendicular to the liquid surface of the impregnation solution. Examples of the impregnation method include brush coating, spray coating, and dip coating in addition to dipping. The impregnated region 306 having an enhanced strength of the elastic material is present in the edge 61, the outer face 62 and the end face 63, which are adjacent to each other via the edge 61 and facing the photoconductor 10, and a back face that is on the back of the outer face 62 and does not face the photoconductor 10.

The cleaning blade 5 subjected to such an impregnation treatment is the blade type E of the cleaning blade 5 illustrated in FIGS. 12E and 18.

Another impregnation method includes dipping, in an impregnation solution, the single-layer blade member 305 obliquely to the liquid surface of the impregnation solution as illustrated in FIG. 21. In such an impregnation treatment, the impregnated region 306 is formed in the edge 61, a part of the outer face 62, and a part of the end face 63, but the face on the back of the outer face 62 is not impregnated.

The cleaning blade 5 subjected to such an impregnation treatment is the blade type F illustrated in FIGS. 12F and 19.

An ultraviolet curable resin used for impregnation preferably has a Martens hardness of 250 to 500 $N/mm^2$ and an elastic power of 75% or smaller and, more preferably, an elastic power of 50% to 75%. Here, the Martens hardness and the elastic power of the ultraviolet curable resin to be impregnated mentioned here, were obtained by measuring those of the resin applied onto a glass substrate to have a thickness of 5 to 10 μm. With these characteristics, the edge 61, which is a tip ridgeline of the cleaning blade 5 abutting on the photoconductor 10 in FIG. 2, is inhibited from deforming in the direction of rotation of the photoconductor 10. In addition, even when the surface layer is abraded over time to expose the inner part, such deformation is inhibited similarly by impregnating the inner part.

The Martens hardness of the ultraviolet curable resin used for the cleaning blade 5 according to the present was measured using a micro hardness meter HM-2000 manufactured by Fischer Instruments K.K. Specifically, measurement procedure is as follows. Apply an ultraviolet curable resin onto a glass plate to obtain a layer thickness of 20 μm. Push a Vicker's penetrator in the ultraviolet curable resin with a load of 9.8 mN for 30 seconds, keep this state for five seconds, and remove the Vicker's penetrator with a load of 9.8 mN in 30 seconds. Then, measure the hardness. The elastic power is a characteristic value determined from an integrated stress at the time of the measurement of the Martens hardness in a manner described below. When the integrated stress at the time of pressing the Vicker's penetrator is referred to as $W_{plast}$ and the integrated stress at the time of removing the test load is referred to as $W_{elast}$, the elastic power is a characteristic value defined as $W_{elast}/W_{plast} \times 100\%$. As the elastic power increases, hysteresis loss (plastic deformation) decreases, that is, elasticity increases. A too low elastic power means that the material is closer to glass than rubber.

The Martens hardness of the vicinity of the edge 61 (tip ridgeline) is the Martens hardness of the cleaning blade 5 impregnated with the ultraviolet curable resin and is different from the Martens hardness of the ultraviolet curable resin described above.

The ultraviolet curable resin used for impregnation preferably has a high hardness and a high elasticity. Preferable examples include acrylate and methacrylate having a tricyclodecane or adamantane skeleton. The capability to remove toner is improved remarkably, abrasion of the leaning blade is reduced, and excellent cleaning performance can be maintained for a long time. Additionally, a friction coefficient between the cleaning blade and the photoconductor is reduced, the amount of abrasion of the photoconductor is reduced, and operational lives of the photoconductor and the image forming apparatus can be extended. In addition, since the cleaning blade does not rub the additives or the like of toner against the surface of the photoconductor, image failure such as white voids is not generated.

Acrylate or methacrylate having a tricyclodecane or adamantane skeleton is preferable because a peculiar structure of the tricyclodecane or adamantane skeleton can compensate for shortage of crosslinking points even when the amount of functional groups of acrylate or methacrylate is small. Examples of acrylate or methacrylate having a tricyclodecane or adamantane skeleton include tricyclodecane dimethanol diacrylate, 1,3-adamantane dimethanol diacrylate, 1,3-adamantane dimethanol dimethacrylate, 1,3,5-adamantane trimethanol triacrylate, and 1,3,5-adamantane trimethanol trimethacrylate. These compounds may be used in combination.

The number of functional groups of the acrylate or the methacrylate having tricyclodecane or an adamantane skeleton is preferably from 1 to 6, and, more preferably, from 2 to 4. When the number of functional groups is only one, a cross-linked structure is weak. When the number of functional groups is five or greater, steric hindrance may occur. Therefore, acrylates or methacrylates having different numbers of functional groups are preferably mixed. The molecular weight of the acrylate or the methacrylate having tricyclodecane or an adamantane skeleton is preferably 500 or smaller. When the molecular weight is 500 or greater, a molecular size is large. Therefore, a cleaning blade is not easily impregnated with resin to attain a high hardness.

An acrylate monomer having a molecular weight of 100 to 1500 may be mixed in the impregnation solution to impregnate the cleaning blade 5 with an ultraviolet curable resin through brush coating, spray coating, dip coating, or the like. Examples of the acrylate monomer include dipentaerythritol hexaacrylate, pentaerythritol tetraacrylate, pentaerythritol triacrylate, pentaerythritol ethoxytetraacrylate, trimethylolpropane triacrylate, trimethylolpropane ethoxytriacrylate, 1,6-hexanediol diacrylate, ethoxylated bisphenol A diacrylate, propoxylated ethoxylated bisphenol A diacrylate, 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate, 1,18-octadecanediol diacrylate, glycerol propoxy triacrylate, dipropylene glycol diacrylate, tripropylene glycol diacrylate, PO-modified neopentyl glycol diacrylate, PEG 600 diacrylate, PEG 400 diacrylate, PEG 200 diacrylate, neopentyl glycol-hydroxypivalate diacrylate, octyl/decyl acrylate, isobornyl acrylate, ethoxylated phenyl acrylate, and 9,9-bis[4-(2-acryloyloxyethoxy)phenyl]fluorene. These compounds may be used singly or in combination.

It is preferable that a diluent for the impregnation solution can dissolve the ultraviolet curable resin and has a low boiling point. In particularly, the boiling point is preferably 160° C. or lower, and more preferably, 100° C. or lower. Examples of usable diluent include hydrocarbon solvents such as toluene and xylene; ester solvents such as ethyl acetate, n-butyl acetate, methyl cellosolve acetate, and propylene glycol monomethyl ether acetate; ketone solvents such as methyl ethyl ketone, methyl isobutyl ketone, diisobutyl ketone, cyclohexanone, and cyclopentanone; ether solvents such as ethylene glycol monomethyl ether, ethylene glycol monoethyl ether, and propylene glycol monomethyl ether; and alcohol organic solvents such as ethanol, propanol, 1-butanol, isopropyl alcohol, and isobutyl alcohol.

The above-mentioned examples of diluent accelerate impregnation at the time of coating, but may deteriorate physical properties to degrade the abrasion resistance. For example, the solvent remains inside the rubber to swell the rubber, and the thickness of the rubber does not return to the original. There is a risk that, if the rubber is heated and dried to remove the remaining solvent, physical properties of the rubber may change to degrade cleaning capability. Therefore, it is preferable to lower the temperature of heating and drying, or perform vacuum drying or the like in place of heating and drying. This can reduce the concentration of the remaining solvent.

Next, example impregnation solutions are described.

<Impregnation Solution 1>

Ultraviolet curable resin: 50 parts of X-DA manufactured by Idemitsu Kosan Co., Ltd. having two functional groups Polymerization initiator: 5 parts of Irgacure 184 manufactured by Ciba Specialty Chemicals Inc.

Solvent: 55 parts of cyclohexanone

<Impregnation Solution 2>

Ultraviolet curable resin: 50 parts of A-DCP manufactured by Shin-Nakamura Chemical Co., Ltd., having two functional groups Polymerization initiator: 5 parts of Irgacure 184 manufactured by Ciba Specialty Chemicals Inc.

Solvent: 55 parts of cyclohexanone

<Impregnation Solution 3>

Ultraviolet curable resin: 50 parts of X-A-201 manufactured by Idemitsu Kosan Co., Ltd., having two functional groups Polymerization initiator: 5 parts of Irgacure 184 manufactured by Ciba Specialty Chemicals Inc.

Solvent: 55 parts of cyclohexanone

<Impregnation Solution 4>

Ultraviolet curable resin: 50 parts of ADTM manufactured by Mitsubishi Gas Chemical Company, Inc., having three functional groups Polymerization initiator: 5 parts of Irgacure 184 manufactured by Ciba Specialty Chemicals Inc.

Solvent: 55 parts of cyclohexanone

<Impregnation Solution 5>

Ultraviolet curable resin 1: 25 parts of A-DCP manufactured by Shin-Nakamura Chemical Co., Ltd. having two functional groups Ultraviolet curable resin 2: 25 parts of PETIA manufactured by Daicel-Cytec Co., Ltd. having three functional groups Polymerization initiator: 5 parts of Irgacure 184 manufactured by Ciba Specialty Chemicals Inc.

Solvent: 55 parts of cyclohexanone

<Impregnation Solution 6>

Ultraviolet curable resin 1: 25 parts of X-A-201 manufactured by Idemitsu Kosan Co., Ltd. having two functional groups Ultraviolet curable resin 2: 25 parts of PETIA manufactured by Daicel-Cytec Co., Ltd. having three functional groups Polymerization initiator: 5 parts of Irgacure 184 manufactured by Ciba Specialty Chemicals Inc.

Solvent: 55 parts of cyclohexanone

<Impregnation Solution 7>

Ultraviolet curable resin: 50 parts of PETIA manufactured by Daicel-Cytec Co., Ltd., having three functional groups Polymerization initiator: 5 parts of Irgacure 184 manufactured by Ciba Specialty Chemicals Inc.

Solvent: 55 parts of cyclohexanone

<Impregnation Solution 8>

Ultraviolet curable resin: 50 parts of DPHA manufactured by Daicel-Cytec Co., Ltd., having six functional groups Polymerization initiator: 5 parts of Irgacure 184 manufactured by Ciba Specialty Chemicals Inc.

Solvent: 55 parts of cyclohexanone

In Embodiment 3-6 through 3-9 described below, structures common to the bilayer blade (blade type A) through the blade type F are described.

It is to be noted that, although Embodiment 3-6 through 3-9 are described using the bilayer blade type A, similar effects are available by the blade types B through F.

Embodiment 3-6

Embodiment 3-6 of the cleaning blade 5 usable in the cleaning device 1 according to the third embodiment is described.

The cleaning blade 5 according to Embodiment 3-6 is different from the cleaning blade according to any of Embodiments 3-1 through 3-5 only in the Martens hardness of the edge region 206 is 2 N/mm$^2$ or greater.

Accordingly, descriptions about configurations, operation, action, and effects of the present embodiment similar to those of Embodiment 1-5 are omitted.

In the case of the edge 61 (edge region 206) having a lower hardness, for example, when the edge 61 contacts the surface of the photoconductor 10 as illustrated in FIG. 5B from the state illustrated in FIG. 5A, the nip between the edge 61 and the surface of the photoconductor 10 increases in width. Consequently, the contact pressure decreases. When the contact pressure decreases, toner external additives escaping the edge 61 of the cleaning blade 5 are pressed to the surface of the photoconductor 10, and the possibility of streaky voids in output images and filming on the photoconductor 10 increases.

In view of the foregoing, in the cleaning blade 5 according to the present embodiment, the Martens hardness of the edge region 206 is equal to or greater than 2.0 N/mm$^2$.

The edge region 206 having the Martens hardness of 2.0 N/mm$^2$ or greater is advantageous in suppressing streaky voids and filming, that is, the adhesion of toner external additives to the surface of the photoconductor 10.

In the case of the edge 61 (of the edge region 206) having a higher hardness, such as 2.0 N/mm$^2$ or greater, deformation of the edge 61 upon application of load is smaller as illustrated in FIG. 5C. Then, the area of contact and the nip width are smaller when the cleaning blade 5 is disposed in contact with the surface of the photoconductor 10.

Additionally, since the edge 61 is harder, the amount by which the edge 61 is drawn in by the movement of the photoconductor 10 is smaller, and the vicinity of the edge 61 less easily deforms.

When the nip width is small and the deformation of the vicinity of the edge 61 is small, the edge 61 can stably contact the surface of the photoconductor 10, and the toner external additives are inhibited from adhering to the photoconductor 10. Thus, the occurrence of streaky voids and filming are suppressed. Additionally, since the deformation of the edge 61 is smaller, the load on the edge 61 is smaller. Accordingly, abrasion and chipping of the ridgeline at the end of the cleaning blade 5 are inhibited.

Thus, the occurrence of streaky voids and filming, caused by the toner external additives adhering to the surface of the photoconductor 10, is suppressed.

Next, a verification experiment performed to ascertain effects of the cleaning blade 5 according to the present embodiment is described.

The tan δ of each layer was measured in a manner similar to that described above.

Multiple configurations of the cleaning blade 5 according to the present embodiment and comparative examples, used in the verification experiment, and verification results thereof are indicated in Table 14 below.

TABLE 14

| | X | $S_A$ [mm$^2$] | $S_B$ [mm$^2$] | $L_1$ | $L_2$ | Edge Martens hardness | Streaky voids and filming |
|---|---|---|---|---|---|---|---|
| Configuration 1 | 0.28 | 6.3 | 16.3 | 0.50 | 0.20 | 5.5 | Excellent |
| Configuration 2 | 0.28 | 6.3 | 16.3 | 0.50 | 0.20 | 5.1 | Excellent |
| Configuration 3 | 0.28 | 6.3 | 16.3 | 0.50 | 0.20 | 4.4 | Good |
| Configuration 4 | 0.28 | 6.3 | 16.3 | 0.50 | 0.20 | 4.0 | Good |
| Configuration 5 | 0.28 | 6.3 | 16.3 | 0.50 | 0.20 | 3.6 | Good |
| Configuration 6 | 0.28 | 6.3 | 16.3 | 0.50 | 0.20 | 3.0 | Good |
| Configuration 7 | 0.28 | 6.3 | 16.3 | 0.50 | 0.20 | 2.6 | Good |
| Configuration 8 | 0.28 | 6.3 | 16.3 | 0.50 | 0.20 | 2.0 | Good |
| Comparative example 1 | 0.28 | 6.3 | 16.3 | 0.50 | 0.20 | 1.5 | Acceptable |
| Comparative example 2 | 0.28 | 6.3 | 16.3 | 0.50 | 0.20 | 0.9 | Poor |
| Comparative example 3 | 0.28 | 6.3 | 16.3 | 0.50 | 0.20 | 0.5 | Poor |

[Evaluation Method]

The occurrence of filming was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 8 and Comparative examples 1 through 3 listed in Table 14.

Images were output on 15,000 sheets consecutively under a temperature of 32° C. and a humidity of 54%. An image having an image area ratio of 5% was output on A4-size sheets.

The cleaning capability was evaluated in the following manner and rated in four grades of "Excellent", "Good", "Acceptable", and "Poor".

Excellent: The trace of filming on the output images is not observed with eyes, and image failure is not recognized. The toner external additives adhering to the photoconductor 10 are hardly observed.

Good: No trace of filming is observed with eyes on the output images, and image failure is not recognized. On the photoconductor 10, a small amount of toner external additives adhering thereto is observed.

Acceptable: No trace of filming is observed on the output images with eyes, and image failure is not recognized. However, adhesion of toner external additives to the photoconductor 10 is noticeable.

Poor: The trace of filming on the output images is observed with eyes, and the image is degraded.

The Martens hardness and the elastic power of the edge region 206 are measured as described below.

The Martens hardness and the elastic power of the edge region 206 mentioned above were obtained using a micro hardness measuring system, FISCHERSCOPE® HM2000, from Fischer Technology, Inc.

Push a Vickers penetrator in the cleaning blade 5 at 20 μm from the edge 61 (ridgeline at the end), with a strength of 1.0 mN for 10 seconds, keep that state for 5 seconds, and gradually draws out the Vickers penetrator in 10 seconds. Then, measure the Martens hardness. Martens hardness is calculated concurrently with measurement of elastic power.

The elastic power is a characteristic value defined as $W_{elast}/W_{plast}\times100\%$, wherein $W_{plast}$ represents the cumulative stress caused while the Vickers penetrator is pushed in, and $W_{elast}$ represents cumulative stress caused in removal of the test load (see FIG. 6).

As the elastic power increases, the rate of plastic power in the period from application of force to distort the material to remove the load becomes smaller. That is, the rate of plastic deformation in the deformation of rubber caused by force is smaller.

[Evaluation Results]

Configuration 1

The cross-sectional area $S_A$ of the edge region 206 is 6.3 $mm_2$, and the cross-sectional area $S_B$ of the adjacent region 207 is 16.3 $mm_2$. The tan δ variation $L_1$ of the edge region 206 is 0.50. The tan δ variation $L_2$ of the adjacent region 207 is 0.20. The converted tan δ (X) calculated from Formula 4 is 0.28.

The converted tan δ (X) in this configuration is within the range of from 0.20 to 0.51.

The edge region 206 has a Martens hardness (edge Martens hardness) of 5.5 $N/mm^2$, which is greater than 2.0 $N/mm^2$.

With these features, inhibition of streaky voids and filming in image output on 15,000 sheets was rated as excellent. That is, effects of filming were not observed with eyes on the output image, and image failure was not observed. The toner external additives adhering to the photoconductor 10 are hardly observed.

This indicates that the toner external additives are prevented from adhering to the photoconductor 10 and occurrence of streaky voids and filming is suppressed. In addition, this indicates that the load applied to the edge 61 is reduced, and abrasion or chipping of the cleaning blade 5 is suppressed.

Configurations 2 Through 8

The cross-sectional area $S_A$ of the edge region 206, the cross-sectional area $S_B$ of the adjacent region 207, the tan δ variation $L_1$ of the edge region 206 is 0.50, and the tan δ variation $L_2$ of the adjacent region 207 are similar to those of Configuration 1. The converted tan δ (X) calculated from Formula 4 is 0.28.

The converted tan δ (X) in this configuration is within the range of from 0.20 to 0.51.

The edge region 206 has a Martens hardness of 2.0 $N/mm^2$ or greater in each of Configurations 2 through 8.

With these features, inhibition of streaky voids and filming in image output on 15,000 sheets was rated as excellent or good. That is, effects of filming were not observed with eyes on the output image, and image failure was not observed. The toner external additives adhering to the photoconductor 10 are hardly observed, or the amount is small.

This indicates that the toner external additives are prevented from adhering to the photoconductor 10 and occurrence of streaky voids and filming is suppressed. In addition, this indicates that the load applied to the edge 61 is reduced, and abrasion or chipping of the cleaning blade 5 is suppressed.

Comparative Examples 1 Through 3

The cross-sectional area $S_A$ of the edge region 206, the cross-sectional area $S_B$ of the adjacent region 207, the tan δ variation $L_1$ of the edge region 206 is 0.50, and the tan δ variation $L_2$ of the adjacent region 207 are similar to those of Configuration 1. The converted tan δ (X) calculated from Formula 4 is 0.28.

The converted tan δ (X) in this configuration is within the range of from 0.20 to 0.51.

However, unlike Configurations 1 through 8, the edge region 206 has a Martens hardness (edge Martens hardness) smaller than 2.0 $N/mm^2$.

Inhibition of streaky voids and filming in image output on 15,000 sheets was rated as acceptable or poor. That is, the trace of filming was observed with eyes on the output image, or the amount of toner external additives adhering to the photoconductor 10 was noticeable even though the trace of effects of filming were not observed with eyes on the output image.

This indicates that adhesion of toner external additive to the photoconductor 10 is not fully prevented, and streaky voids and filming are not satisfactorily suppressed in some cases. In addition, this indicates that a greater load is applied to the edge 61 and abrasion or chipping of the cleaning blade 5 are not suppressed.

The above verification results confirm that the above effects are attained in the configuration in which the converted tan δ (X) defined by Formula 4 is 0.23 or greater and 0.51 or smaller and the Martens hardness of the edge region 206 is 2.0 $N/mm^2$ or greater in the temperature range of from 0° C. to 50° C.

That is, the verification results confirm that the structure according to the present embodiment can suppress the occurrence of streaky voids and filming. The verification results further confirm that, when the amount of deformation of the edge 61 is small, the load applied to the edge 61 is smaller, and abrasion and chipping of the cleaning blade 5 are suppressed.

Thus, streaky voids and filming, caused by the toner external additives adhering to the surface of the photoconductor 10, are suppressed.

Embodiment 3-7

Embodiment 3-7 of the cleaning blade 5 usable in the cleaning device 1 according to the third embodiment is described.

The cleaning blade 5 according to Embodiment 3-7 is different from that according to Embodiment 3-6 only in that Embodiment 3-7 specifies a more preferable relation between the cross-sectional area $S_A$ of the edge region 206 and the cross-sectional area $S_B$ of the adjacent region 207, and a more preferable relation between the tan δ variation $L_1$ of the edge region 206 and the tan δ variation $L_2$ of the adjacent region 207 in the temperature range of from 0° C. to 50° C.

Therefore, description of a structure similar to Embodiment 3-6, and an action and an effect thereof will be omitted appropriately. Unless it is necessary to distinguish, the same reference characters will be given to the same or similar elements in descriptions below.

In the two-region cleaning blade 5, when the adjacent region 207 is relatively thin and made of a material susceptible to environmental changes, the edge region 206, which is higher in hardness, is dominant in the posture and the behavior of the entire cleaning blade 5. In this case, fatigue of the cleaning blade 5 easily occurs, and the conforming performance is degraded.

That is, the behavior and posture of the entire cleaning blade 5 fluctuate depending on environmental changes, and the cleaning capability becomes lower than a specified capability designed under standard environment (at the ordinary temperature such as 23° C.).

In view of the foregoing, in addition to the structure similar to that according to Embodiment 3-6, in the cleaning blade 5 according to Embodiment 3-7, the cross-sectional area $S_B$ of the adjacent region 207 is greater than the cross-sectional area $S_A$ of the edge region 206 ($S_B>S_A$), and the tan δ variation $L_2$ of the adjacent region 207 is smaller than the tan δ variation $L_1$ of the edge region 206 ($L_2<L_1$) in the temperature range of from 0° C. to 50° C.

With this configuration, the following effects are attained in the two-region cleaning blade 5 including the edge region 206 and the adjacent region 207.

When the cross-sectional area $S_B$ of the adjacent region 207 is greater than the cross-sectional area $S_A$ of the edge region 206, the characteristics of the adjacent region 207 are dominant in the posture and the behavior of the entire cleaning blade 5. In addition, when the adjacent region 207 is made of a material whose tan δ is less susceptible to environmental changes than the material of the edge region 206 ($L_2<L_1$), the cleaning capability of the cleaning blade 5 is inhibited from decreasing.

That is, the above-described structure suppress fluctuations in behavior and posture of the entire cleaning blade 5 caused by environmental changes, and the cleaning capability is prevented from lowering below the specified capability designed for the standard environment.

Next, a verification experiment performed to ascertain effects of the cleaning blade 5 according to the present embodiment is described.

The tan δ of each layer was measured in a manner similar to that described above.

Multiple configurations of the cleaning blade 5 according to the present embodiment and comparative examples, used in the verification experiment, and verification results thereof are indicated in Table 15 below.

TABLE 15

| | X | $S_A$ [mm$^2$] | $S_B$ [mm$^2$] | $L_1$ | $L_2$ | Edge Martens hardness | Streaky voids and filming | Line pressure difference |
|---|---|---|---|---|---|---|---|---|
| Configuration 1 | 0.23 | 6.3 | 16.3 | 0.30 | 0.20 | 2.0 | Good | Excellent |
| Configuration 2 | 0.27 | 7.5 | 15.0 | 0.40 | 0.20 | 3.2 | Good | Excellent |
| Configuration 3 | 0.32 | 6.3 | 16.3 | 0.50 | 0.25 | 4.1 | Good | Good |
| Configuration 4 | 0.32 | 10.0 | 6.3 | 0.40 | 0.20 | 4.0 | Good | Good |
| Configuration 5 | 0.35 | 8.8 | 15.0 | 0.60 | 0.20 | 5.0 | Excellent | Good |
| Comparative example 1 | 0.32 | 10.0 | 6.3 | 0.20 | 0.50 | 4.5 | Good | Acceptable |
| Comparative example 2 | 0.34 | 6.3 | 16.3 | 0.70 | 0.20 | 5.0 | Excellent | Poor |
| Comparative example 3 | 0.33 | 12.5 | 6.3 | 0.40 | 0.20 | 5.5 | Excellent | Poor |
| Comparative example 4 | 0.34 | 15.0 | 6.3 | 0.40 | 0.20 | 5.5 | Excellent | Poor |

[Evaluation Method]

The occurrence of filming and effects of fatigue on the cleaning capability were evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 5 and Comparative examples 1 through 4 indicated in Table 15.

As changes in line pressure, a contact pressure (line pressure) of the edge 61 (i.e., the blade edge) was measured before and after the cleaning blade 5 was kept in contact with the photoconductor 10 for seven days (168 hours). Additionally, changes in the contact pressure over time, which arise in a state in which the cleaning blade 5 was kept in contact with the photoconductor 10 and thus kept under pressure, were compared. The contact pressure of the cleaning blade 5 in contact with the photoconductor 10 was set to 20 g/cm.

Adverse effects of fatigue (due to the line pressure change) of the cleaning blade 5 on the cleaning capability were evaluated in the four ratings under a condition of high charging current, which increases the possibility of defective cleaning. When the line pressure is reduced by 4.0 g/cm, (20% of a specified line pressure), cleaning becomes defective.

Evaluations were made in the three environments, namely, the cold environment (10° C.), the ordinary temperature environment (23° C.), and the hot environment (32° C.), and the rating was made based on the largest reduction in line pressure among the three environments.

Excellent: Reduction in line pressure is 3.0 g/cm (15% of specified line pressure) or smaller. Cleaning capability is not affected, and the degree of margin is large.

Good: Reduction in line pressure is 4.0 g/cm (20% of specified line pressure) or smaller. Cleaning capability is not affected.

Acceptable: Reduction in line pressure is 5.0 g/cm (25% of specified line pressure) or greater. Cleaning capability is affected.

Poor: Reduction in line pressure is 6.0 g/cm (30% of specified line pressure) or greater. Cleaning capability is significantly affected.

[Evaluation Results]

Configuration 1

The cross-sectional area $S_A$ of the edge region 206 is 6.3 $mm^2$, the cross-sectional area $S_B$ of the adjacent region 207 is 16.3 $mm^2$, the tan δ variation $L_1$ of the edge region 206 is 0.30, and the tan δ variation $L_2$ of the adjacent region 207 is 0.20. The converted tan δ (X) calculated from Formula 4 is 0.23.

The converted tan δ (X) of this configuration is within the range of from 0.23 to 0.51.

The cross-sectional area $S_B$ of the adjacent region 207 is greater than the cross-sectional area $S_A$ of the edge region 206 ($S_B>S_A$), and the tan δ variation $L_2$ of the adjacent region 207 is smaller than the tan δ variation $L_1$ of the edge region 206 ($L_2<L_1$) in the temperature range of from 0° C. to 50° C.

The edge region 206 has a Martens hardness of 2.0 $N/mm^2$ or greater, similar to Embodiment 3-6.

With these features, inhibition of streaky voids and filming in image output on 15,000 sheets was rated as good. That is, effects of filming were not observed with eyes on the output image, and image failure was not observed. On the photoconductor 10, a small amount of toner external additives adhering thereto is observed.

Additionally, effects of fatigue (due to the line pressure change) on the cleaning capability were rated as excellent. That is, the line pressure reduction was 3.0 g/cm (15% of specified line pressure) or smaller. The cleaning capability was not affected, and the degree of margin was large.

This indicates that, while the toner external additives are prevented from adhering to the photoconductor 10, thereby suppressing the occurrence of streaky voids and filming, the line pressure is prevented from lowing to the degree that the cleaning capability is affected.

Configurations 2 Through 5

Similar to Configuration 1, the converted tan δ (X) is within the range of from 0.23 to 0.51.

The cross-sectional area $S_B$ of the adjacent region 207 is greater than the cross-sectional area $S_A$ of the edge region 206 ($S_B>S_A$), and the tan δ variation $L_2$ of the adjacent region 207 is smaller than the tan δ variation $L_1$ of the edge region 206 ($L_2<L_1$) in the temperature range of from 0° C. to 50° C.

The edge region 206 has a Martens hardness of 2.0 $N/mm^2$ or greater, similar to Configuration 1.

With these features, inhibition of streaky voids and filming in image output on 15,000 sheets was rated as excellent or good. That is, effects of filming were not observed with eyes on the output image, and image failure was not observed. The toner external additives adhering to the photoconductor 10 are hardly observed, or the amount is small.

Additionally, effects of fatigue (due to the line pressure change) on the cleaning capability were rated as excellent or good. That is, the line pressure reduction was 4.0 g/cm (20% of specified line pressure) or smaller. The cleaning capability was not affected.

This indicates that, while the toner external additives are prevented from adhering to the photoconductor 10, thereby suppressing the occurrence of streaky voids and filming, the line pressure is prevented from lowing to the degree to affect the cleaning capability.

Comparative Examples 1 Through 4

Similar to Configurations 1 through 5, the converted tan δ (X) is within the range of from 0.23 to 0.51, and the edge region 206 has a Martens hardness of 2.0 $N/mm^2$ or greater.

However, Comparative examples 1 through 4 do not satisfy at least one of the preferable relation between the cross-sectional area $S_A$ of the edge region 206 and the cross-sectional area SB of the adjacent region 207 ($S_B>S_A$), and the preferable relation between the tan δ variation $L_1$ of the edge region 206 and the tan δ variation $L_2$ of the adjacent region 207 ($L_2<L_1$) in the temperature range of from 0° C. to 50° C.

With these features, inhibition of streaky voids and filming in image output on 15,000 sheets was rated as excellent or good. That is, effects of filming were not observed with eyes on the output image, and image failure was not observed. The toner external additives adhering to the photoconductor 10 are hardly observed, or the amount is small.

However, effects of fatigue (due to the line pressure change) on the cleaning capability were rated as acceptable or poor. That is, the line pressure reduction was 5.0 g/cm (25% of specified line pressure) or greater. The cleaning capability was affected.

According to the verification results, the edge region 206, which is harder, is dominant in the posture and the behavior of the entire cleaning blade 5. Alternatively, the harder edge layer 6 causes fatigue of the cleaning blade 5 or reduces the conforming performance. Then, line pressure decreases, thereby degrading the cleaning capability.

Thus, the verification results confirm that the above-described features of Embodiment 1-6 suppress fluctuations in behavior and posture of the entire cleaning blade 5 caused by environmental changes, and the cleaning capability is prevented from lowering below the specified capability designed for the standard environment.

Embodiment 3-8

Embodiment 3-8 of the cleaning blade 5 usable in the cleaning device 1 according to the third embodiment is described.

It is to be noted that the cleaning blade 5 according to present embodiment is different from the cleaning blade 5 according Embodiment 3-6 only in that the edge region 206 is greater in Martens hardness than the adjacent region 207.

Therefore, description of a structure similar to Embodiment 3-6, and an action and an effect thereof will be omitted appropriately. Unless it is necessary to distinguish, the same reference characters will be given to the same or similar elements in descriptions below.

When both of the edge region 206 and the adjacent region 207 of the two-region cleaning blade 5 are relatively high in hardness, the entire cleaning blade 5 is relatively high in hardness, and the conforming performance of the cleaning blade 5 is lowered from the following reason.

When urethane rubber, which is widely used in cleaning blades, is increased in hardness to enhance the capability to remove substances adhering to the contact object (e.g., the photoconductor 10), elasticity thereof decreases. Accordingly, when the adjacent region 207 is high in hardness, the performance of the cleaning blade 5 to conform to the surface unevenness of the contact object decreases.

When the conforming performance decreases, an increased amount of toner can escape the cleaning blade 5, and the cleaning capability is degraded.

In view of the foregoing, in the cleaning blade 5 according to the present embodiment, the edge region 206 is made greater in Martens hardness than the adjacent region 207, in addition to the structure of Embodiment 3-6.

When the edge region 206 is higher in hardness than the adjacent region 207, the capability of the edge region 206 can be separated from that of the adjacent region 207.

The edge region 206 has a higher hardness to scrape off toner external additives from the photoconductor 10, and the adjacent region 207 has a lower hardness to maintain elasticity to secure the conforming performance of the entire cleaning blade 5.

Next, a verification experiment performed to ascertain effects of the cleaning blade 5 according to the present embodiment is described.

The tan δ of each layer was measured in a manner similar to that in Embodiment 3-1.

Multiple configurations of the cleaning blade 5 according to the present embodiment and comparative examples, used in the verification experiment, and verification results thereof are indicated in Table 16 below.

TABLE 16

| | X | $S_A$ [mm$^2$] | $S_B$ [mm$^2$] | $L_1$ | $L_2$ | Martens hardness [N/mm$^2$] Edge region | Adjacent region | Cleaning capability |
|---|---|---|---|---|---|---|---|---|
| Configuration 1 | 0.28 | 6.3 | 16.3 | 0.5 | 0.2 | 2.2 | 0.9 | Excellent |
| Configuration 2 | 0.28 | 6.3 | 16.3 | 0.5 | 0.2 | 2.9 | 1.0 | Excellent |
| Configuration 3 | 0.28 | 6.3 | 16.3 | 0.5 | 0.2 | 3.5 | 1.1 | Good |
| Configuration 4 | 0.28 | 6.3 | 16.3 | 0.5 | 0.2 | 3.9 | 1.0 | Good |
| Comparative example 1 | 0.28 | 6.3 | 16.3 | 0.5 | 0.2 | 2.1 | 3.1 | Poor |
| Comparative example 2 | 0.28 | 6.3 | 16.3 | 0.5 | 0.2 | 2.2 | 2.5 | Poor |
| Comparative example 3 | 0.28 | 6.3 | 16.3 | 0.5 | 0.2 | 2.0 | 4.2 | Poor |
| Comparative example 4 | 0.28 | 6.3 | 16.3 | 0.5 | 0.2 | 2.0 | 3.5 | Poor |

[Evaluation Method]

Cleaning capability was evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 4 and Comparative examples 1 through 4 listed in Table 16.

In each of the cold environment (10° C.), the ordinary temperature environment (23° C.), and the hot environment (32° C.), images were successively output on 25,000 sheets after the test machine was left unused for 24 hour. To input a greater amount of toner to the photoconductor 10 (image bearer), a solid image extending entirely in A4 size was output.

The cleaning capability was evaluated in the following manner and rated in four grades of "Excellent", "Good", "Acceptable", and "Poor".

Excellent: In each of the three environments, no trace of defective cleaning is observed on the sheet after feeding of 25,000 sheets. There is no practical disadvantage. Defective cleaning does not occur even under a severe condition in which the charging current is increased, which is a harsh condition for cleaning.

Good: In each of the three environments, no trace of defective cleaning is observed on the sheets after output of 25,000 sheets. There is no practical disadvantage.

Acceptable: In each of the three environments, no trace of defective cleaning is observed on the sheets after output of 25,000 sheets. Although there is no practical disadvantage, in one of the three environments, toner escaping the cleaning blade on the photoconductor 10 was observed.

Poor: In one of the three environments, the trace of defective cleaning was observed on the sheets after output of 25,000 sheets. In practice, the outputs images were substandard.

[Evaluation Results]

Configuration 1

The cross-sectional area $S_A$ of the edge region 206 is 6.3 mm$^2$, the cross-sectional area $S_B$ of the adjacent region 207 is 16.3 mm$^2$, the tan δ variation $L_1$ of the edge region 206 is 0.50, and the tan δ variation $L_2$ of the adjacent region 207 is 0.20. The converted tan δ (X) calculated from Formula 4 is 0.28.

The converted tan δ (X) of this configuration is within the range of from 0.23 to 0.51.

The edge region 206 has a Martens hardness (edge Martens hardness) of 2.2 N/mm$^2$, which is greater than 2.0 N/mm$^2$.

The adjacent region 207 has a Martens hardness of 0.9 N/mm$^2$, and the edge region 206 is higher in Martens hardness than the adjacent region 207.

With these features, cleaning capability was rated as excellent in any of the cold environment (10° C.), the ordinary temperature environment (23° C.), and the hot environment (32° C.) even in the cleaning capability evaluation in which 25,000 sheets were output. That is, defective cleaning was not obvious on the transfer sheets, and there is no disadvantage in practice.

This means that, since the edge region 206 is higher in hardness to scrape off toner external additives from the photoconductor 10 and the adjacent region 207 is lower in hardness to maintain elasticity, preferable conforming performance of the entire cleaning blade 5 is maintained.

Configurations 2 Through 4

Similar to Configuration 1, the cross-sectional area $S_A$ of the edge region 206 is 6.3 mm$^2$, the cross-sectional area $S_B$ of the adjacent region 207 is 16.3 mm$^2$, the tan δ variation $L_1$ of the edge region 206 is 0.50, and the tan δ variation $L_2$ of the adjacent region 207 is 0.20. The converted tan δ (X) calculated from Formula 4 is 0.28.

The converted tan δ (X) of this configuration is within the range of from 0.23 to 0.51. The edge region 206 has a Martens hardness greater than 2.0 N/mm$^2$. The edge region 206 is higher in Martens hardness than the adjacent region 207.

With these features, cleaning capability was rated as excellent or good in any of the cold environment (10° C.), the ordinary temperature environment (23° C.), and the hot environment (32° C.) even in the cleaning capability evaluation in which 25,000 sheets were output. That is, defective cleaning was not obvious on the transfer sheets, and there is no practical disadvantage.

This means that, similar to Configuration 1, since the edge region 206 is higher in hardness to scrape off toner external additives from the photoconductor 10 and the adjacent region 207 is lower in hardness to maintain elasticity, preferable conforming performance of the entire cleaning blade 5 is maintained.

Comparative Examples 1 Through 4

Similar to Configurations 1 through 4, the cross-sectional area $S_A$ of the edge region 206 is 6.3 $mm^2$, the cross-sectional area $S_B$ of the adjacent region 207 is 16.3 $mm^2$, the tan δ variation $L_1$ of the edge region 206 is 0.50, and the tan δ variation $L_2$ of the adjacent region 207 is 0.20. The converted tan δ (X) calculated from Formula 4 is 0.28.

However, the edge region 206 is lower in Martens hardness than the adjacent region 207.

Regarding cleaning capability, these structures were rated as poor in any one of the cold environment (10° C.), the ordinary temperature environment (23° C.), and the hot environment (32° C.) in the cleaning capability evaluation in which 25,000 sheets were output. That is, defective cleaning was obvious on the transfer sheets in one of these environments, and there is a practical disadvantage.

According to the verification results, since the edge region 206 is lower in hardness than the adjacent region 207 differently from Configurations 1 through 4, the conforming performance of the cleaning blade 5 decreases, and defective cleaning occurs.

The verification results confirm that Embodiment 3-8, in which the edge region 206 is higher in hardness to scrape off toner external additives from the photoconductor 10 and the adjacent region 207 is lower in hardness to maintaining elasticity, is advantageous in maintaining the conforming performance of the entire cleaning blade 5.

Embodiment 3-9

Embodiment 3-9 of the cleaning blade 5 usable in the cleaning device 1 according to the third embodiment is described.

It is to be noted that Embodiment 3-9 is different from Embodiment 3-6 only in that a preferable range of the elastic power of each of the edge region 206 and the adjacent region 207 is specified.

Therefore, description of a structure similar to Embodiment 3-6, and an action and an effect thereof will be omitted appropriately. Unless it is necessary to distinguish, the same reference characters will be given to the same or similar elements in descriptions below.

When the elastic power of each of the edge region 206 and the adjacent region 207 is lower (the ratio of plastic work in deformation is greater), permanent deformation of the cleaning blade 5 easily arises. Then, the permanent deformation thereof causes fatigue of the cleaning blade 5, and the contact pressure (line pressure) of the edge 61 (blade edge) pressed to the photoconductor 10 decreases. Then, defective cleaning occurs easily.

In view of the foregoing, in Embodiment 3-9, in addition to the features of Embodiment 3-6, the edge region 206 has an elastic power of 40% or greater and 90% or smaller (i.e., a range of from 40% to 90%), and the adjacent region 207 has an elastic power of 70% or greater and 95% or smaller (i.e., a range of from 70% to 95%).

This structure inhibits the line pressure from significantly decreasing to a degree to degrade the cleaning capability and makes the deformation of the entire cleaning blade 5 not plastic but elastic. Accordingly, fatigue of the cleaning blade 5 is suppressed.

Next, a verification experiment performed to ascertain effects of the cleaning blade 5 according to the present embodiment is described.

The tan δ of each layer was measured in a manner similar to that described above.

Multiple configurations of the cleaning blade 5 according to the present embodiment and comparative examples, used in the verification experiment, and verification results thereof are indicated in Table 17 below.

TABLE 17

| | | | | | | Elastic pawer ratio [%] | | Line |
|---|---|---|---|---|---|---|---|---|
| | X | $S_A$ [$mm^2$] | $S_B$ [$mm^2$] | $L_1$ | $L_2$ | Edge region | Adjacent region | pressure change |
| Configuration 1 | 0.28 | 6.3 | 16.3 | 0.5 | 0.2 | 90 | 95 | Excellent |
| Configuration 2 | 0.28 | 6.3 | 16.3 | 0.5 | 0.2 | 82 | 88 | Excellent |
| Configuration 3 | 0.28 | 6.3 | 16.3 | 0.5 | 0.2 | 71 | 75 | Excellent |
| Configuration 4 | 0.28 | 6.3 | 16.3 | 0.5 | 0.2 | 79 | 81 | Good |
| Configuration 5 | 0.28 | 6.3 | 16.3 | 0.5 | 0.2 | 55 | 75 | Good |
| Configuration 6 | 0.28 | 6.3 | 16.3 | 0.5 | 0.2 | 40 | 70 | Good |
| Comparative example 1 | 0.28 | 6.3 | 16.3 | 0.5 | 0.2 | 65 | 60 | Acceptable |
| Comparative example 2 | 0.28 | 6.3 | 16.3 | 0.5 | 0.2 | 56 | 49 | Poor |
| Comparative example 3 | 0.28 | 6.3 | 16.3 | 0.5 | 0.2 | 47 | 42 | Poor |
| Comparative example 4 | 0.28 | 6.3 | 16.3 | 0.5 | 0.2 | 40 | 33 | Poor |

[Evaluation Method]

The occurrence of filming and effects of fatigue on the cleaning capability were evaluated under the following conditions.

As a test machine (image forming apparatus), Ricoh PC 3503 was used. In the test machine, the cleaning blade 5 of the process cartridge 121 illustrated in FIG. 2 was replaced with those according to Configurations 1 through 6 and Comparative examples 1 through 4 indicated in Table 7.

As changes in line pressure, a contact pressure (line pressure) of the edge 61 (i.e., the blade edge) was measured before and after the cleaning blade 5 was kept in contact with the photoconductor 10 for seven days (168 hours). Additionally, changes in the contact pressure over time, which arise in a state in which the cleaning blade 5 was kept in contact with the photoconductor 10 and thus kept under pressure, were compared. The contact pressure of the cleaning blade 5 in contact with the photoconductor 10 was set to 20 g/cm.

Adverse effects of fatigue (due to the line pressure change) of the cleaning blade 5 on the cleaning capability were evaluated in the four ratings under a condition of high charging current, which increases the possibility of defective cleaning. When the line pressure is reduced by 4.0 g/cm, (20% of a specified line pressure), cleaning becomes defective.

Evaluations were made in the three environments, namely, the cold environment (10° C.), the ordinary temperature environment (23° C.), and the hot environment (32° C.), and the rating was made based on the largest reduction in line pressure among the three environments.

Excellent: Reduction in line pressure is 3.0 g/cm (15% of specified line pressure) or smaller. Cleaning capability is not affected, and the degree of margin is large.

Good: Reduction in line pressure is 4.0 g/cm (20% of specified line pressure) or smaller. Cleaning capability is not affected.

Acceptable: Reduction in line pressure is 5.0 g/cm (25% of specified line pressure) or greater. Cleaning capability is affected.

Poor: Reduction in line pressure is 6.0 g/cm (30% of specified line pressure) or greater. Cleaning capability is significantly affected.

[Evaluation Results]

Configuration 1

The cross-sectional area $S_A$ of the edge region 206 is 6.3 $mm^2$, the cross-sectional area $S_B$ of the adjacent region 207 is 16.3 $mm^2$, the tan δ variation $L_1$ of the edge region 206 is 0.50, and the tan δ variation $L_2$ of the adjacent region 207 is 0.20. The converted tan δ (X) calculated from Formula 4 is 0.28.

The converted tan δ (X) of this configuration is within the range of from 0.23 to 0.51. The elastic power of the edge region 206 is 90%, which is in the preferable range of from 40% to 90%, and the elastic power of the adjacent region 207 is 90%, which is in the preferable range of from 70% to 95%.

The edge region 206 has a Martens hardness of 2.0 $N/mm^2$ or greater, similar to Embodiment 3-6.

In this structure, effects of fatigue (due to the line pressure change) on the cleaning capability were rated as excellent. That is, the line pressure reduction was 3.0 g/cm (15% of specified line pressure) or smaller. The cleaning capability was not affected, and the degree of margin was large.

According to the verification results, the line pressure did not significantly decrease to a degree to degrade the cleaning capability, and the entire cleaning blade 5 deformed not plastically but elastically. Accordingly, fatigue of the cleaning blade 5 was suppressed.

Configurations 2 Through 6

Similar to Configuration 1, the converted tan δ (X) is 0.28, which is within the range of from 0.23 to 0.51. The elastic power of the edge region 206 is within the range of from 40% to 90%, and the elastic power of the adjacent region 207 is within the range of from 70% to 95%. The edge region 206 has a Martens hardness of 2.0 $N/mm^2$ or greater, similar to Configuration 1.

In this structure, effects of fatigue (due to the line pressure change) on the cleaning capability were rated as excellent or good. That is, the line pressure reduction was 3.0 g/cm (15% of specified line pressure) or smaller. The cleaning capability was not affected.

According to the verification results, the line pressure did not significantly decrease to a degree to degrade the cleaning capability, and the entire cleaning blade 5 deformed not plastically but elastically. Accordingly, fatigue of the cleaning blade 5 was suppressed.

Comparative Examples 1 Through 4

Similar to Configurations 1 through 6, the converted tan δ (X) is 0.28, which is within the range of from 0.23 to 0.51.

The edge region 206 has a Martens hardness of 2.0 $N/mm^2$ or greater, similar to Configuration 1.

Although the elastic power of the edge region 206 is within the range of from 40% to 90%, the elastic power of the adjacent region 207 is smaller than 70%.

In this structure, effects of fatigue (due to the line pressure change) on the cleaning capability were rated as acceptable or poor. That is, the line pressure reduction was 5.0 g/cm (25% of specified line pressure) or greater, and cleaning capability was affected.

According to the verification results, the line pressure significantly decreased to degrade the cleaning capability, and the entire cleaning blade 5 deformed plastically. Accordingly, fatigue of the cleaning blade 5 occurred.

Thus, the verification results confirm that the structure according to Embodiment 3-9 is advantageous in inhibiting the line pressure from significantly decreasing to degrade the cleaning capability and making the deformation of the entire cleaning blade 5 not plastic but elastic, thereby suppressing fatigue of the cleaning blade 5.

Thus, the cleaning blade 5 usable in the cleaning device 1 according to the third embodiment has been described using multiple configurations.

By incorporating one of the above-described configurations of the cleaning blade 5, the image forming apparatus 100 according to the third embodiment can exhibit an effect similar to that attained by the cleaning blade 5 incorporated.

For example, the image forming apparatus 100 can suppress generation of vibration and fatigue of the cleaning blade 5 due to environmental change (temperature change), which degrade the cleaning capability of the cleaning device 1, and accordingly suppress creation of substandard images caused by the degraded cleaning capability.

Since the image forming apparatus 100 according to the third embodiment incorporates the cleaning blade 5 including the edge region 206 and the adjacent region 207 and having the tan δ less dependent on the environment, vibration is suppressed, similar to the first embodiment, even when the charging device 40 employs the charging roller 41 to apply AC voltage to the surface of the photoconductor 10.

Thus, generation of noise due to vibration, abrasion and chipping of the cleaning blade 5, and abnormal abrasion of the photoconductor 10 are suppressed.

Similar to the first embodiment, in the image forming apparatus 100 according to the third embodiment, inorganic particles are included at the surface or in the surface layer of the photoconductor 10. It is possible to suppress vibration of the edge 61 by using the cleaning blade 5 including the edge region 206 and the adjacent region 207 and having the tan δ is less dependent on the environment.

The image forming apparatus 100 according to the third embodiment can thereby attain the effect of suppressing generation of abnormal noise due to vibration of the cleaning blade 5, abrasion or chipping of the cleaning blade 5, and abnormal abrasion of the photoconductor 10 even when the image forming apparatus 100 according to the second embodiment includes inorganic particles on a surface of the photoconductor 10.

A layer structure similar to that described in the first embodiment can be used for the photoconductor 10 of the image forming apparatus 100.

For the image forming apparatus 100 according to the third embodiment, toner similar to that described in the first embodiment can be used.

The configurations described above are just examples, and each of aspects of this specification attains a specific effect as described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A multilayered blade made of an elastic material, the blade comprising:

an edge layer having a contact edge to contact an object; and at least one backup layer laminated on the edge layer, the blade having a converted loss tangent tan δ of from 0.23 to 0.51 inclusive in a temperature range of from 0° C. to 50° C., the converted loss tangent tan δ defined as:

$$X = \frac{A}{A+B} \times L_1 + \frac{B}{A+B} \times L_2,$$

where X represents the converted loss tangent tan δ, A represents a thickness in millimeters of the edge layer, B represents a thickness in millimeters of the at least one backup layer, $L_1$ represents a variation of a loss tangent tan δ of the edge layer in the temperature range of from 0° C. to 50° C., $L_2$ represents a variation of a loss tangent tan δ of the at least one backup layer in the temperature range of from 0° C. to 50° C., and the variation ($L_1$) of the loss tangent tan δ of the edge layer is equal to or greater than the variation ($L_2$) of the loss tangent tan δ of the at least one backup layer.

2. The blade according to claim 1, wherein the variation ($L_1$) of the loss tangent tan δ of the edge layer is from 0.3 to 0.65 inclusive in the temperature range of from 0° C. to 50° C.

3. The blade according to claim 1, wherein the variation ($L_2$) of the loss tangent tan δ of the at least one backup layer is from 0.2 to 0.5 inclusive in the temperature range of from 0° C. to 50° C.

4. The blade according to claim 1, wherein, in the temperature range of from 0° C. to 50° C., the converted loss tangent tan δ is from 0.23 to 0.35 inclusive, the variation ($L_1$) of the loss tangent tan δ of the edge layer is from 0.3 to 0.5 inclusive, and the variation ($L_2$) of the loss tangent tan δ of the at least one backup layer is from 0.2 to 0.3 inclusive.

5. The blade according to claim 1, wherein a Martens hardness of the edge layer is 2.0 $N/mm^2$ or greater.

6. The blade according to claim 5, wherein the at least one backup layer is thicker than the edge layer, and wherein the variation ($L_2$) of the loss tangent tan δ of the at least one backup layer is smaller than the variation ($L_1$) of the loss tangent tan δ of the edge layer in the temperature range of from 0° C. to 50° C.

7. The blade according to claim 5, wherein the Martens hardness of the edge layer is greater than a Martens hardness of the at least one backup layer.

8. The blade according to claim 5, wherein an elastic power of the edge layer is from 40% to 90% inclusive, and wherein an elastic power of the at least one backup layer is from 70% to 95% inclusive.

9. An image forming apparatus comprising:

an image bearer to bear an image;

a charger configured to charge a surface of the image bearer;

an exposure device configured to expose the surface of the charged image bearer to form an electrostatic latent image on the image bearer;

a developing device configured to develop the electrostatic latent image into a toner image;

a transfer device configured to transfer the toner image from the image bearer onto a recording medium;

a fixing device configured to fix the toner image on the recording medium; and a cleaning device configured to remove residual toner from the image bearer, the cleaning device including the blade according to claim 1.

10. A multilayered blade made of an elastic material, the blade comprising:

an edge layer having a contact edge to contact an object;

a first backup layer laminated on the edge layer; and a second backup layer laminated on the first backup layer, the blade having a converted loss tangent tan δ of from 0.23 to 0.51 inclusive in a temperature range of from 0° C. to 50° C., the converted loss tangent tan δ defined as:

$$X = \frac{A}{A+B} \times L_1 + X_B, \text{ and}$$

$$X_B = \frac{B_1}{A+B} \times L_{B1} + \frac{B_2}{A+B} \times L_{B2}$$

where X represents the converted loss tangent tan δ, A represents a thickness in millimeters of the edge layer, $B_1$ represents a thickness in millimeters of the first backup layer, $B_2$ represents a thickness in millimeters of the second backup layer, B represents $B_1$ and $B_2$ added together, $L_1$ represents a variation of a loss tangent tan δ of the edge layer in the temperature range of from 0° C. to 50° C., $L_{B1}$ represents a variation of a loss tangent tan δ of the first backup layer in the temperature range of from 0° C. to 50° C., $L_{B2}$ represents a variation of a loss tangent tan δ of the second backup layer in the temperature range of from 0° C. to 50° C., the variation ($L_1$) of the loss tangent tan δ of the edge layer is equal to or greater than the variation ($L_{B1}$) of the loss tangent tan δ of the first backup layer, and the variation ($L_1$) of the loss tangent tan δ of the edge layer is equal to or greater than the variation ($L_{B2}$) of the loss tangent tan δ of the second backup layer.

11. An image forming apparatus comprising:

an image bearer configured to bear an image;

a charger configured to charge a surface of the image bearer;

an exposure device configured to expose the surface of the charged image bearer to form an electrostatic latent image on the image bearer;

a developing device configured to develop the electrostatic latent image into a toner image;

a transfer device configured to transfer the toner image from the image bearer onto a recording medium;

a fixing device configured to fix the toner image on the recording medium; and a cleaning device configured to remove residual toner from the image bearer, the cleaning device including the blade according to claim 10.

12. An elastic blade comprising:

an edge region having a contact edge to contact an object; and an adjacent region adjacent to the edge region on a cross section perpendicular to a direction in which the contact edge extends, the blade having a converted loss tangent tan δ of from 0.23 to 0.51 inclusive in a temperature range of from 0° C. to 50° C., the converted loss tangent tan δ defined as:

$$X = \frac{S_A}{S_A + S_B} \times L_1 + \frac{S_B}{S_A + S_B} \times L_2,$$

where X represents the converted loss tangent tan δ, $S_A$ represents a cross-sectional area in square millimeters of the edge region, $S_B$ represents a cross-sectional area in square millimeters of the adjacent region, $L_1$ represents a variation of a loss tangent tan δ of the edge region in the temperature range of from 0° C. to 50° C., $L_2$ represents a variation of a loss tangent tan δ of the adjacent region in the temperature range of from 0° C. to 50° C., and the variation ($L_1$) of the loss tangent tan δ of the edge region is equal to or greater than the variation ($L_2$) of the loss tangent tan δ of the adjacent region.

13. An image forming apparatus comprising:

an image bearer to bear an image;

a charger configured to charge a surface of the image bearer;

an exposure device configured to expose the surface of the charged image bearer to form an electrostatic latent image on the image bearer;

a developing device configured to develop the electrostatic latent image into a toner image;

a transfer device configured to transfer the toner image from the image bearer onto a recording medium;

a fixing device configured to fix the toner image on the recording medium; and a cleaning device configured to remove residual toner from the image bearer, the cleaning device including the blade according to claim 12.

* * * * *